US010845724B2

(12) United States Patent
Kikuchi et al.

(10) Patent No.: US 10,845,724 B2
(45) Date of Patent: Nov. 24, 2020

(54) ELECTRO-CONDUCTIVE MEMBER, PROCESS CARTRIDGE AND IMAGE FORMING APPARATUS

(71) Applicant: CANON KABUSHIKI KAISHA, Tokyo (JP)

(72) Inventors: Yuichi Kikuchi, Suntou-gun (JP); Satoru Nishioka, Suntou-gun (KR); Kenji Takashima, Yokohama (JP); Kazuhiro Yamauchi, Suntou-gun (JP); Masahiro Kurachi, Susono (JP); Takumi Furukawa, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/829,309

(22) Filed: Mar. 25, 2020

(65) Prior Publication Data

US 2020/0310266 A1 Oct. 1, 2020

(30) Foreign Application Priority Data

Mar. 29, 2019 (JP) ..... 2019-069097
Oct. 18, 2019 (JP) ..... 2019-191571

(51) Int. Cl.
*G03G 15/02* (2006.01)
*G03G 15/16* (2006.01)

(52) U.S. Cl.
CPC ..... *G03G 15/0233* (2013.01); *G03G 15/1685* (2013.01)

(58) Field of Classification Search
CPC ..... G03G 15/0233; G03G 15/1685
(Continued)

(56) References Cited

U.S. PATENT DOCUMENTS 3,640,708 A 2/1972 Humphriss et al.
6,070,040 A 5/2000 Goto et al.
(Continued)

FOREIGN PATENT DOCUMENTS

EP 3048489 A 7/2016
EP 3073324 A 9/2016
(Continued)

OTHER PUBLICATIONS

European Search Report dated Aug. 13, 2020 in counterpart application EP 20165807.7. (10 pages).

*Primary Examiner* — Robert B Beatty
(74) *Attorney, Agent, or Firm* — Venable LLP

(57) ABSTRACT

Provided an electro-conductive member that can be used as a charging member capable of preventing the emergence of a ghost image. The member comprises an electro-conductive support and an electro-conductive layer, the electro-conductive layer has a matrix including a first cross-linked rubber, and domains, the domains each includes a second cross-linked rubber and an electronically conductive agent, at least some of the domains are exposed to an outer surface of the member to constitute protrusions, the outer surface is constituted by the matrix and the exposed domains, and in a double logarithmic plot with a frequency on the abscissa and an impedance on the ordinate, a slope at a frequency of $1.0\times10^{5}$ Hz to $1.0\times10^{6}$ Hz is −0.8 to −0.3, and an impedance at a frequency of $1.0\times10^{-2}$ Hz to $1.0\times10^{1}$ Hz is $1.0\times10^{3}$ to $1.0\times10^{7}\Omega$.

20 Claims, 12 Drawing Sheets

(58) Field of Classification Search
USPC ..... 399/176, 313; 492/18, 56
See application file for complete search history.

(56) References Cited

U.S. PATENT DOCUMENTS

| | | | | |
|---|---|---|---|---|
| 6,697,587 | B2 | 2/2004 | Harada | |
| 7,744,515 | B2 | 6/2010 | Iwamura | |
| 8,163,389 | B2 | 4/2012 | Hirakawa et al. | |
| 8,275,293 | B2 | 9/2012 | Ono | |
| 8,491,994 | B2 | 7/2013 | Harada et al. | |
| 10,012,924 | B2 | 7/2018 | Yoshidome et al. | |
| 2007/0230975 | A1* | 10/2007 | Yamazaki ..... | G03G 15/0233 399/31 |
| 2012/0237863 | A1 | 9/2012 | Wu | |
| 2013/0195517 | A1 | 8/2013 | Jansen et al. | |
| 2014/0219679 | A1 | 8/2014 | Liu et al. | |
| 2014/0219682 | A1* | 8/2014 | Tsuto ..... | G03G 15/0233 399/176 |

FOREIGN PATENT DOCUMENTS

| | | | |
|---|---|---|---|
| JP | H09-279015 | | 10/1997 |
| JP | H11-231637 | | 8/1999 |
| JP | 2002-003651 | | 1/2002 |
| JP | 2005-321764 | | 11/2005 |
| JP | 2006-060456 | A | 2/2006 |
| JP | 2006-207807 | | 8/2006 |
| JP | 2007-163849 | | 6/2007 |
| JP | 2011-022410 | | 2/2011 |
| JP | 2012-163954 | | 8/2012 |
| JP | 2013-020175 | | 1/2013 |
| JP | 2015184589 | A * | 10/2015 |
| JP | 2016-018154 | | 2/2016 |
| JP | 2017-058639 | | 3/2017 |
| JP | 2017-072833 | | 4/2017 |
| WO | 2019/203225 | | 10/2019 |
| WO | 2019/203227 | | 10/2019 |
| WO | 2019/203238 | | 10/2019 |
| WO | 2019/203321 | | 10/2019 |

* cited by examiner

SCHEMATIC DIAGRAM OF ELECTROPHOTOGRAPHIC PROCESS

ELECTRO-CONDUCTIVE MEMBER, PROCESS CARTRIDGE AND IMAGE FORMING APPARATUS

BACKGROUND OF THE INVENTION

Field of the Invention

The present disclosure is directed to an electro-conductive member for electrophotography that can be used as a charging member, a development member or a transfer member in an electrophotographic image forming apparatus, a process cartridge and an electrophotographic image forming apparatus.

Description of the Related Art

Electro-conductive members such as charging members, transfer members or development members are used in electrophotographic image forming apparatuses. Electro-conductive members configured to have an electro-conductive support and an electro-conductive layer disposed on the support are known as the electro-conductive members. Such an electro-conductive member plays a role in transporting charge from the electro-conductive support to the electro-conductive member surface and applying the charge to a contact object through discharge or frictional charging.

The charging member is a member that causes discharge between the charging member and an electrophotographic photosensitive member and thereby charges the electrophotographic photosensitive member surface. The development member is a member that controls the charge of a developing agent coating its surface through frictional charging and thereby confers a uniform charge distribution, and subsequently uniformly transfers the developing agent to the surface of the electrophotographic photosensitive member according to an applied electric field. The transfer member is a member that transfers a developing agent to a printing medium or an intermediate transfer body from the electrophotographic photosensitive member while stabilizing the developing agent thus transferred through discharge.

Each of these electro-conductive members needs to achieve uniform charging for an electrophotographic photosensitive member or a contact object such as an intermediate transfer body or a printing medium.

Japanese Patent Application Laid-Open No. 2002-3651 discloses a rubber composition having a matrix-domain structure including a polymer continuous phase consisting of an ionic conductive rubber material composed mainly of raw rubber A having a volume resistivity of $1\times10^{12}$ Ω·cm or smaller, and a polymer particle phase consisting of an electronic conductive rubber material conducted by blending an electro-conductive particle with raw rubber B, and a charging member having an elastic layer formed from the rubber composition.

SUMMARY OF THE INVENTION

One aspect of the present disclosure is directed to providing an electro-conductive member that is capable of stably charging an object to be charged even when applied to a high-speed electrophotographic image formation process, and can be used as a charging member, a development member or a transfer member.

Another aspect of the present disclosure is directed to providing a process cartridge that contributes to the formation of an electrophotographic image of high grade. A further alternative aspect of the present disclosure is directed to providing an electrophotographic image forming apparatus that can form an electrophotographic image of high grade.

According to one aspect of the present disclosure, there is provided an electro-conductive member for electrophotography including a support having an electro-conductive outer surface and an electro-conductive layer on the outer surface of the support, an electro-conductive layer on the outer surface of the support, the electro-conductive layer having a matrix comprising a first cross-linked rubber, and domains dispersed in the matrix, the domains each comprising a second cross-linked rubber and an electronically conductive agent, at least some of the domains being exposed to an outer surface of the electro-conductive member to constitute protrusions on an outer surface of the electro-conductive member, the outer surface of the electro-conductive member being constituted by the matrix and the domains exposed to the outer surface of the electro-conductive member, wherein in a double logarithmic plot with a frequency on the abscissa and an impedance on the ordinate, a slope at a frequency of $1.0\times10^{5}$ Hz to $1.0\times10^{6}$ Hz is −0.8 or more and −0.3 or less, and an impedance at a frequency of $1.0\times10^{-2}$ Hz to $1.0\times10^{1}$ Hz is $1.0\times10^{3}$ to $1.0\times10^{7}$ω, the impedance being measured by applying an alternating-current voltage with an amplitude of 1 V to between the outer surface of the support and a platinum electrode directly provided on the outer surface of the electro-conductive member while varying the frequency between $1.0\times10^{-2}$ Hz and $1.0\times10^{7}$ Hz in an environment involving a temperature of 23° C. and a relative humidity of 50%.

According to another aspect of the present disclosure, there is provided a process cartridge configured to be detachably attachable to a main body of an electrophotographic image forming apparatus, the process cartridge for electrophotography including the electro-conductive member described above. According to a further alternative aspect of the present disclosure, there is provided an electrophotographic image forming apparatus including the electro-conductive member described above.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to the studies of the present inventors, a charging member as disclosed in Japanese Patent Application Laid-Open No. 2002-3651 has been confirmed to be excellent in uniform charging properties for an object to be charged. However, the present inventors have recognized that the charging member is still susceptible to improvement in terms of a recent higher speed of an image formation process. Specifically, the charging member according to Japanese Patent Application Laid-Open No. 2002-3651, when subjected to a high-speed electrophotographic image formation process, was unable to sufficiently uniformize very small unevenness of potentials formed on the surface of an object to be charged before a charging step, in some cases. Furthermore, an electrophotographic image in which an image not supposed to be formed appears in a superimposed manner on an original image due to the uneven potentials (hereinafter, also referred to as a "ghost image") was formed in some cases.

The present inventors have presumed the following reason why the charging member according to Japanese Patent Application Laid-Open No. 2002-3651 causes a ghost image.

Figure 1A:
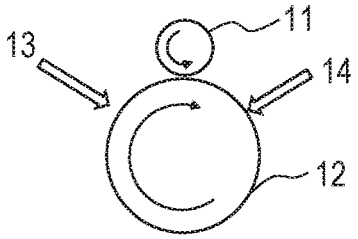
FIG. 1A is a schematic diagram of electrophotographic process.
Figure 1B:
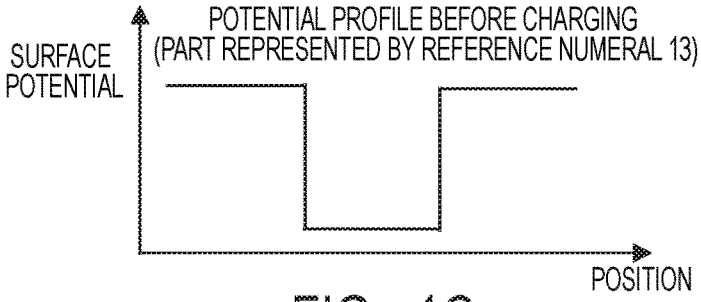
FIG. 1B is an image diagram of potential profile before charging.
Figure 1C:
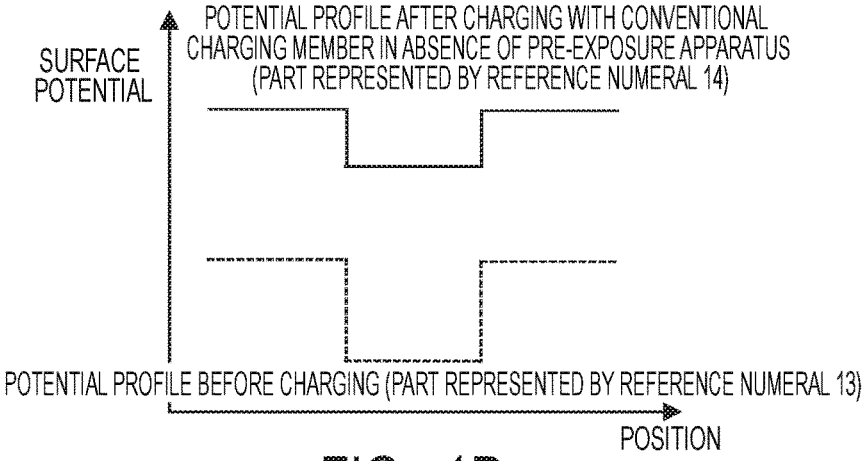
FIG. 1C is an image diagram of potential profile after charging with conventional charging number in absence of pre-exposure apparatus.

A phenomenon in which a ghost image emerges will be described with reference to FIG. 1A to FIG. 1D. In FIG. 1A, reference numeral 11 denotes a charging member, reference numeral 12 denotes a photosensitive drum, reference numeral 13 denotes a surface potential measurement part before a charging process, and reference numeral 14 denotes the surface potential measurement part after the charging process. Usually, a photosensitive drum that has undergone a transfer process has uneven surface potentials, as illustrated in FIG. 1B. Thus, the uneven surface potentials enter a charging process, and uneven charge potentials as illustrated in FIG. 1C are formed according to the uneven surface potentials so that a ghost image emerges. In this context, no ghost image emerges as long as the charging member has the ability to confer charge sufficient for uniformizing the uneven surface potentials.

However, it is considered that the charging member according to Japanese Patent Application Laid-Open No. 2002-3651 cannot sufficiently respond to shortened discharge intervals for an object to be charged in association with a higher speed of an electrophotographic image formation process. The mechanism thereof will be discussed as follows.

In a microgap in the neighborhood of a contact part between a charging member and a photosensitive drum, discharge usually occurs in a region where the relationship between the strength of an electric field and a microgap distance satisfies the Paschen's law. In an electrophotographic process of causing discharge while rotating the photosensitive drum, discharge is found to occur repetitively a plurality of times, not in sustained manner, from the onset point to the end point of discharge when one point of the charging member surface is monitored over time.

The present inventors have measured and analyzed the detailed discharge state of the charging member according to Japanese Patent Application Laid-Open No. 2002-3651 in a high-speed process using an oscilloscope. In the charging member according to Japanese Patent Application Laid-Open No. 2002-3651, a phenomenon was obtained in which a charging process part caused a timing at which discharge with a high frequency was less likely to occur, i.e., the omission of discharge. The omission of discharge presumably decreases the total amount of discharge and cannot compensate for uneven surface potentials.

Figure 2A:
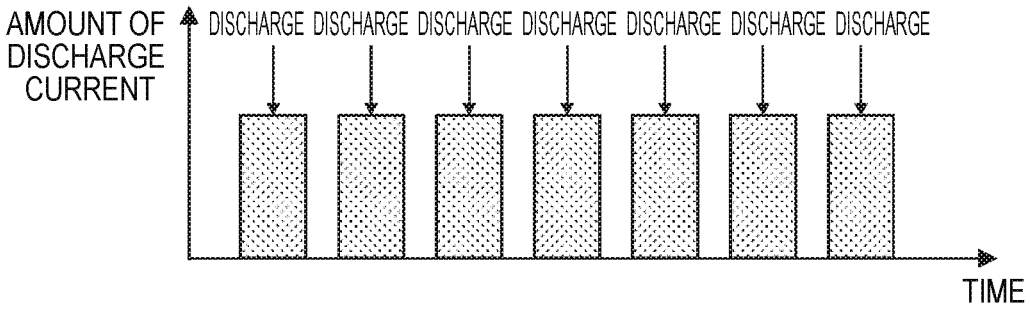
FIG. 2A is an image diagram of a state in which the total amount of discharge is sufficient without the omission of discharge.
Figure 2B:
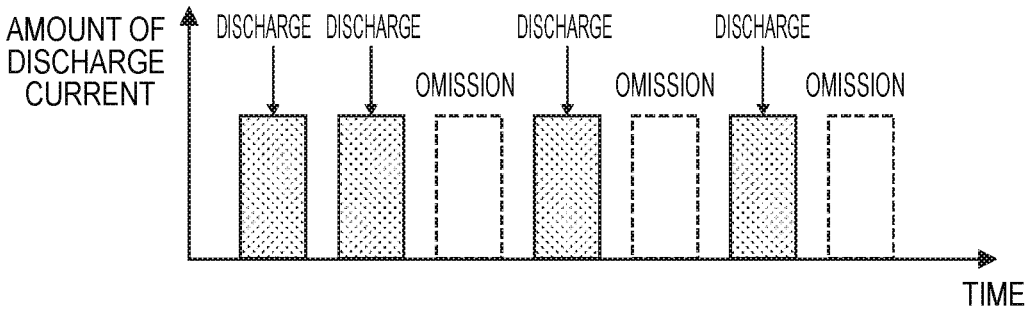
FIG. 2B is an image diagram of a state in which the total amount of discharge is insufficient due to the omission of discharge.

FIG. 2A and FIG. 2B illustrates an image diagram of a state in which the omission of discharge occurs. FIG. 2A illustrates a state in which the total amount of discharge is sufficient without the omission of discharge. FIG. 2B illustrates a state in which the total amount of discharge is insufficient due to the omission of discharge.

The omission of discharge occurs presumably because, first of all, charge is consumed through discharge on the surface of the charging member, and then, the supply of charge for subsequent discharge cannot keep pace with the consumption.

Thus, after the consumption of charge through discharge, the omission of discharge can be suppressed by improving a discharge frequency in order to rapidly supply the subsequent charge to the surface of the charging member.

In this context, the present inventors believe that mere rapid cycles of charging inside the charging member are not sufficient. Specifically, the omission of discharge may be suppressed by rapid cycles of charge consumption through discharge and charge supply on the surface of the charging member. However, when the amount of charge that can contribute to the cycles is decreased with reduction in the time required for the cycles, the amount of single discharge is decreased so that the total amount of discharge does not reach a level that uniformizes uneven surface potentials. Thus, the present inventors have thought that it is necessary not only to suppress the omission of discharge, i.e., to improve a discharge frequency, but also to improve the amount of single discharge.

The present inventors have further found that not only for the discharge phenomenon described above but for a contact part between a charging member and a photosensitive drum, a ghost image can be further suppressed by conferring an effect of uniformizing the uneven surface potentials of the photosensitive drum.

Accordingly, the present inventors have conducted studies to obtain an electro-conductive member that can accumulate sufficient charge in a short time, rapidly releases the charge, and is further capable of uniformizing uneven surface potentials even in its contact part with a photosensitive drum. As a result, the present inventors have found that an electro-conductive member configured as described below can well meet the requirements described above.

The electro-conductive member has a support having an electro-conductive outer surface and an electro-conductive layer disposed on the outer surface of the support. The electro-conductive layer has a matrix including a first cross-linked rubber, and a plurality of domains dispersed in the matrix. The domains include a second cross-linked rubber and an electronically conductive agent.

A platinum electrode is directly established on the outer surface of the electro-conductive member, and an alternating-current voltage with an amplitude of 1 V is applied to between the outer surface of the support and the electrode film in an environment involving a temperature of 23° C. and a humidity of 50% RH while varying the frequency between $1.0\times10^{-2}$ Hz and $1.0\times10^{7}$ Hz. An impedance is thereby measured. In a double logarithmic plot with a frequency on the abscissa and an impedance on the ordinate, the following first requirement and second requirement are both satisfied, and the following third requirement for a surface shape is further satisfied as a feature of a surface shape unique to a domain-matrix structure.

<First Requirement>

A slope at a frequency of $1.0\times10^{5}$ Hz to $1.0\times10^{6}$ Hz is −0.8 or more and −0.3 or less.

<Second Requirement>

An impedance at a frequency of $1.0\times10^{-2}$ Hz to $1.0\times10^{1}$ Hz is $1.0\times10^{3}$ to $1.0\times10^{7}\Omega$.

<Third Requirement>

At least some of the domains are exposed to the outer surface of the electro-conductive member so that protrusions are provided on the outer surface of the electro-conductive member, and the outer surface of the electro-conductive member has the matrix and the domains exposed to the outer surface of the electro-conductive member.

Figure 1D:
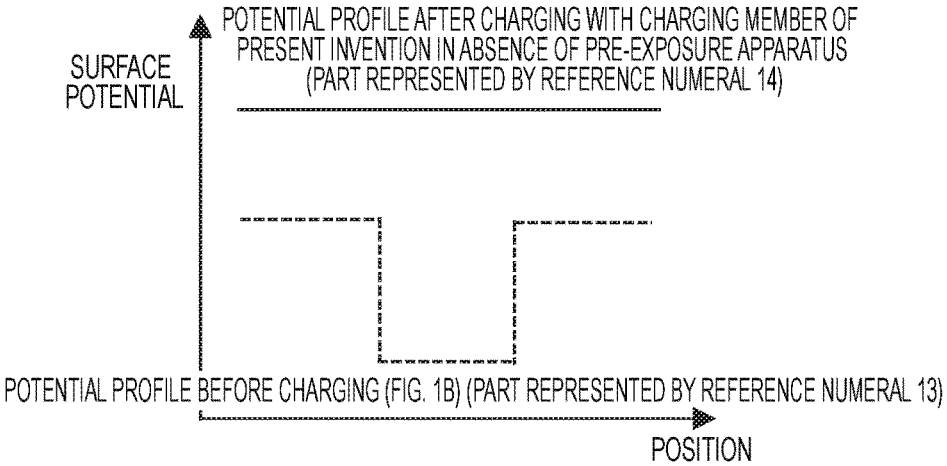
FIG. 1D is an image diagram of potential profile after charging with charging member of present invention in absence of pre-exposure apparatus.

Specifically, the electro-conductive member according to the present aspect can form a uniform charge potential profile as shown in FIG. 1D without the use of a pre-exposure apparatus for uniformizing uneven surface potentials.

Hereinafter, the electro-conductive member according to the present aspect will be described by taking its form as a charging member as an example. The electro-conductive member according to the present aspect is not limited by purposes as a charging member and is also applicable to, for example, a development member and a transfer member.

The electro-conductive member according to the present aspect has a support having an electro-conductive outer surface and an electro-conductive layer disposed on the outer surface of the support. The electro-conductive layer has electro-conductivity. In this context, the electro-conductivity is defined as a volume resistivity of smaller than $1.0\times10^{8}$ Ω·cm. The electro-conductive layer has a matrix including a first cross-linked rubber, and a plurality of domains dispersed in the matrix. The domains include a second cross-linked rubber and an electronically conductive agent. The electro-conductive member satisfies <first requirement>, <second requirement> and <third requirement> described above.

<First Requirement>

The first requirement stipulates that the stagnation of charge within the electro-conductive member is less likely to occur on a high-frequency side.

Figure 3:
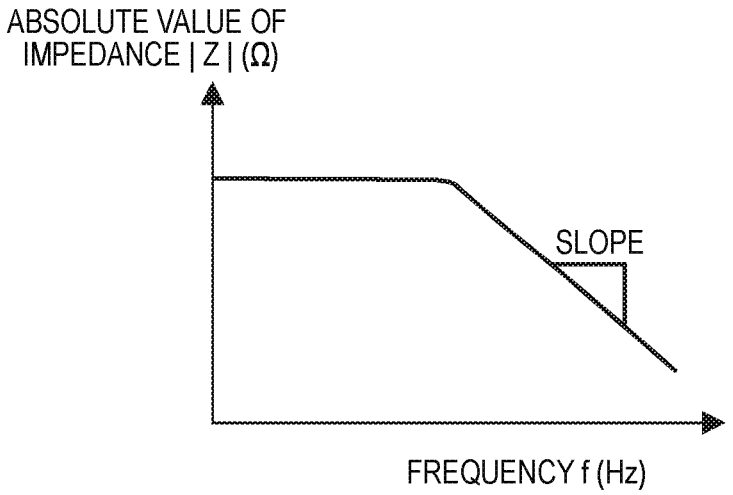
FIG. 3 is an illustrative view of a graph of impedance characteristics.

When the impedance of a conventional electro-conductive member is measured, a slope is always −1 on a high-frequency side. In this context, the slope refers to a slope with respect to the abscissa in a double logarithmic plot of the impedance characteristics of the electro-conductive member against a frequency, as illustrated in FIG. 3.

An equivalent circuit of the electro-conductive member is indicated by a parallel circuit of electrical resistance R and capacitance C. Absolute value |Z| of an impedance can be represented by expression (1) given below wherein f represents a frequency.

$$|Z| = \sqrt{\frac{1}{R^{-2} + (2\pi f)^2 C^2}} \tag{1}$$

The impedance assumes a straight line with a slope of −1 on a high-frequency side presumably because, since the motion of charge cannot match a high-frequency voltage and is thereby stagnated, largely increased electrical resistance value R, i.e., so-called capacitance of insulation, is measured. The state of stagnation of charge can be estimated as a state in which R in the expression (1) approximates infinity. In this respect, the factor of the denominator $(R^{-2}+(2\pi f)^2C^2)$ in the expression (1) enables approximation in which $R^{-2}$ takes a very small value with respect to $(2\pi f)^2C^2$. Thus, the expression (1) may be deformed into an approximate expression, for example, expression (2), by the removal of $R^{-2}$. Finally, the expression (2) is deformed into expression (3) so as to take the logarithm of both sides. Thus, the slope of log f is −1.

$$|Z| = \sqrt{\frac{1}{(2\pi f)^2 C^2}} \tag{2}$$

$$\log|Z| = -\log f - \log(2\pi C) \tag{3}$$

Figure 4:
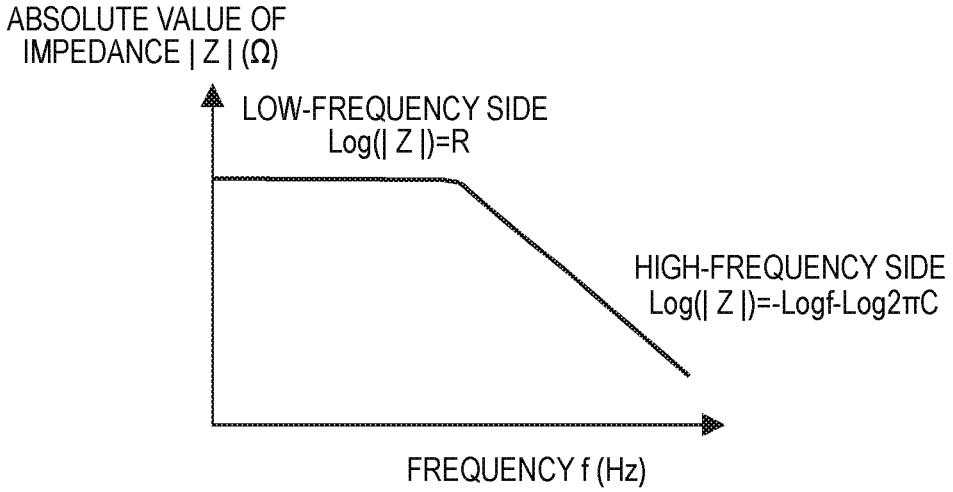
FIG. 4 is an illustrative view of impedance behavior.

The meanings of the expressions (1) to (3) will be described with reference to FIG. 4. In FIG. 4, the ordinate depicts the logarithm of the absolute value of an impedance (log|Z|), and the abscissa depicts the logarithm of a frequency (log f) of an oscillatory voltage for measurement. FIG. 4 illustrates impedance behavior represented by the expression (1). First of all, as described above, the absolute value of an impedance that satisfies the expression (1) starts to be decreased at a certain frequency as the frequency is increased. Such behavior of decrease assumes a straight line with a slope of −1 in a double logarithmic plot as illustrated in FIG. 4, without the dependence of the slope on the electrical resistance value of the charging member, a capacitance, etc., as represented by the expression (3).

Since measured impedance characteristics of an insulating resin layer assume a straight line with a slope of −1, the state with a slope of −1 in the impedance measurement of the electro-conductive layer in the electro-conductive member is presumed to appear as the property of stagnating the motion of charge on a high-frequency side. When the motion of charge on a high-frequency side is stagnated, the supply of charge for discharge cannot keep pace with a discharge frequency. As a result, there exists a timing at which discharge is lost, presumably resulting in the omission of discharge.

On the other hand, in the electro-conductive member according to the present disclosure, the slope of the impedance of the electro-conductive layer is −0.8 or more and −0.3 or less in a high-frequency region from $1.0\times10^5$ Hz to $1.0\times10^6$ Hz. Therefore, the supply of charge on a high-frequency side is less likely to be stagnated. As a result, charge can be supplied for discharge at frequencies from a low-frequency region where an impedance takes a fixed value to the high-frequency region, particularly, discharge on a high-frequency side where the motion of charge is easily stagnated. Since the supply of charge can be fully achieved in a wide frequency region, the omission of discharge is suppressed, and the total amount of discharge can be improved. The scope of the high-frequency region is a discharge region of the largest frequency among frequencies of discharge from the electro-conductive member. Therefore, the omission of discharge seems to easily occur in this region. When the slope exhibits a value larger than −1 in the range described above in such a frequency region, a slope of larger than −1 is also obtained in a high-frequency region lower than the frequency region. Thus, the omission of discharge is suppressed, and the total amount of discharge can be improved.

In the case of using a charging roller for electrophotography as a charging member in combination with a photosensitive drum, the present inventors have predicted a specific discharge frequency within the following range.

A discharge region in the direction of movement on the surface of a charging roller that is disposed so as to face the outer surface of the photosensitive drum and moves rotationally in synchronization with the photosensitive drum is set to 0.5 mm to 1 mm. As the process speed of an electrophotographic apparatus is 100 to 500 mm/sec at the maximum, the time required for the surface of the photosensitive drum to pass through the discharge region is in the range of from $10^{-3}$ sec to $10^{-2}$ sec. In the detailed observation of discharge, the length of the discharge region is 0.01 mm to 0.1 mm through single discharge. Therefore, discharge is presumed to occur at least 5 to 100 times while the same point on the surface of the photosensitive drum passes through the entire discharge region. Thus, the discharge frequency of the charging roller is presumed to fall within the range of several Hz to $1.0\times10^6$ Hz. A higher-speed process requires rendering a discharge frequency higher and increasing the number of times of discharge. Therefore, it is particularly important to control discharge and electro-conductive mechanisms in a high-frequency region from $1.0\times10^5$ Hz to $1.0\times10^6$ Hz in the range described above.

As mentioned above, the deviation of the slope of the impedance from −1 in a high-frequency region is effective for increasing the number of times of discharge. This can well achieve the property of rapidly performing discharge and charge supply for subsequent discharge. The deviation of the slope of the impedance from −1 means that the supply of charge within the electro-conductive member is not stagnated. Therefore, such a charging member obtains the property of suppressing the omission of discharge.

<Second Requirement>

The impedance on a low-frequency side related to the second requirement represents the property that charge is less likely to be stagnated.

This is also evident from a region where the slope of the impedance on a low-frequency side is not −1. Frequency fin the expression (1) approximates zero and can thus approximate electrical resistance value R. Therefore, the electrical resistance value R is found to represent the ability of charge in moving in a single direction.

Thus, in measurement with a low-frequency voltage applied, it can be assumed that the amount of charge moved is mimicked in a state in which the motion of charge can match voltage oscillation.

The amount of charge moved at a low frequency serves as an index for the ease of movement of charge from the charging member to a measurement electrode and can also serve as an index for the amount of charge moved through discharge from the surface of the charging member to a photosensitive drum.

The alternating-current voltage for use in the measurement of the impedances related to the first requirement and the second requirement has an amplitude of 1 V. The oscillatory voltage for this measurement is drastically low with respect to a voltage of several hundreds of V to several thousands of V to be actually applied to the charging member in an electrophotographic image forming apparatus. Thus, the measurement of the impedances related to the first requirement and the second requirement is considered to be able to evaluate the ease of discharge from the surface of the charging member at a higher level.

The ease of discharge can be controlled in a proper range by satisfying the second requirement. If the impedance is lower than $1.0\times10^3\Omega$, the supply of charge for subsequent discharge cannot keep pace due to too large an amount of single discharge and thus works to cause the omission of discharge. Thus, a ghost image is difficult to suppress. On the other hand, if the impedance exceeds $1.0\times10^7\Omega$, the ease of discharge is reduced and falls short of the amount of discharge for compensating for uneven surface potentials.

In the charging member, as described in FIG. 4, the absolute value of the impedance in a low-frequency region takes a fixed value. For example, an impedance value at a frequency of 1 Hz can be used instead of the impedance at $1.0\times10^{-2}$ Hz to $1.0\times10^1$ Hz.

The electro-conductive member that satisfies both the first requirement and the second requirement is capable of achieving the amount of discharge in a frequency region from a low-frequency side to a high-frequency side such that the discharge reaches a level that cancels uneven surface potentials of a photosensitive drum and suppresses a ghost image. The omission of discharge on a high-frequency side can be suppressed by satisfying the first requirement. Also, the emergence of a ghost image can be effectively suppressed by satisfying the second requirement and thereby further improving discharging properties.

<Method for Measuring Impedance>

The impedance can be measured by the following method.

The impedance measurement requires eliminating the influence of contact resistance between the electro-conductive member and a measurement electrode. For this purpose, platinum in a low resistive thin film form is accumulated on the surface of the electro-conductive member, and the thin film is used as the electrode. Then, the impedance is measured with two terminals by using the electro-conductive support as a ground electrode.

Examples of the method for forming the electrode can include electrode formation methods such as metal deposition, sputtering, application of a metal paste and application of a metal tape. Among these methods, a method of forming a platinum electrode by the deposition of a thin film of platinum is preferred from the viewpoint of reducing contact resistance between the electro-conductive member and the electrode.

In the case of forming a platinum electrode on the surface of the electro-conductive member, a mechanism that can hold the electro-conductive member is imparted to a vacuum deposition apparatus, in consideration of the convenience thereof and the uniformity of the thin film. For an electro-conductive member having a cylindrical cross section, it is preferred to use a vacuum deposition apparatus further provided with a rotational mechanism. For example, for a cylindrical electro-conductive member having a curved (e.g., round) cross section, it is preferred to use a method as given below because the platinum electrode as the measurement electrode described above is difficult to connect with an impedance measurement apparatus.

Specifically, a platinum electrode having a width on the order of 10 mm to 20 mm is formed in the longitudinal direction of the electro-conductive member. Then, a metal sheet is wrapped around the resultant without any space. The metal sheet can be connected with the measurement electrode from the measurement apparatus, followed by measurement. As a result, an electric signal from the electro-conductive layer in the electro-conductive member can be suitably obtained in the measurement apparatus, and the impedance measurement can be carried out. The metal sheet can be a metal sheet having an electrical resistance value equivalent to that of a metal part of a connection cable for the measurement apparatus in measuring the impedance. For example, aluminum foil or a metal tape can be used.

The impedance measurement apparatus can be an apparatus, such as an impedance analyzer, a network analyzer, or a spectrum analyzer, which can measure impedances in a frequency region up to $1.0\times10^{7}$ Hz. Among others, the impedance is preferably measured with an impedance analyzer from the electrical resistance region of the electro-conductive member.

The impedance measurement conditions will be mentioned. The impedance is measured in a frequency region from $1.0\times10^{-2}$ Hz to $1.0\times10^{7}$ Hz using an impedance measurement apparatus. The measurement is performed in an environment involving a temperature of 23° C. and a humidity of 50% RH. For reducing variation in measurement, it is preferred to establish five or more measurement points per digit of the frequency. The amplitude of the alternating-current voltage is 1 V.

As for a measurement voltage, the measurement may be performed with a direct-current voltage applied, in consideration of a voltage distribution to be applied to the electro-conductive member in an electrophotographic apparatus. Specifically, such measurement is suitable for quantifying the transport and accumulation characteristics of charge while applying a direct-current voltage of 10 V or lower in a superimposed manner with an oscillatory voltage.

Next, the method for calculating the slope of the impedance will be mentioned.

Based on the measurement results obtained by measurement under the conditions described above, the absolute value of the impedance is plotted on a double logarithmic graph against a measurement frequency using commercially available spreadsheet software. The slope of the absolute value of the impedance in a frequency region from $1.0\times10^{5}$ to $1.0\times10^{6}$ Hz on the graph obtained by this double logarithmic plot can be determined by exploiting the measurement points in the frequency region from $1.0\times10^{5}$ to $1.0\times10^{6}$ Hz. Specifically, an approximate straight line of a linear function is calculated for the plot on the graph in the frequency range by the least-square method, and the slope thereof can be calculated.

Subsequently, an arithmetic mean value from the measurement points in a frequency region from $1.0\times10^{-2}$ to $1.0\times10^{1}$ Hz in the double logarithmic graph is calculated, and the obtained value can be regarded as an impedance on a low-frequency side.

The measurement of the slope of the impedance for a cylindrical charging member is performed at 5 locations including an arbitrary location in each of regions obtained as five equal parts divided in the longitudinal direction as the axial direction, and an arithmetic mean of slope measurement values at the 5 locations can be calculated.

<Third Requirement>

The electro-conductive member including an electro-conductive layer, which satisfies the stipulations regarding the impedances related to the first requirement and the second requirement can reduce the omission of discharge. However, a higher-speed electrophotographic process is considered to require further reducing uneven surface potentials of a photosensitive drum, for obtaining an electrophotographic image of high grade.

Accordingly, the present inventors have contemplated the injection of charge to a photosensitive drum at a contact part with the photosensitive drum through protrusions derived from domains exposed to the outer surface of the charging member in relation to the third requirement. In this context, the injection charging means that charging is caused by injecting charge according to difference in potential to the photosensitive drum surface from an electro-conductive part in the outer surface of the electro-conductive member in contact with the photosensitive drum surface at the contact part.

Figure 5:
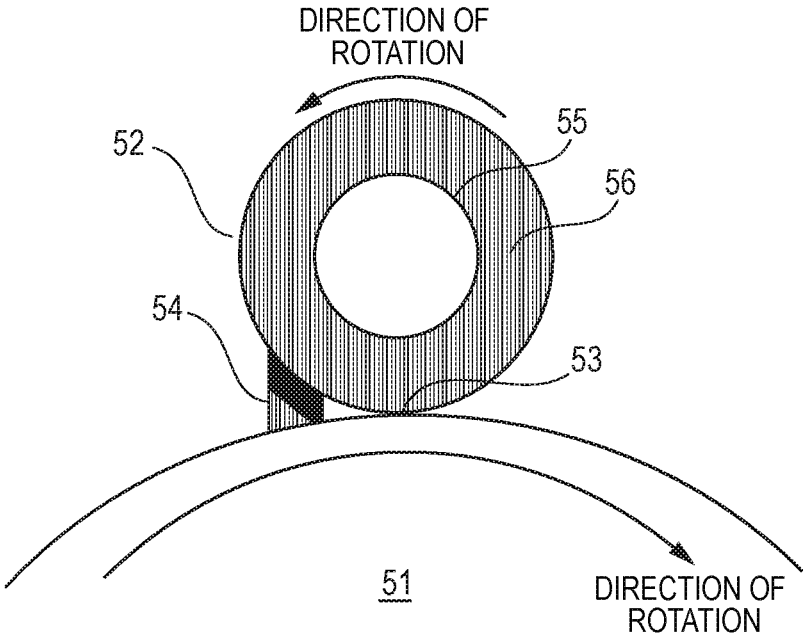
FIG. 5 is a conceptual diagram of the neighborhood of a contact part between a photosensitive drum and a charging member.

FIG. 5 illustrates a conceptual diagram of the neighborhood of contact part 53 between photosensitive drum 51 and charging member 52 having electro-conductive support 55 and electro-conductive layer 56. As illustrated in FIG. 5, discharge 54 causes a microgap that applies difference in potential on the upstream side of a process with respect to the contact part 53. Depending on discharge from the charging member 52, remaining uneven surface potentials, which have not yet been uniformized, of the photosensitive drum can be further uniformized by injection charging from the protrusions.

Since the surface potential of the charging member is a negative value and is constant with respect to the uneven surface potentials on the photosensitive drum surface, the difference in potential at the contact part and the amount of injected charge are larger at a location with a negatively small surface potential than at a location with a large surface potential among the uneven surface potentials of the photosensitive drum.

In short, the injection charging at the contact part is effective for uniformizing uneven surface potentials.

The electro-conductive member according to the present aspect has a matrix-domain structure that can fully accumulate and highly efficiently transport charge within the electro-conductive layer according to the stipulations regarding the impedances of the first requirement and the second requirement, and therefore, presumably has high efficiency of not only suppression of the omission of discharge but injection charging. Furthermore, the electro-conductive part has a convex shape and is configured to come alone into contact with a photosensitive drum. This configuration further improves the efficiency of injection charging. Moreover, the electro-conductive part to come into contact is rich in a low resistive electronically conductive agent having high charge transport efficiency. This configuration is also presumably advantageous for injection charging.

Specifically, the height of the protrusions of the electro-conductive part is preferably 50 nm or larger and 200 nm or smaller. The height of 50 nm or larger can achieve the contact of the electro-conductive protrusions alone with a photosensitive drum. On the other hand, the height of the protrusions is preferably 200 nm or smaller because uneven discharge derived from the protrusions occurs in a discharge region.

As described above, the configuration according to the present disclosure that can suppress the omission of discharge according to the first requirement and the second requirement and additionally enables highly efficient injection charging through electro-conductive protrusions is presumably capable of suppressing a ghost image in a high-speed process.

<Electro-Conductive Member>

Figure 6:
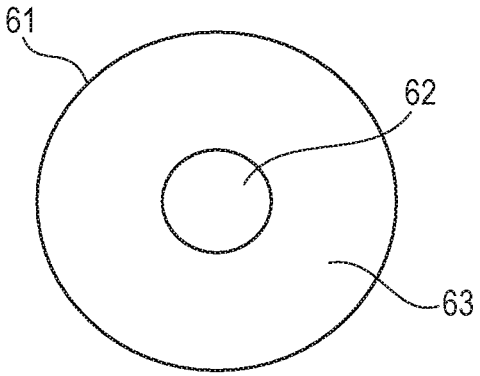
FIG. 6 is a cross-sectional view perpendicular to the longitudinal direction of a charging roller.

The electro-conductive member according to the present aspect will be described with reference to FIG. 6 by taking an electro-conductive member having a roller shape (hereinafter, referred to as an electro-conductive roller) as an example. FIG. 6 is a cross-sectional view perpendicular to the longitudinal direction as the axial direction of the electro-conductive roller. Electro-conductive roller 61 has cylindrical electro-conductive support 62 and electro-conductive layer 63 formed on the outer periphery, i.e., outer surface, of the support 62.

<Electro-Conductive Support>

A material known in the field of electro-conductive members for electrophotography, or a material that can be used in such an electro-conductive member can be appropriately selected and used as a material constituting the electro-conductive support. Examples thereof include aluminum, stainless, synthetic resins having electro-conductivity, and metals and alloys such as iron and copper alloy. These materials may be further subjected to oxidation treatment or plating treatment with chromium, nickel or the like. Any of electroplating and electroless plating can be used as the type of the plating. Electroless plating is preferred from the viewpoint of dimensional stability. In this context, examples of the type of the electroless plating used can include nickel plating, copper plating, gold plating and plating with various alloys. The plating thickness is preferably 0.05 μm or larger. The plating thickness is preferably 0.1 to 30 μm in consideration of the balance between working efficiency and antirust ability. The cylindrical shape of the support may be a solid cylindrical shape or a hollow cylindrical shape. The outside diameter of this support is preferably in the range of ϕ3 mm to ϕ10 mm.

The presence of a moderately resistive layer or an insulating layer between the support and the electro-conductive layer hinders rapid supply of charge after consumption of charge through discharge. Accordingly, it is preferred that the electro-conductive layer should be disposed directly on the support or that the electro-conductive layer should be disposed on the outer periphery of the support via only an intermediate layer formed from a thin film and an electro-conductive resin layer, such as a primer.

A known primer can be selected and used according to a rubber material for electro-conductive layer formation and the material of the support, etc. Examples of the material for the primer include thermosetting resins and thermoplastic resins. Specifically, a material such as phenolic resin, urethane resin, acrylic resin, polyester resin, polyether resin or epoxy resin can be used.

The impedances of the resin layer and the support are preferably in the range of $1.0\times10^{-5}$ to $1.0\times10^{2}\Omega$ at a frequency of $1.0\times10^{-2}$ Hz to $1.0\times10^{1}$ Hz. The support and the resin layer having an impedance in the range described above at a low frequency are preferred because sufficient supply of charge to the electro-conductive layer can be carried out and because the matrix-domain structure of the electro-conductive layer is not inhibited from having the function of suppressing the omission of discharge according to the first requirement and the second requirement.

The impedance of the resin layer can be measured in the same way as in the measurement of the slope of the impedance described above except that the measurement is performed by peeling off the electro-conductive layer present in the outermost surface. The impedance of the support can be measured in the same way as in the measurement of the impedance described above in a state before the support is coated with the resin layer or the electro-conductive layer, or a state in which the coating layer formed from the electro-conductive layer or the resin layer and the electro-conductive layer has been peeled off after charging roller formation.

<Electro-Conductive Layer>

The electro-conductive member that satisfies <first requirement>, <second requirement> and <third requirement> described above is preferably, for example, an electro-conductive member having an electro-conductive layer that satisfies the following configuration (i) to configuration (iv).

Configuration (i): the volume resistivity of the matrix is larger than $1.0\times10^{12}$ Ω·cm and $1.0\times10^{17}$ Ω·cm or smaller.

Configuration (ii): the volume resistivity of the domains is $1.0\times10^{1}$ Ω·cm or larger and $1.0\times10^{4}$ Ω·cm or smaller.

Configuration (iii): the distance between the adjacent domains is in the range of 0.2 μm or more and 2.0 μm or less.

Configuration (iv): at least some of the domains are exposed to the outer surface of the electro-conductive member so that protrusions are provided on the outer surface of the electro-conductive member, and the outer surface of the electro-conductive member has the matrix and the surfaces of the domains exposed to the outer surface of the electro-conductive member.

Hereinafter, the factors (i) to (iv) will be described.

Figure 7A:
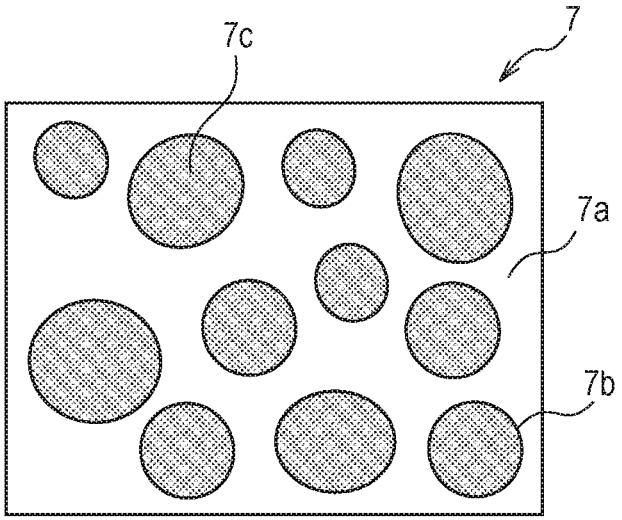
FIG. 7A is a schematic cross-sectional view in the thickness direction of an electro-conductive layer.
Figure 7B:
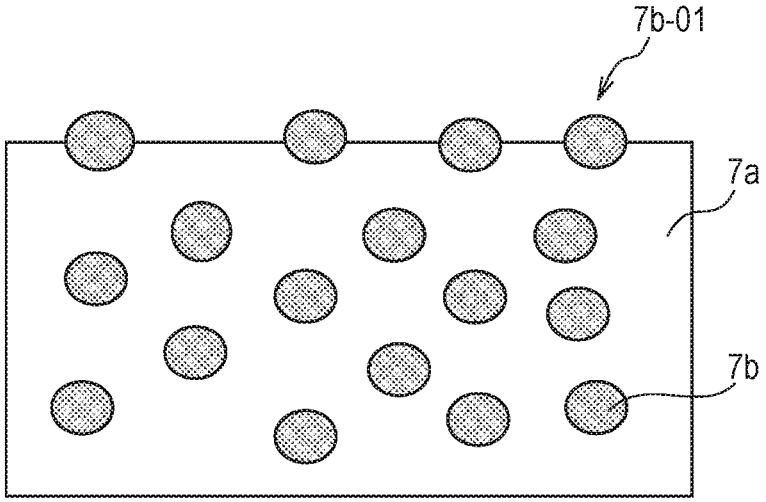
FIG. 7B is an enlarged view of the neighborhood of the outer surface of the electro-conductive layer in FIG. 7A.

FIG. 7A illustrates a partial cross-sectional view of the electro-conductive layer in a direction perpendicular to the longitudinal direction of the electro-conductive roller. Electro-conductive layer 7 has a matrix-domain structure having matrix 7*a* and domains 7*b*. The domains 7*b* contain electro-conductive particle 7*c* as the electronically conductive agent. FIG. 7B is an enlarged view of the neighborhood of a surface of the electro-conductive layer on a side opposite to the electro-conductive support side of the electro-conductive layer (hereinafter, also referred to as the "outer surface of the electro-conductive layer").

A bias is applied to between the electro-conductive support in the electro-conductive member including the electro-conductive layer in which the domains containing the electronically conductive agent are dispersed in the matrix, and an object to be charged. Then, charge within the electro-conductive layer is considered to move to a side opposite to the side of the electro-conductive layer facing the electro-conductive support, i.e., the outer surface side of the electro-conductive member, as given below. As a result, the charge is accumulated in the neighborhood of the interface between the domains and the matrix. Then, the charge is sequentially delivered from the domains positioned on the electro-conductive support side to the domains positioned on a side opposite to the electro-conductive support side to arrive at a surface on the side opposite to the electro-conductive support side of the electro-conductive layer (hereinafter, also referred to as the "outer surface of the electro-conductive layer"). In this respect, if the charge of all the domains moves to the outer surface side of the electro-conductive layer by a single charging step, time is required to accumulate charge in the electro-conductive layer for a next charging step. Specifically, it is difficult to respond to a high-speed electrophotographic image formation process. Thus, it is preferred to prevent simultaneous charge transfer between the domains by the application of a bias. The accumulation of charge in a sufficient amount in the domains is also effective for a sufficient amount of discharge through single discharge in a high-frequency region where the motion of charge is restricted.

As illustrated in FIG. 7B, at least some of the domains 7*b* are exposed to the outer surface of the electro-conductive member so that protrusions 7*b*-01 are provided on the outer surface of the electro-conductive member. Such protrusions constitute a contact part with a photosensitive drum. As a result, the charge fully accumulated in the domains is efficiently injected to an electrophotographic photosensitive member at the contact part.

As mentioned above, it is preferred to prevent simultaneous charge transfer between the domains at the time of application of a bias and to satisfy the configurations (i) to (iv) for sufficiently accumulating charge in the domains.

<Configuration (i)>

Volume Resistivity of Matrix;

When the volume resistivity of the matrix is larger than $1.0\times10^{12}$ Ω·cm and $1.0\times10^{17}$ Ω·cm or smaller, charge can be prevented from moving within the matrix while bypassing the domains. Furthermore, the charge accumulated in the domains can be prevented from leaking out to the matrix and thereby falling into a state as if a communicating electro-conductive pathway is formed within the electro-conductive layer.

For <first requirement> described above, it is necessary to move charge via the domains in the electro-conductive layer even under application of a high-frequency bias. The present inventors believe that a configuration in which electro-conductive regions (domains) where charge is sufficiently accumulated are separated from each other by an electrically insulating region (matrix) is effective for this purpose. When the volume resistivity of the matrix falls within the range of the highly resistive region as described above, charge can remain sufficiently at the interface between each domain and the matrix and can be prevented from leaking out of the domains.

The present inventors have also found that a charge movement pathway limited to a domain-mediated pathway is effective for the electro-conductive layer that satisfies <second requirement> described above. The density of charge present in the domains can be improved by preventing charge from leaking out of the domains to the matrix, and limiting a charge transport pathway to a pathway mediated by a plurality of domains. Therefore, the amount of charge filled in each domain can be further increased. It is considered that this can improve the total number of charges that can be involved in discharge on the surfaces of the domains as an electro-conductive phase serving as the point of origin of discharge and can consequently improve the ease of discharge from the surface of the charging member.

The discharge from the outer surface of the electro-conductive layer draws charge through an electric field from the domains as an electro-conductive phase, as described above. At the same time therewith, positive ions generated by the ionization of air through the electric field collide with the surface of the electro-conductive layer having negative charge to produce a γ effect of releasing charge from the surface of the electro-conductive layer. As described above, a high density of charge can be present in the domains as an electro-conductive phase on the surface of the charging member. Thus, discharge efficiency upon collision of the positive ions with the surface of the electro-conductive layer through the electric field can also be improved. In such a state, presumably, a larger number of charges can be easily generated through discharge, as compared with a conventional charging member.

Method for Measuring Volume Resistivity of Matrix;

The volume resistivity of the matrix can be measured, for example, by cutting out a thin section having a predetermined thickness (e.g., 1 μm) including a matrix-domain structure from the electro-conductive layer, and bringing a microprobe of a scanning probe microscope (SPM) or an atomic force microscope (AFM) into contact with the matrix in the thin section.

Figure 9A:
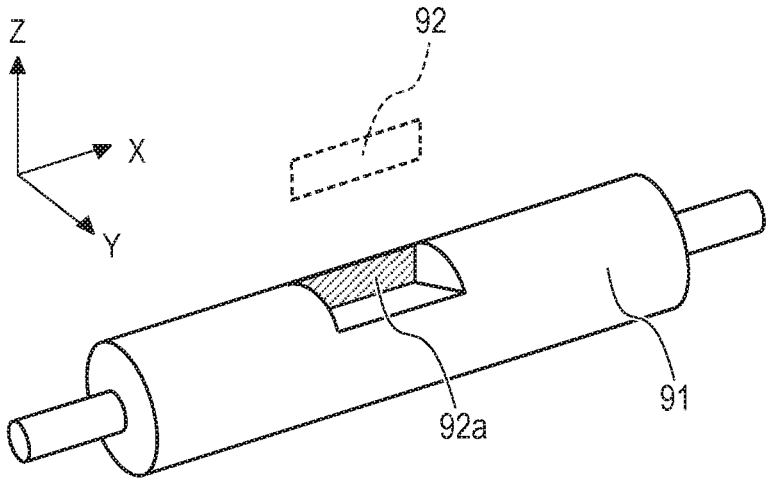
FIG. 9A is an illustrative view of the cut of the section from the electro-conductive member at cross section 92*a* parallel to XZ plane 92.
Figure 9B:
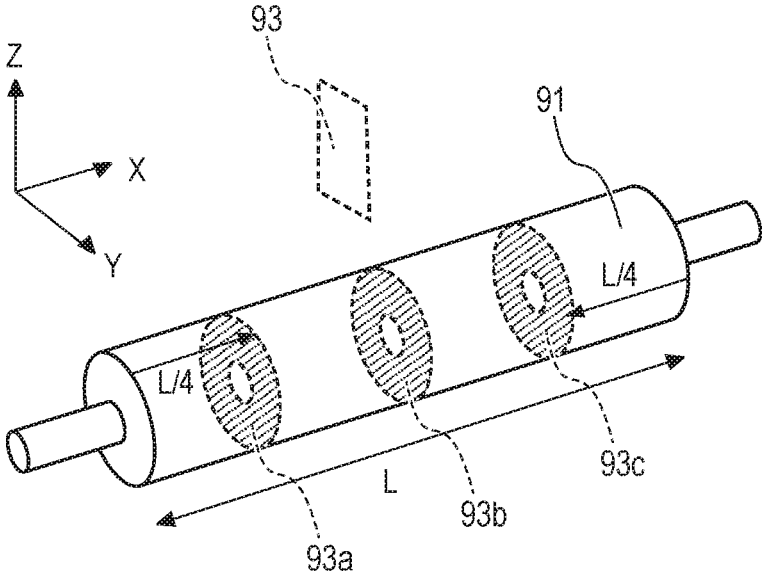
FIG. 9B is an illustrative view of the cut of the section from the electro-conductive member at the cross sections in the thickness direction of the electro-conductive layer.

The thin section is cut out from the elastic layer, for example, as illustrated in FIG. 9A, such that the thin section includes at least a portion of cross section 92*a* parallel to the XZ plane when the longitudinal direction of the electro-conductive member is defined as an X-axis, the thickness direction of the electro-conductive layer is defined as a Z-axis, and the circumferential direction is defined as a Y-axis. Alternatively, as illustrated in FIG. 9B, the thin section is cut out such that the thin section includes at least a portion of the YZ plane (e.g., 93*a*, 93*b* and 93*c*) perpendicular to the axial direction of the electro-conductive member. Examples of the method for cutting out the thin section include sharp razors, microtomes and focused ion beam (FIB).

For the measurement of the volume resistivity, one surface of the thin section cut out from the electro-conductive layer is grounded. Subsequently, a microprobe of a scanning probe microscope (SPM) or an atomic force microscope (AFM) is brought into contact with the matrix moiety on a surface on a side opposite to the grounded surface of the thin section. A DC voltage of 50 V is applied thereto for 5 seconds, and a ground current value is measured for 5 seconds. An arithmetic mean value is calculated from the obtained values, and the applied voltage is divided by the calculated value to calculate an electrical resistance value. Finally, the resistance value is converted to a volume resistivity using the film thickness of the thin section. In this respect, SPM or AFM can measure the film thickness of the thin section at the same time with the resistance value.

The volume resistivity value of the matrix in the cylindrical charging member is determined, for example, by dividing the electro-conductive layer into 4 parts in the circumferential direction and 5 parts in the longitudinal direction, cutting out one thin section sample per region, obtaining the measurement value described above, and then calculating an arithmetic mean value of the volume resistivities of a total of 20 samples.

<Configuration (ii)>

Volume Resistivity of Domain;

The volume resistivity of the domains is preferably $1.0\times10^{1}$ Ω·cm or larger and $1.0\times10^{4}$ Ω·cm or smaller. A lower volume resistivity of the domains can more effectively limit a charge transport pathway to a pathway mediated by a plurality of domains, while suppressing the unintended movement of charge in the matrix.

The volume resistivity of the domains is more preferably $1.0\times10^{2}$ Ω·cm or smaller. When the volume resistivity of the domains is decreased to the range described above, the amount of charge moved within the domains can be drastically improved. Hence, the impedance of the electro-conductive layer at a frequency of $1.0\times10^{-2}$ Hz to $1.0\times10^{1}$ Hz can be adjusted to a lower range equal to or lower than $1.0\times10^{5}$Ω, and the charge transport pathway can be further effectively limited to a pathway mediated by the domains.

The volume resistivity of the domains is adjusted by using the electronically conductive agent for a rubber component of the domains, and thereby setting the electro-conductivity thereof to a predetermined value.

A rubber composition including a rubber component for the matrix can be used as a rubber material for the domains. The difference in solubility parameter (SP value) of the rubber composition from that of the rubber material constituting the matrix is preferably in the following range for forming a matrix-domain structure: the difference in SP value is 0.4 $(J/cm^3)^{0.5}$ or more and 5.0 $(J/cm^3)^{0.5}$ or less, in particular, more preferably 0.4 $(J/cm^3)^{0.5}$ or more and 2.2 $(J/cm^3)^{0.5}$ or less.

The volume resistivity of the domains can be adjusted by appropriately selecting the type of the electronically conductive agent and the amount of the electronically conductive agent added. The electronically conductive agent for use in adjusting the volume resistivity of the domains to $1.0\times10^{1}$ Ω·cm or larger and $1.0\times10^{4}$ Ω·cm or smaller is preferably an electronically conductive agent that can largely change the volume resistivity from high resistance to low resistance depending on the amount of the electronically conductive agent dispersed.

Examples of the electronically conductive agent to be blended into the domains include; carbon materials such as carbon black and graphite; electro-conductive oxides such as titanium oxide and tin oxide; metals such as Cu and Ag; and particles conducted by coating their surfaces with an electro-conductive oxide or metal.

If necessary, two or more types of these electronically conductive agents may be blended in appropriate amounts for use.

Among the electronically conductive agents as mentioned above, electro-conductive carbon black is preferably used because the electro-conductive carbon black has large affinity for rubbers and because the distance between the electronically conductive agent particles is easy to control. The type of the carbon black to be blended into the domains is not particularly limited. Specific examples thereof include gas furnace black, oil furnace black, thermal black, lampblack, acetylene black and Ketjenblack.

Among others, electro-conductive carbon black that absorbs DBP oil in an amount of 40 $cm^3$/100 g or more and 170 $cm^3$/100 g or less and is capable of imparting high electro-conductivity to the domains can be suitably used.

The electronically conductive agent such as electro-conductive carbon black is preferably blended at 20 parts by mass or more and 150 parts by mass or less into the domains per 100 parts by mass of a rubber component contained in the domains. The blending ratio is particularly preferably 50 parts by mass or more and 100 parts by mass or less. The blending of the electronically conductive agent at such a ratio is preferred because a large amount of the electronically conductive agent is blended as compared with a general electro-conductive member for electrophotography. This can easily control the volume resistivity of the domains in the range of $1.0\times10^{1}$ Ω·cm or larger and $1.0\times10^{4}$ Ω·cm or smaller. If necessary, an additive generally used as a blending agent for rubbers may be added to the rubber composition for the domains without inhibiting the advantageous effects according to the present disclosure.

Examples of such an additive include fillers, processing aids, cross-linking agents, cross-linking aids, cross-linking promoters, antioxidants, cross-linking promotion aids, cross-linking retarders, softening agents, dispersants and colorants.

Method for Measuring Volume Resistivity of Domain;

The measurement of the volume resistivity of the domains can be carried out in the same way as <method for measuring volume resistivity of matrix> described above except that: the measurement location is changed to a location corresponding to the domains; and the applied voltage in measuring a current value is changed to 1 V.

In this context, the domains preferably have a uniform volume resistivity. For improving the uniformity of the volume resistivity of the domains, it is preferred to uniformize the amount of the electronically conductive agent among the domains. This can further stabilize discharge from the outer surface of the electro-conductive member to an object to be charged.

Specifically, ratios of cross-sectional areas of moieties of the electronically conductive agent contained in the domains, respectively, appearing in a cross section in the thickness direction of the electro-conductive layer to respective cross-sectional areas of the domains are preferably, for example, in the following range: coefficient of variation σr/μr is preferably 0 or more and 0.4 or less when standard deviation of the ratios of the total cross-sectional areas of the electro-conductive particles to the cross-sectional areas of the domains is defined as σr and a mean value of the ratios is defined as μr.

A method of reducing variation in the number or amount of the conductive agent contained in each domain can be used for σr/μr of 0 or more and 0.4 or less. When the uniformity of the volume resistivity based on such an index is imparted to the domains, electric field concentration within the electro-conductive layer can be suppressed, and the presence of a matrix to which an electric field is locally applied can be reduced. This can minimize the electro-conductivity of the matrix.

σr/μr is more preferably 0 or more and 0.25 or less. This can further effectively suppress electric field concentration within the electro-conductive layer and can further reduce the impedance to $1.0\times10^{5}$Ω or lower at $1.0\times10^{-2}$ Hz to $1.0\times10^{1}$ Hz.

For improving the uniformity of the volume resistivity of the domains, it is preferred to increase the amount of the electronically conductive agent such as carbon black blended with a second cross-linked rubber in the step of preparing a rubber composition for domain formation (CMB) mentioned later.

Method for Measuring Index for Uniformity of Volume Resistivity of Domain;

The uniformity of the volume resistivity of the domains is governed by the amount of the electronically conductive agent in the domains and can therefore be evaluated by measuring variation in the amount of the electronically conductive agent in the domains.

First, a section is prepared in the same way as the method for use in the measurement of the volume resistivity of the matrix mentioned above. Subsequently, a fracture surface is formed with a unit such as freeze-fracture, a cross polisher or focused ion beam (FIB). FIB is preferred in consideration of the smoothness of the fracture surface and a pretreatment for observation. Also, a pretreatment, such as staining treatment or deposition treatment, which suitably produces the contrast between the domains as an electro-conductive phase and the matrix as an insulating phase may be performed in order to suitably carry out the observation of a matrix-domain structure.

The section after the formation of the fracture surface and the pretreatment is observed under a scanning electron microscope (SEM) or a transmission electron microscope (TEM) to confirm the presence of the matrix-domain structure. Among these approaches, observation under SEM at ×1000 to ×100000 is preferred because of accurate quantification of the areas of the domains. Specific procedures will be mentioned later.

<Configuration (iii)>

Arithmetic Mean Value Dm of Distances Between Surfaces of Adjacent Domains (Hereinafter, Also Referred to as "Inter-Domain Surface Distances")

Arithmetic mean value Dm of inter-domain surface distances is preferably 0.2 μm or more and 2.0 μm or less.

Dm is preferably 2.0 μm or less, particularly preferably 1.0 μm or less, because the electro-conductive layer in which the domains having the volume resistivity related to the configuration (ii) are dispersed in the matrix having the volume resistivity related to the configuration (i) satisfies <second requirement> described above.

On the other hand, Dm is preferably 0.2 μm or more, particularly preferably 0.3 μm or more, for reliably separating the domains from each other by the matrix serving as an insulating region, and thereby sufficiently accumulating charge in the domains.

Method for Measuring Inter-Domain Surface Distances;

The method for measuring the inter-domain surface distances can be carried as follows.

First, a section is prepared in the same way as the method for use in the measurement of the volume resistivity of the matrix mentioned above. Also, a pretreatment, such as staining treatment or deposition treatment, which suitably produces the contrast between an electro-conductive phase and an insulating phase may be performed in order to suitably carry out the observation of a matrix-domain structure.

The section after the formation of the fracture surface and the platinum deposition is observed under a scanning electron microscope (SEM) to confirm the presence of the matrix-domain structure. Among these approaches, observation under SEM at ×1000 to ×100000 is preferred because of accurate quantification of the areas of the domains. Specific procedures will be mentioned later.

Uniformity of Inter-Domain Surface Distances Dm;

In relation to the configuration (iii), a uniform distribution of the inter-domain surface distances is more preferred. The uniform distribution of the inter-domain surface distances can reduce a phenomenon of suppression of the ease of discharge when there arises a location at which the supply of charge is stagnated, as compared with the surroundings, by locally producing some locations with a long inter-domain surface distances within the electro-conductive layer.

Observation regions of 50 μm square are obtained at arbitrary 3 locations in a thickness region from 0.1 T to 0.9 T in depth in the support direction from the outer surface of the electro-conductive layer at the cross sections of charge transport, i.e., the cross sections in the thickness direction of the electro-conductive layer as illustrated in FIG. 9B. In this respect, coefficient of variation σm/Dm calculated using mean value Dm of inter-domain surface distances in the observation regions and variation σm of the inter-domain surface distances is preferably 0 or more and 0.4 or less, more preferably 0.10 or more and 0.30 or less.

Method for Measuring Uniformity of Inter-Domain Surface Distances;

The uniformity of the inter-domain surface distances can be measured by quantifying an image obtained by the direct observation of a fracture surface in the same way as in the measurement of the inter-domain surface distances. Specific procedures will be mentioned later.

The electro-conductive member according to the present aspect can be formed through, for example, a method including the following steps (i) to (iv):

(i) preparing a rubber composition for domain formation (hereinafter, also referred to as "CMB") containing carbon black and a second rubber;

(ii) preparing a rubber composition for matrix formation (hereinafter, also referred to as "MRC") containing a first rubber;

(iii) kneading CMB and MRC to prepare a rubber composition having a matrix-domain structure; and (iv) forming a layer of the rubber composition prepared in the step (iii) on an electro-conductive support either directly or via an additional layer, and curing (cross-linking) the layer of the rubber composition to form the electro-conductive layer according to the present aspect.

The configuration (i) to the configuration (iii) can be controlled, for example, by selecting a material for use in each of the steps and adjusting production conditions. Hereinafter, the method therefor will be described.

First, as for the configuration (i), the volume resistivity of the matrix depends on the composition of MRC.

At least one low electro-conductive rubber such as natural rubber, butadiene rubber, butyl rubber, acrylonitrile-butadiene rubber, urethane rubber, silicone rubber, fluorine rubber, isoprene rubber, chloroprene rubber, styrene-butadiene rubber, ethylene-propylene rubber or polynorbornene rubber can be used as the first rubber for use in MRC. If necessary, a filler, a processing aid, a cross-linking agent, a cross-linking aid, a cross-linking promoter, a cross-linking promotion aid, a cross-linking retarder, an antioxidant, a softening agent, a dispersant and/or a colorant may be added to MRC on the precondition that the volume resistivity of the matrix can fall within the range described above. On the other hand, it is preferred that MRC should not contain an electronically conductive agent such as carbon black, for adjusting the volume resistivity of the matrix to within the range described above.

The configuration (ii) can be adjusted by the amount of the electronically conductive agent in CMB. Examples of the method therefor include a method of using electro-conductive carbon black that absorbs DBP oil in an amount of 40 $cm^3$/100 g or more and 170 $cm^3$/100 g or less as the electronically conductive agent. Specifically, the configuration (ii) can be achieved by preparing CMB so as to contain 40% by mass or more and 200% by mass or less of the electro-conductive carbon black with respect to the total mass of CMB.

The control of the following four factors, (a) to (d), is effective for the configuration (iii):

(a) difference in interfacial tension a between CMB and MRC;

(b) the ratio of a viscosity of MRC (ηm) to a viscosity of CMB (ηd) (ηm/ηd);

(c) a shear rate (γ) at the time of kneading of CMB and MRC, and the amount of energy at the time of shear (EDK) in the step (iii); and (d) the volume fraction of CMB with respect to MRC in the step (iii).

(a) Difference in Interfacial Tension Between CMB and MRC

In the case of mixing two immiscible rubbers, phase separation generally occurs. This is because, since the interaction between the same polymers is stronger than the interaction between different polymers, the same polymers aggregate with each other to decrease a free energy for stabilization. The interface of the phase-separated structure comes into contact with the different polymers and therefore has a higher free energy than that of the inside stabilized through the interaction between the same polymers. As a result, an interfacial tension that intends to decrease the area of contact with the different polymers is generated in order to decrease the free energy of the interface. When this interfacial tension is small, even the different polymers are more uniformly mixed in order to increase entropy. The uniformly mixed state is dissolution. Thus, the interfacial tension tends to correlate with a SP value (solubility parameter) serving as a guideline for solubility.

In short, the difference in interfacial tension between CMB and MRC is considered to correlate with difference in SP value between the rubbers, respectively, contained therein. The first rubber in MRC and the second rubber in CMB are preferably rubber raw materials differing in the absolute value of the solubility parameter in the following range: the difference in the absolute value of the SP value is preferably 0.4 $(J/cm^3)^{0.5}$ or more and 5.0 $(J/cm^3)^{0.5}$ or less, particularly preferably 0.4 $(J/cm^3)^{0.5}$ or more and 2.2 $(J/cm^3)^{0.5}$ or less, for selecting the rubbers. Within this range, a stable phase-separated structure can be formed, and domain diameter D of CMB can be decreased. In this context, specific examples of the second rubber that can be used in CMB include natural rubber (NR), isoprene rubber (IR), butadiene rubber (BR), styrene-butadiene rubber (SBR), butyl rubber (IIR), ethylene-propylene rubber (EPM and EPDM), chloroprene rubber (CR), nitrile rubber (NBR), hydrogenated nitrile rubber (H-NBR), silicone rubber and urethane rubber (U), at least one of which can be used.

The thickness of the electro-conductive layer is not particularly limited as long as the intended function and effect of the electro-conductive member are obtained. The thickness of the electro-conductive layer is preferably 1.0 mm or larger and 4.5 mm or smaller.

The mass ratio between the domains and the matrix (domain:matrix) is preferably 5:95 to 40:60, more preferably 10:90 to 30:70, further preferably 13:87 to 25:75.

<Method for Measuring SP Value>

The SP value can be accurately calculated by using a material having a known SP value and preparing a calibration curve. A catalog value provided by a material manufacturer may be used as this known SP value. For example, the SP values of NBR and SBR are substantially determined by the content percentages of acrylonitrile and styrene without depending on their molecular weights. The rubbers constituting the matrix and the domains are analyzed for their content percentage of acrylonitrile or styrene using an analysis approach such as pyrolysis gas chromatography (Py-GC) or solid NMR. Their SP values can thus be calculated from the calibration curve obtained from the material having the known SP value. The SP value of the isoprene rubber is determined by isomer structures such as 1,2-polyisoprene, 1,3-polyisoprene, 3,4-polyisoprene, cis-1,4-polyisoprene and trans-1,4-polyisoprene. Thus, the content percentages of the isomers are analyzed by an approach such as Py-GC or solid NMR, as in SBR and NBR, and the SP value of the isoprene rubber can be calculated from the material having the known SP value. The SP value of the material having the known SP value is determined by the Hansen solubility sphere method.

(b) Viscosity Ratio Between CMB and MRC

As the viscosity ratio between CMB and MRC ($\eta d/\eta m$) is closer to 1, the maximum Feret diameter of the domains can be decreased. Specifically, the viscosity ratio is preferably 1.0 or more and 2.0 or less. The viscosity ratio between CMB and MRC can be adjusted by selecting the Mooney viscosities of the raw rubbers for use in CMB and MRC or adjusting the type or amount of a filler to be blended therewith. A plasticizer such as paraffine oil may be added thereto without interfering with the formation of a phase-separated structure. Also, the viscosity ratio can be adjusted by adjusting a kneading temperature. The viscosities of CMB and MRC are obtained by measuring Mooney viscosity ML (1+4) at rubber temperatures at the time of kneading based on JIS K 6300-1: 2013.

(c) Shear Rate at Time of Kneading of MRC and CMB, and Amount of Energy at Time of Shear As the shear rate at the time of kneading of MRC and CMB is faster or as the amount of energy at the time of shear is larger, inter-domain surface distances Dm and Dms (which will be mentioned later) can be decreased.

The shear rate can be increased by increasing the inside diameter of a stirring member such as a blade or a screw in a kneading machine and thereby decreasing the gap from the end surface of the stirring member to the inner wall of the kneading machine, or by increasing the number of rotations. The increased amount of energy at the time of shear can be achieved by increasing the number of rotations of the stirring member or enhancing the viscosities of the first rubber in CMB and the second rubber in MRC.

(d) Volume Fraction of CMB with Respect to MRC

The volume fraction of CMB with respect to MRC correlates with the coalescence probability of a rubber mixture for domain formation colliding with a rubber mixture for matrix formation. Specifically, the coalescence probability of a rubber mixture for domain formation colliding with a rubber mixture for matrix formation is decreased with reduction in the volume fraction of the rubber mixture for domain formation with respect to the rubber mixture for matrix formation. In short, inter-domain surface distances Dm and Dms (which will be mentioned later) can be decreased by decreasing the volume fraction of the domains in the matrix in a range that produces necessary electro-conductivity.

The volume fraction of CMB with respect to MRC (i.e., the volume fraction of the domains with respect to the matrix) is preferably 15% or more and 40% or less.

In the electro-conductive member, when the length in the longitudinal direction of the electro-conductive layer is defined as L and the thickness of the electro-conductive layer is defined as T, cross sections in the thickness direction of the electro-conductive layer as illustrated in FIG. 9B are obtained at 3 locations, i.e., the center in the longitudinal direction of the electro-conductive layer, and L/4 from both ends of the electro-conductive layer toward the center. Each of the cross sections in the thickness direction of the electro-conductive layer preferably satisfies the following.

Observation regions of 15 μm square are placed at arbitrary 3 locations in a thickness region from 0.1 T to 0.9 T in depth from the outer surface of the electro-conductive layer as to each of the cross sections. In this respect, 80% by number or more of domains observed in each of a total of the 9 observation regions preferably satisfy the following configuration (v) and configuration (vi).

Configuration (v)

Ratio μr of the cross-sectional area of the electronically conductive agent contained in the domain to the cross-sectional area of the domain is 20% or more.

Configuration (vi)

When the perimeter of the domain is defined as A and the envelope perimeter of the domain is defined as B, A/B is 1.00 or more and 1.10 or less.

The configuration (v) and the configuration (vi) can stipulate the shape of the domains. The "shape of the domains" is defined as the cross-sectional shape of the domains appearing in the cross section in the thickness direction of the electro-conductive layer.

The shape of the domains is preferably a shape having no irregularities on its periphery, i.e., a nearly spherical shape. The nonuniformity of the electric field among the domains can be reduced by reducing the number of irregular structures related to the shape. In short, the number of locations where electric field concentration occurs can be decreased to reduce a phenomenon of charge transport more than necessary in the matrix.

The present inventors have gained the finding that the amount of the electronically conductive agent (electro-conductive particle) contained in one domain influences the outer shape of the domain.

Specifically, the present inventors have gained the finding that as the amount of the electro-conductive particle filled in one domain is increased, the outer shape of the domain is more spherical. The number of points of concentration of electron transfer between the domains can be decreased with increase in the number of nearly spherical domains.

According to the studies of the present inventors, domains in which the ratio of the total cross-sectional area of electro-conductive particles observed at the cross section of one domain to the cross-sectional area of the domain is 20% or more can assume a more spherical shape, though the reason therefor is unknown. As a result, such domains can assume an outer shape capable of significantly relaxing the concentration of electron transfer between the domains, and are therefore preferred. Specifically, the ratio of the cross-sectional area of the electro-conductive particle contained in the domain to the cross-sectional area of the domain is preferably 20% or more, more preferably 25% or more and 30% or less.

The present inventors have found that the domain shape without irregularities on the periphery should preferably satisfy the following expression (5):

$$1.00 \leq A/B \leq 1.10 \quad (5)$$

(A: the perimeter of the domain, B: the envelope perimeter of the domain)

Figure 8:
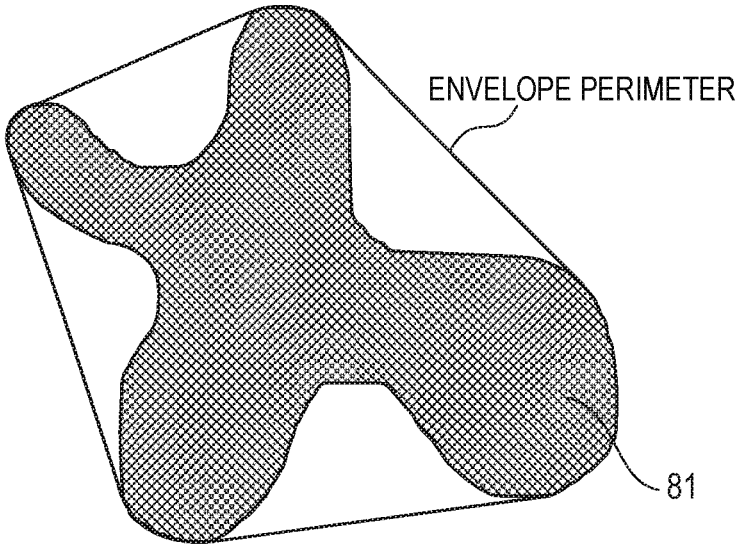
FIG. 8 is an illustrative view of an envelope perimeter.

The expression (5) represents the ratio of perimeter A of the domain to envelope perimeter B of the domain. In this context, the envelope perimeter refers to a perimeter obtained by connecting the protrusions of domain 81 observed in an observation region as illustrated in FIG. 8.

The ratio of the perimeter of the domain to the envelope perimeter of the domain is 1 as the minimum value. This ratio of 1 means that the domain has a shape having no depression in the cross-sectional shape, such as a true circle or an ellipse. The ratio of 1.1 or less means that the domain has no large concavo-convex shape. Thus, the anisotropy of an electric field is less likely to be exhibited.

<Method for Measuring Parameter for Shape of Domain>

An ultrathin section having a thickness of 1 μm is cut out of the electro-conductive layer of the electro-conductive member (electro-conductive roller) at a cutting temperature of −100° C. using a microtome (trade name: Leica EMFCS, manufactured by Leica Microsystems GmbH). However, as described below, it is necessary to prepare the section at a cross section perpendicular to the longitudinal direction of the electro-conductive member and evaluate the shape of the domains on a fracture surface of the section. The reason therefor will be mentioned below.

FIG. 9A and FIG. 9B is a diagram three-dimensionally illustrating the shape of electro-conductive member 91 on 3 axes, specifically, X, Y and Z-axes. In FIG. 9A and FIG. 9B, the X-axis depicts a direction parallel to the longitudinal direction (axial direction) of the electro-conductive member, and the Y-axis and the Z-axis each depict a direction perpendicular to the axial direction of the electro-conductive member.

FIG. 9A illustrates an image diagram of cutout of the section from the electro-conductive member at cross section 92*a* parallel to XZ plane 92. The XZ plane can be rotated 360° about the axis of the electro-conductive member. The electro-conductive member is rotated in contact with a photosensitive drum and discharges in passing through space from the photosensitive drum. In consideration of this, the cross section 92*a* parallel to the XZ plane 92 depicts a surface on which simultaneous discharge occurs at a certain timing. The surface potential of the photosensitive drum is formed by the passage of a fixed amount of a surface corresponding to the cross section 92*a*.

Thus, the analysis of the cross section, such as the cross section 92*a*, on which simultaneous discharge occurs at a certain moment does not suffice for evaluating the shape of the domains, which correlates with electric field concentration within the electro-conductive member. The evaluation needs to be conducted at a cross section parallel to YZ plane 93 perpendicular to the axial direction of the electro-conductive member because a domain shape including a given amount of the cross section 92*a* can be evaluated.

When the length in the longitudinal direction of the electro-conductive layer is defined as L, a total of 3 locations, i.e., cross section 93*b* at the center in the longitudinal direction of the electro-conductive layer, and cross sections (93*a* and 93*c*) at 2 locations of L/4 from both ends of the electro-conductive layer toward the center, are selected for this evaluation.

The following measurement is performed at the observation positions of the cross sections 93*a* to 93*c*: when the thickness of the electro-conductive layer is defined as T, observation regions of 15 μm square are placed at arbitrary 3 locations in a thickness region from 0.1 T or more and 0.9 T or less in depth from the outer surface at each of the sections. The measurement can be performed in the observation regions at a total of 9 locations.

Platinum is deposited in the obtained sections to obtain deposition sections. Subsequently, the surfaces of the deposition sections are photographed under a scanning electron microscope (SEM) (trade name: S-4800, manufactured by Hitachi High-Technologies Corp.) at ×1000 or ×5000 to obtain observed images.

Next, in order to quantify the shape of the domains in the analyzed images, the images are 8-bit grayscaled using image processing software Image-Pro Plus (product name, manufactured by Media Cybernetics Inc.) to obtain black-and-white images with 256 shades of gray. Subsequently, the images are processed by monochrome inversion so as to whiten the domains within the fracture surface to obtain binarized images.

<<Method for Measuring Cross-Sectional Area Ratio μr of Electro-Conductive Particle in Domain>>

The cross-sectional area ratio of the electronically conductive agent in the domain can be measured by quantifying the binarized images of the observed images taken at ×5000.

The images are 8-bit grayscaled using image processing software (trade name: Image-Pro Plus; manufactured by Media Cybernetics Inc.) to obtain black-and-white images with 256 shades of gray. The binarization of the observed images is carried out so as to permit identification of carbon black particles to obtain binarized images. The obtained images are applied to a counting function to calculate cross-sectional areas S of the domains in the analyzed images and total cross-sectional area Sc of carbon black particles as the electronically conductive agent contained in each of the domains.

Then, arithmetic mean value μr of Sc/S at the 9 locations is calculated as the cross-sectional area ratio of the electronically conductive agent in each of the domains.

The cross-sectional area ratio μr of the electronically conductive agent influences the uniformity of the volume resistivity of the domains. The uniformity of the volume resistivity of the domains can be measured as follows, in addition to the measurement of the cross-sectional area ratio μr.

By the measurement method described above, μr/μr is measured as an index for the uniformity of the volume resistivity of the domains from μr and standard deviation σr of μr.

<<Method for Measuring Perimeter A and Envelope Perimeter B of Domain>>

The following items are calculated as to domain groups present in the binarized images of the observed images taken at ×1000 by the counting function of the image processing software:

perimeter A (μm) and envelope perimeter B (μm).

These values are substituted into the following expression (5), and an arithmetic mean value from the evaluated images of the 9 locations is employed:

$$1.00 \leq A/B \leq 1.10 \quad (5)$$

(A: the perimeter of the domain, B: the envelope perimeter of the domain)

<<Method for Measuring Shape Exponent of Domain>>

The shape exponent of the domains can be calculated as the percent by number of domains having μr (% by area) of 20% or more and perimeter ratio A/B that satisfies the expression (5) with respect to the total number of domains. The shape exponent of the domains is preferably 80% by number or more and 100% by number or less.

The binarized images are applied to the counting function of image processing software Image-Pro Plus (manufactured by Media Cybernetics Inc.) to calculate the number of domains in each of the binarized images. The percent by number of domains that satisfy μr≥20 and the expression (5) can be further determined.

A high density of electro-conductive particles filled in the domains as stipulated in the configuration (v) allows the outer shape of the domains to be nearly spherical and can reduce irregularities as stipulated in the configuration (vi).

For obtaining the domains filled with a high density of the electronically conductive agent as stipulated in the configuration (v), the electronically conductive agent preferably has carbon black that absorbs DBP oil in an amount of 40 $cm^3$/100 g or more and 170 $cm^3$/100 g or less.

The amount of DBP oil absorbed ($cm^3$/100 g) refers to the volume of dibutyl phthalate (DBP) adsorbable by 100 g of carbon black and is measured according to Japanese Industrial Standards (JIS) K 6217-4: 2017 (Carbon black for rubber industry—Fundamental characteristics—Part 4: Determination of oil absorption number (OAN) and oil absorption number of compressed sample (COAN)).

In general, carbon black has a botryoidal conformation having aggregated primary particles having an average particle size of 10 nm or larger and 50 nm or smaller. This botryoidal conformation is called structure, and the degree thereof is quantified from the amount of DBP oil absorbed ($cm^3$/100 g).

The electro-conductive carbon black having the amount of DBP oil absorbed within the range described above has a non-fully developed structure and therefore exhibits less aggregation of the carbon black particles and favorable dispersibility in rubbers. Hence, such electro-conductive carbon black can be filled in a large amount in the domains. As a result, domains having a more spherical outer shape can be easily obtained.

The electro-conductive carbon black having the amount of DBP oil absorbed within the range described above is less likely to form an aggregate and therefore facilitates forming the domains related to the requirement (vi).

<Configuration (iv)>

As for the outer surface of the electro-conductive member according to the present disclosure, as described in the section <third requirement>, at least some of the domains serving as an electro-conductive part are exposed as protrusions to the outer surface of the electro-conductive member in order to achieve highly efficient injection charging.

The protrusions are configured to be highly electro-conductively responsive as obtained through an electro-conductive mechanism derived from the matrix-domain structure of the present disclosure, and to be rich in the electronically conductive agent such as carbon black. In such a configuration, the contact of the protrusions alone with a photosensitive drum can be further achieved.

Thus, the electro-conductive member according to the present disclosure can exert highly efficient injection charging from the protrusions derived from the domains present on the outer surface and can therefore uniformize uneven surface potentials even at the contact part with a photosensitive drum.

Specifically, the height of the protrusions derived from the domains is preferably 50 nm or larger and 200 nm or smaller. The height of 50 nm or larger can achieve the contact of the protrusions derived from the domains with a photosensitive drum. The height is more preferably 150 nm or larger. On the other hand, the height of the protrusions is preferably 200 nm or smaller because uneven discharge derived from the protrusions occurs in a discharge region.

The domains that provide protrusions on the outer surface of the electro-conductive member are present such that arithmetic mean value Dms of distances between the protrusions of the adjacent domains (arithmetic mean inter-surface distance) is preferably 2.0 μm or less, particularly preferably 0.2 μm or more and 2.0 μm or less. When the distances between the protrusions fall within the range described above, charge can be injected at many points to the photosensitive drum surface. Hence, the injection charging properties of the protrusions derived from the domains can be improved.

<Method for Forming Protrusion Derived from Domain>

The protrusions derived from the domains can be formed by grinding the surface of the electro-conductive member. The present inventors also believe that since the electro-conductive layer has a matrix-domain structure, the protrusions derived from the domains can be suitably formed by a grinding step using a grindstone. The protrusions derived from the domains are preferably formed by a grinding method using a plunge polishing machine and a polishing grindstone.

A putative mechanism under which the protrusions derived from the domains can be formed by grindstone polishing will be given. First, the domains dispersed in the matrix are filled with the electronically conductive agent such as carbon black and thus more highly reinforced than the matrix unfilled with the electronically conductive agent. Specifically, in the case of performing a grinding process using the same grindstone, the domains, which are highly reinforced, are more resistant to grinding than the matrix and thus easily form protrusions. The protrusions derived from the domains can be formed by exploiting difference in grindability resulting from this difference in reinforcement. Particularly, the electro-conductive member according to the present embodiment is configured such that the domains are filled with a large amount of carbon black. Therefore, the protrusions can be suitably formed.

The polishing grindstone for plunge polishing machines for use in polishing will be described here. The surface roughness of the polishing grindstone can be appropriately selected according to polishing efficiency and the type of the material constituting the electro-conductive layer. This surface roughness of the grindstone can be adjusted by the type, grain size, grade, binder, texture (abrasive grain percentage), etc. of abrasive grains.

The "grain size of abrasive grains" refers to the size of the abrasive grains and is indicated by, for example, #80. In this case, the number means the number of the smallest openings per inch (25.4 mm) in a mesh through which the abrasive grains are screened. A larger number means finer abrasive grains. The "grade of abrasive grains" refers to hardness and is indicated by alphabets A to Z. This grade closer to A means being softer, and the grade closer to Z means being harder. Abrasive grains richer in a binder form a grindstone of harder grade. The "texture of abrasive grains (abrasive grain percentage)" refers to the volume ratio of the abrasive grains to the total volume of the grindstone. The coarseness and fineness of the texture are indicated by a large or small value of this texture. A larger number indicating the texture means being coarser. A grindstone that has a large number of this texture and has large holes is called porous grindstone and has advantages such as the prevention of clogging and grinding burn caused by grindstones.

In general, this polishing grindstone can be produced by mixing raw materials (an abrasive, a binder, a pore forming agent, etc.), followed by press molding, drying, firing and finishing. Green silicon carbide (GC), black silicon carbide (C), white corundum (WA), brown alumina (A), zirconia alumina (Z) or the like can be used as the abrasive grains. These materials can be used alone or as a mixture of two or more thereof. Vitrified (V), resinoid (B), resinoid and reinforced (BF), rubber (R), silicate (S), magnesia (Mg), shellac (E) or the like can be appropriately used as the binder according to a purpose.

In this context, the outside diameter shape in the longitudinal direction of the polishing grindstone is preferably an inverted crown shape in which the outside diameter is gradually decreased from the end parts toward the central part such that the electro-conductive roller can be polished into a crown shape. The outside diameter shape of the polishing grindstone is preferably a shape having a circular curve or a quadratic or higher order curve in the longitudinal direction.

In addition, the outside diameter shape of the polishing grindstone may be a shape represented by any of various mathematical expressions such as a quartic curve and a sine function. For the outer shape of the polishing grindstone, it is preferred that the outside diameter should be smoothly changed. Alternatively, the outer shape may be a shape in which a circular curve or the like is approximated to a polygonal shape with a straight line. The width in a direction corresponding to the axial direction of this polishing grindstone is preferably equivalent to or larger than the width in the axial direction of the electro-conductive roller.

The protrusions derived from the domains can be formed by appropriately selecting the grindstone in consideration of the factors listed above, and carrying out the grinding step under conditions that promote the difference in grindability between the domains and the matrix.

Specifically, the conditions preferably involve controlling polishing or using blunt abrasive grains. The protrusions derived from the domains can be suitably formed, for example, by adopting a unit such as polishing using a treated grindstone for a shortened time of a precision polishing step after roughing-out. Examples of the treated grindstone include grindstones treated with a rubber member, specifically, grindstones treated, for example, by attriting abrasive grains by polishing the surface of a grindstone dressed with a rubber member blended with abrasive grains.

<Method for Confirming Protrusion Derived from Domain>

A thin section including the surface is taken out of the electro-conductive layer. The confirmation of the protrusions derived from the domains and the measurement of the height of the protrusions can be carried out using a microprobe.

Examples of the unit of preparing the thin section include sharp razors, microtomes and FIB. Among these units, FIB which can form a very smooth cross section is preferred. When the length in the longitudinal direction of the electro-conductive layer is defined as L, the cutout position of the electro-conductive layer is 3 locations, i.e., the center in the longitudinal direction, and L/4 from both ends of the electro-conductive layer toward the center.

The thin section for observation may be subjected to a pretreatment, such as staining treatment or deposition treatment, which suitably produces the contrast between the domains as an electro-conductive phase and the matrix as an insulating phase, in order to carry out more accurate observation of the matrix-domain structure.

Subsequently, the surface profile and electrical resistance profile of the thin section sampled from the electro-conductive member are measured under SPM. The protrusions can thereby be confirmed to be protrusions derived from the domains. At the same time therewith, the height of the protrusions can be quantitatively evaluated from a shape profile. For example, an apparatus such as SPM (MFP-3D-Origin, manufactured by Oxford Instruments K.K.) can be used.

The electrical resistance value profile and the shape profile are measured by measuring the surface of the electro-conductive member using the apparatus.

Subsequently, the protrusions in the surface shape profile obtained by the measurement described above are confirmed to be derived from domains having higher electro-conductivity than that of the surroundings in the electrical resistance value profile. The height of the protrusions is further calculated from the profile.

The calculation method involves determining the height by getting the difference between an arithmetic mean value from the shape profile derived from the domains and an arithmetic mean value from the shape profile of the matrix adjacent thereto.

Randomly selected 20 protrusions are measured in each of the sections cut out from the 3 locations, and an arithmetic mean value of the values of a total of 60 protrusions can be calculated.

<Method for Measuring Inter-Surface Distance Dms of Protrusion Derived from Domain>

The method for measuring inter-surface distance Dms of the protrusions derived from the domains can be carried out as follows.

When the length in the longitudinal direction of the electro-conductive layer is defined as L and the thickness of the electro-conductive layer is defined as T, samples including the outer surface of the charging member are cut out using a razor from 3 locations, i.e., the center in the longitudinal direction of the electro-conductive layer, and L/4 from both ends of the electro-conductive layer toward the center. The size of the samples is 2 mm in both the circumferential direction and the longitudinal direction of the charging member, with a thickness set to thickness T of the electro-conductive layer. Analysis regions of 50 μm square are placed at arbitrary 3 locations in a surface corresponding to the outer surface of the charging member as to each of the obtained 3 samples. The 3 analysis regions are photographed under a scanning electron microscope (trade name: S-4800, manufactured by Hitachi High-Technologies Corp.) at ×5000. Each of a total of 9 photographed images thus obtained is binarized using image processing software (trade name: LUZEX; manufactured by Nireco Corp.).

The procedures for binarization are performed as follows: the photographed images are 8-bit grayscaled to obtain black-and-white images with 256 shades of gray. Then, the photographed images are binarized so as to blacken the domains in the images to obtain binarized images of the photographed images. Subsequently, the inter-surface distance of the domains is calculated as to each of the 9 binarized images, and an arithmetic mean value thereof is further calculated. This value is regarded as Dms. The inter-surface distance refers to the distance between the walls of the domains located in the closest vicinity and can be determined by setting a measurement parameter to the distance between adjacent walls in the image processing software.

<Domain Diameter D>

An arithmetic mean value of circle-equivalent diameters D of the domains (hereinafter, also simply referred to as "domain diameters D") is preferably 0.1 μm or larger and 5.0 μm or smaller.

The mean domain diameter D of 0.10 μm or larger can more effectively limit a charge movement pathway in the electro-conductive layer. The mean domain diameter D is more preferably 0.15 μm or larger, further preferably 0.20 μm or larger.

The mean domain diameter D of 5.0 μm or smaller can exponentially increase the ratio of the surface areas to the total volume of the domains, i.e., the specific surface area of the domains, and can drastically improve the release efficiency of charge from the domains. The mean domain diameter D is more preferably 2.0 μm or smaller, further preferably 1.0 μm or smaller, for the reason described above.

For further reducing electric field concentration among the domains, it is preferred that the domains should have a more spherical outer shape. For this purpose, it is preferred that the domain diameters should be smaller within the range described above. Examples of the method therefor include a method which involves kneading MRC and CMB to phase-separate MRC and CMB in the step (iii), and then controlling the domain diameters ascribable to CMB so as to be smaller in the step of preparing a rubber composition including the domains from CMB formed in the matrix from MRC. The decreased domain diameters increase the specific surface area of the domains and increase the interface between the domains and the matrix. Therefore, a tension works at the interface of the domains such that the tension is decreased. As a result, the domains have a more spherical outer shape.

In this context, the following expressions are known about a determinant of a domain diameter (maximum Feret diameter D) in a matrix-domain structure formed by melt-kneading two immiscible polymers.

Taylor's Equation $$D=[C\cdot\sigma/\eta m\cdot\gamma];f(\eta m/\eta d) \tag{6}$$

Wu's Empirical Equation $$\gamma\cdot D\cdot\eta m/\sigma=4(\eta d/\eta m)0.84\cdot\eta d/\eta m>1 \tag{7}$$

$$\gamma\cdot D\cdot\eta m/\sigma=4(\eta d/\eta m)-0.84\cdot\eta d/\eta m<1 \tag{8}$$

Tokita's Equation $$D \cong \frac{12\times P\times\sigma\times\phi}{\pi\times\eta\times\gamma}\left(1+\frac{4\times P\times\phi\times EDK}{\pi\times\eta\times\gamma}\right) \tag{9}$$

In the expressions (6) to (9), D represents the maximum Feret diameter of the domains from CMB, C represents a constant, α represents an interfacial tension, ηm represents the viscosity of the matrix, ηd represents the viscosity of the domains, γ represents a shear rate, η represents the viscosity of a mixing system, P represents the coalescence probability of collision, ϕ represents a domain phase volume, and EDK represents domain phase breaking energy.

In relation to the configuration (iii), decrease in domain size according to the expressions (6) to (9) is effective for the uniformity of the inter-domain surface distances. The matrix-domain structure is further governed by when to stop the kneading step in the course of splitting the raw rubber for the domains in the kneading step to gradually decrease the particle size thereof. Thus, the uniformity of the inter-domain surface distances can be controlled by a kneading time in the kneading process and the number of kneading rotations serving as an exponent for the intensity of the kneading. A longer kneading time or a larger number of kneading rotations can improve the uniformity of the inter-domain surface distances.

Uniformity of Domain Size;

A more uniform domain size, i.e., a narrower particle size distribution, is more preferred. The uniform size distribution of the domains in which charge passes within the electro-conductive layer can suppress charge concentration within the matrix-domain structure and effectively enhance the ease of discharge throughout the surface of the electro-conductive member.

Observation regions of 50 μm square are obtained at arbitrary 3 locations in a thickness region from 0.1 T to 0.9

T in depth in the support direction from the outer surface of the electro-conductive layer at the cross sections of charge transport, i.e., the cross sections in the thickness direction of the electro-conductive layer as illustrated in FIG. 6. In this respect, ratio σd/D of standard deviation ad of the domain sizes to mean value D of the domain sizes (coefficient of variation σd/D) is preferably 0 or more and 0.4 or less, more preferably 0.10 or more and 0.30 or less.

In order to improve the uniformity of the domain diameter, decrease in domain diameter according to the expressions (6) to (9) improves the uniformity of the domain diameter, as in the approach of improving the uniformity of the inter-domain surface distances mentioned above. The uniformity of the domain diameter further varies depending on when to stop the kneading step in the course of splitting the raw rubber for the domains in the step of kneading MRC and CMB to gradually decrease the particle size thereof. Thus, the uniformity of the domain size can be controlled by a kneading time in the kneading process and the number of kneading rotations serving as an exponent for the intensity of the kneading. A longer kneading time or a larger number of kneading rotations can improve the uniformity of the domain size.

Method for Measuring Uniformity of Domain Size;

The uniformity of the domain diameter can be measured by quantifying an image obtained by the direct observation of a fracture surface in the same way as in the measurement of the uniformity of the inter-domain surface distances described above. A specific unit will be mentioned later.

<Method for Confirming Matrix-Domain Structure>

The presence of the matrix-domain structure in the electro-conductive layer can be confirmed by the detailed observation of a fracture surface formed in a thin section prepared from the electro-conductive layer. Specific procedures will be mentioned later.

<Process Cartridge>

Figure 10:
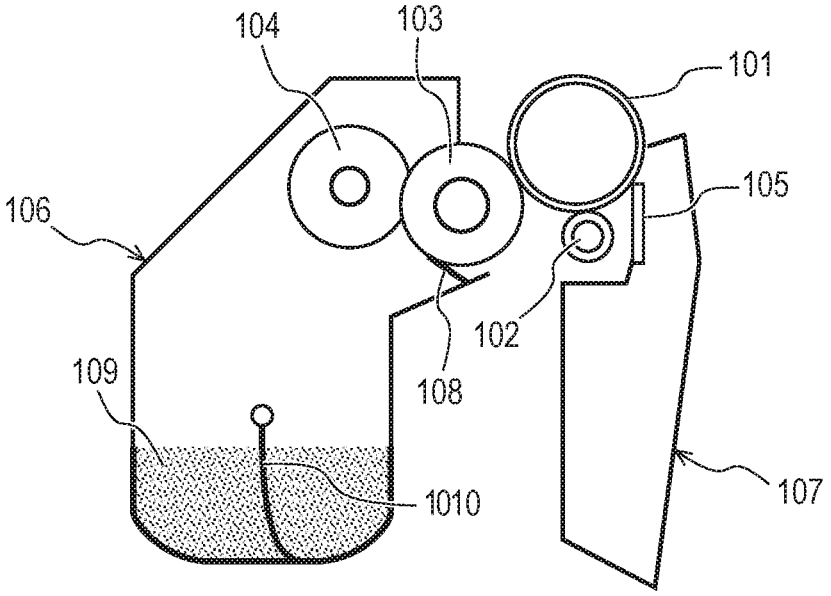
FIG. 10 is an overview diagram of process cartridge.

FIG. 10 is a schematic cross-sectional view of a process cartridge for electrophotography including the electro-conductive member according to the present disclosure as a charging roller. This process cartridge includes a development apparatus and a charging apparatus integrated with each other and is configured to be detachably attachable to a main body of an electrophotographic apparatus. The development apparatus includes at least development roller 103 and toner container 106 integrated with each other and may optionally include toner supply roller 104, toner 109, development blade 108 and stirring blade 1010. The charging apparatus includes at least photosensitive drum 101, cleaning blade 105 and charging roller 102 integrated with each other and may include waste toner container 107. A voltage is applied to each of the charging roller 102, the development roller 103, the toner supply roller 104 and the development blade 108.

<Electrophotographic Apparatus>

Figure 11:
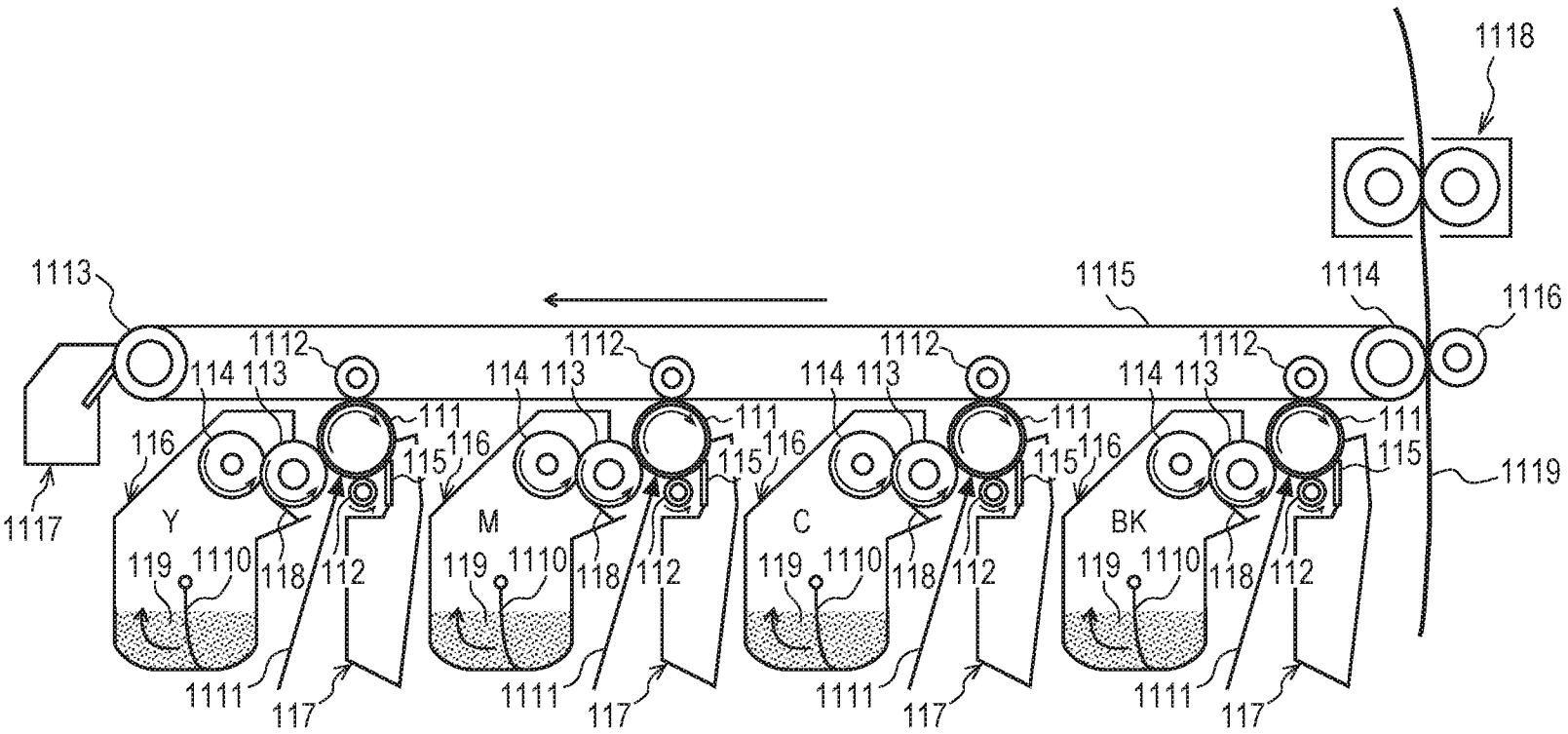
FIG. 11 is an overview diagram of an electrophotographic apparatus.

FIG. 11 is a schematic block diagram of an electrophotographic apparatus employing the electro-conductive member according to the present disclosure as a charging roller. This electrophotographic apparatus is a color electrophotographic apparatus to which four process cartridges described above are detachably mounted. Each process cartridge employs toner of each color (black, magenta, yellow or cyan). Photosensitive drum 111 is rotated in a direction indicated by the arrow, and evenly charged by charging roller 112 to which a voltage has been applied from a charging bias supply. An electrostatic latent image is formed on the surface of the photosensitive drum by exposing light 1111.

Meanwhile, toner 119 stored in toner container 116 is supplied to toner supply roller 114 by stirring blade 1110 and delivered onto development roller 113. Then, the surface of the development roller 113 is uniformly coated with the toner 119 by development blade 118 disposed in contact with the development roller 113, while charge is applied to the toner 119 by frictional charging. The electrostatic latent image is developed by the application of the toner 119 delivered by the development roller 113 disposed in contact with the photosensitive drum 111, and thereby visualized as a toner image.

The visualized toner image on the photosensitive drum is transferred, by primary transfer roller 1112 to which a voltage has been applied from a primary transfer bias supply, to intermediate transfer belt 1115 which is supported and driven by tension roller 1113 and intermediate transfer belt driving roller 1114. The toner images of respective colors are sequentially superimposed to form a color image on the intermediate transfer belt.

Transfer material 1119 is fed into the apparatus by a feed roller and delivered to between the intermediate transfer belt 1115 and secondary transfer roller 1116. A voltage is applied to the secondary transfer roller 1116 from a secondary transfer bias supply, and the color image on the intermediate transfer belt 1115 is transferred to the transfer material 1119 by the secondary transfer roller. The transfer material 1119 with the color image transferred thereto is subjected to fixation treatment by fuser 1118 and ejected from the apparatus to terminate the printing operation.

Meanwhile, toner remaining on the photosensitive drum without being transferred is scraped off by cleaning blade 115 and stored in waste toner container 117. The cleaned photosensitive drum 111 is repetitively subjected to the steps mentioned above. Toner remaining on the primary transfer belt without being transferred is also scraped off by cleaning apparatus 1117.

According to one aspect of the present disclosure, an electro-conductive member can be obtained which is capable of stably charging an object to be charged even when applied to a high-speed electrophotographic image formation process, and can be used as a charging member, a development member or a transfer member. According to another aspect of the present disclosure, a process cartridge that contributes to the formation of an electrophotographic image of high grade can be obtained. According to a further alternative aspect of the present disclosure, an electrophotographic image forming apparatus that can form an electrophotographic image of high grade can be obtained.

EXAMPLES

Example 1

(1. Unvulcanized Rubber Composition for Electro-Conductive Layer Formation)

[1-1. Preparation of Unvulcanized Rubber Composition for Domain Formation (CMB)]

Materials were mixed in the amounts described in Table 1 using a 6 L pressure kneader (product name: TD6-15MDX, manufactured by Toshin Co., Ltd.) to obtain an unvulcanized rubber composition for domain formation. The mixing conditions involved a filling rate of 70 vol %, the number of blade rotations of 30 rpm and 20 minutes.

TABLE 1

| Raw material of unvulcanized rubber composition for domain formation | | |
|---|---|---|
| | Raw material name | Amount (parts by mass) |
| Raw rubber | Styrene-butadiene rubber (trade name: Tufdene 1000, manufactured by Asahi Kasei Corp.) | 100 |
| Electronically conductive agent | Carbon black (trade name: TOKABLACK #5500, manufactured by Tokai Carbon Co., Ltd.) | 60 |
| Vulcanization accelerator | Zinc oxide (trade name: Two Kinds of Zinc Oxides, manufactured by Sakai Chemical Industry Co., Ltd.) | 5 |
| Processing aid | Zinc stearate 11 (trade name: SZ-2000, manufactured by Sakai Chemical Industry Co., Ltd.) | 2 |

[1-2. Preparation of Unvulcanized Rubber Composition for Matrix Formation (MRC)]

Materials were mixed in the amounts described in Table 2 using a 6 L pressure kneader (product name: TD6-15MDX, manufactured by Toshin Co., Ltd.) to obtain an unvulcanized rubber composition for matrix formation. The mixing conditions involved a filling rate of 70 vol %, the number of blade rotations of 30 rpm and 16 minutes.

TABLE 2

| Raw material of unvulcanized rubber composition for matrix formation | | |
|---|---|---|
| | Raw material name | Amount (parts by mass) |
| Raw rubber | Butyl rubber (trade name: JSR Butyl 065, manufactured by JSR Corp.) | 100 |
| Filling agent | Calcium carbonate (trade name: Nanox #30, manufactured by Maruo Calcium Co., Ltd.) | 70 |
| Vulcanization accelerator | Zinc oxide (trade name: Two Kinds of Zinc Oxides, manufactured by Sakai Chemical Industry Co., Ltd.) | 7 |
| Processing aid | Zinc stearate (trade name: SZ-2000, manufactured by Sakai Chemical Industry Co., Ltd.) | 2.8 |

[1-3. Preparation of Unvulcanized Rubber Composition]

CMB and MRC obtained as described above were mixed in the amounts described in Table 3 using a 6 L pressure kneader (product name: TD6-15MDX, manufactured by Toshin Co., Ltd.) to obtain an unvulcanized rubber composition. The mixing conditions involved a filling rate of 70 vol %, the number of blade rotations of 30 rpm and 16 minutes.

TABLE 3

| Raw material of unvulcanized rubber composition | | |
|---|---|---|
| Raw rubber | Unvulcanized rubber composition for domain formation | 25 |
| Raw rubber | Unvulcanized rubber composition for matrix formation | 75 |

[1-4. Preparation of Unvulcanized Rubber Composition for Electro-Conductive Layer Formation]

Materials were mixed in the amounts described in Table 4 using an open roll having a roll diameter of 12 inches to prepare an unvulcanized rubber composition for electro-conductive layer formation. The mixing conditions involved the number of anterior roll rotations of 10 rpm, the number of posterior roll rotations of 8 rpm, and a total of 20 right and left cuts with a roll gap of 2 mm followed by tailing 10 times with a roll gap of 0.5 mm.

TABLE 4

| Raw material of unvulcanized rubber composition for electro-conductive layer formation | | |
|---|---|---|
| | Raw material name | Amount (parts by mass) |
| Raw rubber | Unvulcanized rubber composition | 100 |
| Vulcanizing agent | Sulfur (trade name: SULFAX PMC, manufactured by Tsurumi Chemical Industry Co., Ltd.) | 3 |
| Vulcanization aid | Tetramethylthiuram disulfide (trade name: Nocceler TT-P, manufactured by Ouchi Shinko Chemical Industrial Co., Ltd.) | 3 |

(2. Preparation of Electro-Conductive Member)

[2-1. Provision of Support Having Electro-Conductive Outer Surface]

A round bar of 252 mm in total length and 6 mm in outside diameter was provided as the support having an electro-conductive outer surface by the electroless nickel plating treatment of the surface of free-cutting steel (SUS304).

[2-2. Formation of Electro-Conductive Layer]

A die having an inside diameter of 10.0 mm was attached to the crosshead of a crosshead extruder having a mechanism for supplying an electro-conductive support and a mechanism for discharging an unvulcanized rubber roller. The temperatures of the extruder and the crosshead were adjusted to 80° C., and the delivery rate of the electro-conductive support was adjusted to 60 mm/sec. Under these conditions, the unvulcanized rubber composition for electro-conductive layer formation obtained as described above was supplied from the extruder, and the outer peripheral part of the electro-conductive support was coated with the unvulcanized rubber composition for electro-conductive layer formation in the crosshead to obtain an unvulcanized rubber roller.

Subsequently, the unvulcanized rubber roller was added into a hot-air vulcanization furnace of 160° C. and heated for 60 minutes so that the unvulcanized rubber composition for electro-conductive layer formation was vulcanized to obtain a rubber roller with the electro-conductive layer formed on the outer peripheral part of the electro-conductive support. Then, both end parts of the electro-conductive layer were cut off by 10 mm each to adjust the length in the longitudinal direction of the electro-conductive layer moiety to 232 mm.

[2-3. Polishing of Electro-Conductive Layer]

Next, the surface of the electro-conductive layer in the rubber roller obtained as described above was polished using a rotary grindstone under polishing conditions 1 given below to form protrusions derived from the domains in the electro-conductive layer. The polishing conditions 1 are as follows.

(Polishing Conditions 1)

A grindstone having a hollow cylindrical shape of 305 mm in diameter and 235 mm in length (manufactured by Teiken Corp.) was provided as the grindstone. The type, grain size, grade, binder, texture (abrasive grain percentage) and material of abrasive grains were as follows.

Abrasive grain material: GC (green silicon carbide), (JIS R 6111-2002)
Grain size of abrasive grains: #80 (average particle size: 177 μm; JIS B 4130)
Grade of abrasive grains: HH (JIS R 6210)
Binder: V4PO (vitrified)
Texture of abrasive grains (abrasive grain percentage): 23 (content percentage of abrasive grains: 16%; JIS R 6242)

The surface of the electro-conductive layer was polished using the grindstone described above under the following polishing conditions and polishing scheme.

The polishing conditions involved the number of grindstone rotations of 2100 rpm and the number of electro-conductive member rotations of 250 rpm, while the roughing-out step included bringing the grindstone into contact with the outer periphery of the electro-conductive member at an intrusion speed of 20 mm/sec and then allowing the grindstone to intrude by 0.24 mm into the electro-conductive member.

The precision polishing step included changing the intrusion speed to 1.0 mm/sec, allowing the grindstone to intrude by 0.01 mm into the electro-conductive member, and then separating the grindstone from the electro-conductive member to complete polishing.

An uppercut scheme using the same direction of rotation for the grindstone and the electro-conductive member was adopted as the polishing scheme.

In this way, electro-conductive member A1 was obtained as an electro-conductive roller having a crown shape in which each diameter at position of 90 mm each from the central part toward both end parts was 8.44 mm, and the diameter at the central part was 8.5 mm.

(3. Evaluation of Characteristics)

[3-1] Confirmation of Matrix-Domain Structure

The presence or absence of formation of the matrix-domain structure in the electro-conductive layer was confirmed by the following method.

A section was cut out using a razor so as to permit observation of a cross section perpendicular to the longitudinal direction of the electro-conductive layer in the electro-conductive member. Subsequently, the section was subjected to platinum deposition and photographed under a scanning electron microscope (SEM) (trade name: S-4800, manufactured by Hitachi High-Technologies Corp.) at ×1,000 to obtain a cross-sectional image.

The matrix-domain structure observed in the section from the electro-conductive layer exhibited a form in which a plurality of domains were dispersed in the matrix and were in an independent state without being connected with each other, as illustrated in FIG. 7A, in the cross-sectional image. On the other hand, the matrix was in a continuous state in the image.

In order to further quantify the obtained photographed image, the fracture surface image obtained by observation under SEM was 8-bit grayscaled using image processing software (trade name: Image-Pro Plus, manufactured by Media Cybernetics Inc.) to obtain a black-and-white image with 256 shades of gray. Subsequently, the image was processed by monochrome inversion so as to whiten the domains within the fracture surface. Then, a binarization threshold was set to a luminance distribution of the image based on the algorithm of the discriminant analysis method of Otsu to obtain a binarized image. The binarized image was applied to a counting function to calculate percent K by number of domains that were in isolation without being connected with each other as described above, with respect to the total number of domains that were present in a region of 50 μm square and had no point of contact with the frame border of the binarized image.

Specifically, the counting function of the image processing software was set so as not to count domains having a point of contact with the frame border at the end parts in the 4 direction of the binarized image.

The electro-conductive layer of the electro-conductive member A1 (length in the longitudinal direction: 232 mm) was divided into 5 equal parts in the longitudinal direction and divided into 4 equal parts in the circumferential direction. The section described above was prepared from a total of 20 points including arbitrary one point each from the obtained regions and measured as described above. In this respect, the matrix-domain structure was evaluated as being "present" when arithmetic mean value K (% by number) exceeded 80, and evaluated as being "absent" when arithmetic mean value K (% by number) fell below 80. The results about the "presence or absence of the matrix-domain structure" are described in Tables 6-1 and 6-2.

[3-2] Measurement of Slope at $1.0\times10^5$ Hz to $1.0\times10^6$ Hz, and Impedance at $1\times10^{-2}$ Hz to $1\times10^1$ Hz The electro-conductive member was evaluated for the slope of an impedance at $1.0\times10^5$ to $1.0\times10^6$ Hz and the impedance at $1.0\times10^{-2}$ Hz to $1.0\times10^1$ Hz by measurement described below.

First, a measurement electrode was formed on the electro-conductive member A1 by vacuum platinum deposition under rotation as a pretreatment. In this operation, a belt-like electrode that had a width of 1.5 cm in the longitudinal direction and was uniform in the circumferential direction was formed using a masking tape. The electrode thus formed can minimize the influence of the contact resistance between the measurement electrode and the electro-conductive member through the surface roughness of the electro-conductive member. Subsequently, a measurement electrode on the electro-conductive member side was formed on the electrode such that an aluminum sheet came into contact with the deposited platinum film.

Figure 12:
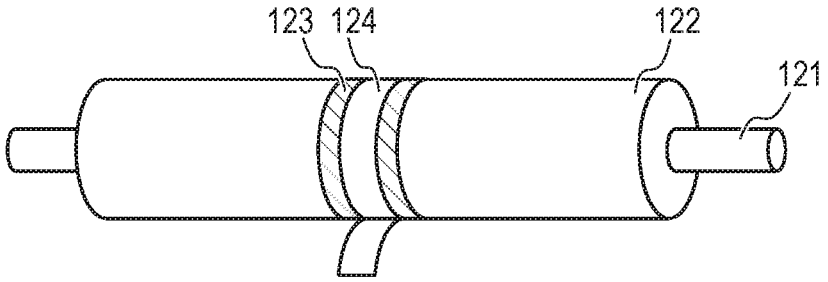
FIG. 12 is an overview diagram of the state of a measurement electrode formed in a charging roller.

FIG. 12 illustrates an overview diagram of the state of the measurement electrode formed on the electro-conductive member. In FIG. 12, reference numeral 121 denotes the electro-conductive support, reference numeral 122 denotes the electro-conductive layer having the matrix-domain structure, reference numeral 123 denotes the deposited platinum layer, and reference numeral 124 denotes the aluminum sheet.

Figure 13:
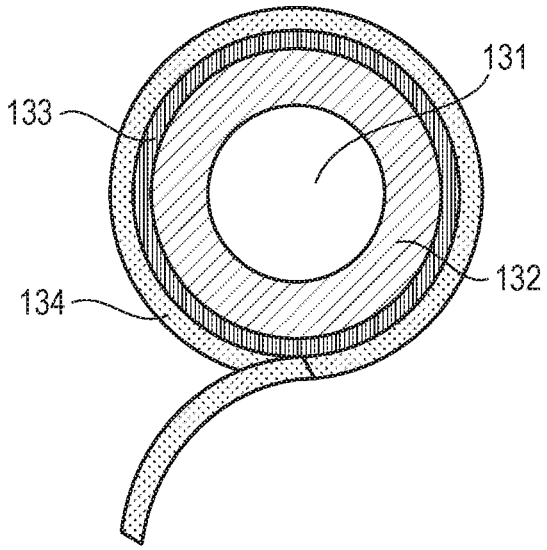
FIG. 13 is a cross-sectional view of a measurement electrode.

FIG. 13 illustrates a cross-sectional view of the state of the measurement electrode formed on the electro-conductive member. Reference numeral 131 denotes the electro-conductive support, reference numeral 132 denotes the electro-conductive layer having the matrix-domain structure, reference numeral 133 denotes the deposited platinum layer, and reference numeral 134 denotes the aluminum sheet. As illustrated in FIG. 13, it is important to sandwich the electro-conductive layer having the matrix-domain structure between the electro-conductive support and the measurement electrode.

Figure 14:
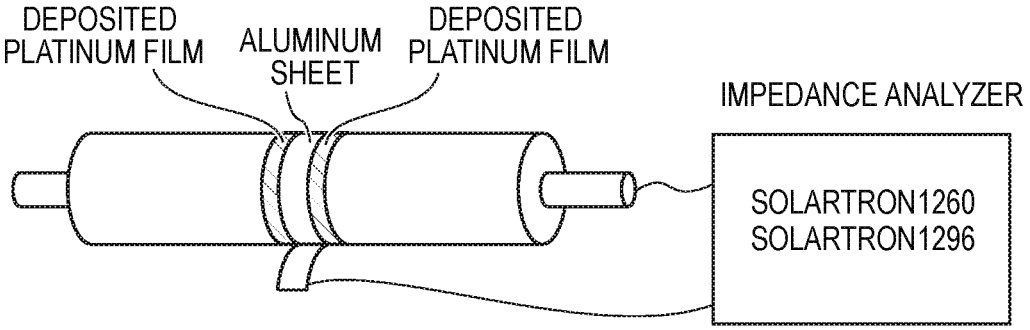
FIG. 14 is an overview diagram of an impedance measurement system.

Then, the aluminum sheet was connected to the measurement electrode on the impedance measurement apparatus (trade name: Solartron 1260 and Solartron 1296 manufactured by Solartron Metrology Ltd.) side. FIG. 14 illustrates an overview diagram of this measurement system. The impedance measurement was performed by using the electro-conductive support and the aluminum sheet as two electrodes for measurement.

For the impedance measurement, the electro-conductive member A1 was left for 48 hours in an environment involving a temperature of 23° C. and a humidity of 50% RH to saturate the amount of water in the electro-conductive member A1.

The impedance was measured at a frequency of $1.0\times10^{-2}$ Hz to $1.0\times10^{7}$ Hz (five measurement points per digit of varying frequencies) using an alternating-current voltage with an amplitude of 1 Vpp in an environment involving a temperature of 23° C. and a humidity of 50% RH to obtain an absolute value of the impedance. Subsequently, the measurement results were plotted in a double logarithmic plot with the absolute value of the impedance and the frequency using commercially available spreadsheet software. Respective arithmetic mean values of (a) the slope at $1.0\times10^{5}$ Hz to $1.0\times10^{6}$ Hz and (b) the absolute value of the impedance at $1.0\times10^{-2}$ Hz to $1.0\times10^{1}$ Hz were calculated from the graph obtained from the double logarithmic plot.

As for the measurement positions, the electro-conductive layer of the electro-conductive member A1 (length in the longitudinal direction: 232 mm) was divided into 5 equal parts in the longitudinal direction, and the measurement electrode was formed at a total of 5 points including arbitrary one point each from these 5 regions. The measurement and the arithmetic mean value calculation described above were performed. The evaluation results are described as the results about "(a) slope" and "(b) impedance" of the electro-conductive layer in Tables 6-1 and 6-2.

[3-3] Measurement of Impedance at $1.0\times10^{-2}$ Hz to $1.0\times10^{1}$ Hz for Electro-Conductive Support The measurement of the impedance at $1.0\times10^{-2}$ Hz to $1.0\times10^{1}$ Hz was performed in the same way as in [3-3] for the electro-conductive support from which the electro-conductive layer of the electro-conductive member A1 was peeled off. The evaluation results are described as the "impedance" of the electro-conductive support in Tables 6-1 and 6-2.

[3-4] Measurement of Volume Resistivity R1 of Matrix

The matrix contained in the electro-conductive layer was evaluated for its volume resistivity by measurement described below. A scanning probe microscope (SPM) (trade name: Q-Scope 250, manufactured by Quesant Instrument Corporation) was operated on the contact mode.

First, an ultrathin section having a thickness of 1 μm was cut out of the electro-conductive layer of the electro-conductive member A1 at a cutting temperature of −100° C. using a microtome (trade name: Leica EM FCS, manufactured by Leica Microsystems GmbH). The ultrathin section was cut out in the direction of a cross section perpendicular to the longitudinal direction of the electro-conductive member, in light of the direction of charge transport for discharge.

Subsequently, the ultrathin section was placed on a metal plate in an environment involving a temperature of 23° C. and a humidity of 50% RH. Then, a location in direct contact with the metal plate was selected, and a cantilever of SPM was brought into contact with a site corresponding to the matrix. A voltage of 50 V was applied to the cantilever for 5 seconds, and current values were measured. An arithmetic mean value of the current values obtained for 5 seconds was calculated.

The surface shape of the measurement section was observed under the SPM. The thickness of the measurement location was calculated from the obtained height profile. The area of a depression at the contact part with the cantilever was further calculated from the results of observing the surface shape. The volume resistivity was calculated from the thickness and the area of a depression and regarded as the volume resistivity of the matrix.

The electro-conductive layer of the electro-conductive member A1 (length in the longitudinal direction: 232 mm) was divided into 5 equal parts in the longitudinal direction and divided into 4 equal parts in the circumferential direction. The section described above was prepared from a total of 20 points including arbitrary one point each from the regions and measured as described above. A mean value therefrom was regarded as volume resistivity R1 of the matrix. The evaluation results are described as the "volume resistivity" of the matrix in Tables 6-1 and 6-2.

[3-5] Measurement of Volume Resistivity R2 of Domain

In order to evaluate the volume resistivity of the domains contained in the electro-conductive layer, the measurement of volume resistivity R2 of the domains was carried out in the same way as in the measurement of the volume resistivity of the matrix except that: the measurement was carried out at a location corresponding to the domains in the ultrathin section; and the voltage for measurement was set to 1 V. The evaluation results are described as the "volume resistivity" of the domains in Tables 6-1 and 6-2.

[3-6] Ratio of Volume Resistivity R1 of Matrix to Volume Resistivity R2 of Domain A common logarithm of the ratio of the volume resistivity R1 of the matrix to the volume resistivity R2 of the domains (R1/R2) was calculated to calculate the volume resistivity ratio of the matrix to the domains. The evaluation results are described as "matrix-domain resistance ratio log(R1/R2)" in Tables 6-1 and 6-2.

[3-7] Evaluation of Index for Uniformity of Volume Resistivity of Domain

The uniformity of the volume resistivity of the domains correlates with the uniformity of the amount of electro-conductive carbon black filled in the domains. Therefore, the quantification of variation in the amount of carbon black in each domain was carried out.

The shape of the domains contained in the electro-conductive layer was evaluated by a method of quantifying observed images obtained under a scanning electron microscope (SEM) as described below by image processing.

A thin section having a thickness of 1 mm was cut out in the same way as in the measurement of the volume resistivity of the matrix. In this thin section, a surface perpendicular to the axis of the electro-conductive support and a fracture surface at a cross section parallel to the surface were obtained. When the length in the longitudinal direction of the electro-conductive layer was defined as L, the cutout position of the electro-conductive layer was 3 locations, i.e., the center in the longitudinal direction, and L/4 from both ends of the electro-conductive layer toward the center. Platinum was deposited in the obtained sections to obtain deposition sections. Subsequently, the surfaces of the deposition sections were photographed under a scanning electron microscope (SEM) (trade name: S-4800, manufactured by Hitachi High-Technologies Corp.) at ×1,000 to obtain observed images.

When the thickness of the electro-conductive layer was defined as T, regions of 15 μm square were subsequently extracted from a total of 9 locations, i.e., arbitrary 3 locations in a thickness region from 0.1 T to 0.9 T in depth from the outer surface of the electro-conductive layer as to each of 3 sections obtained from the 3 measurement positions described above.

Next, in order to quantify the obtained photographed images, the fracture surface images obtained by observation under SEM were 8-bit grayscaled using image processing software (trade name: Image-Pro Plus, manufactured by Media Cybernetics Inc.) to obtain black-and-white images with 256 shades of gray. Subsequently, the images were processed by monochrome inversion so as to whiten the domains within the fracture surface to obtain binarized images. Subsequently, the binarized images were applied to a counting function to calculate cross-sectional areas S of the domains present in the regions of 15 μm square and total cross-sectional area Sc of carbon black particles as the electronically conductive agent in each of the domains. Then, σr/μr was calculated as an index for the uniformity of the volume resistivity of the domains from arithmetic mean value μr and standard deviation σr of ratio Sc/S for the domain groups present in the analyzed images.

In order to calculate the arithmetic mean value μr and the standard deviation σr of Sc/S, one thin section sample each was cut out from a total of the 9 locations and measured as described above, and μr and σr were determined from a total of 9 measurement values. The evaluation results are described as the "volume resistivity uniformity" of the domains in Tables 6-1 and 6-2.

[3-8] Evaluation of Shape of Domain

The shape of the domains was evaluated from arithmetic mean value μr of Sc/S obtained by measuring binarized images obtained in the same way as in [3-7] Evaluation of index for uniformity of volume resistivity of domain, and "perimeter ratio A/B" of the domains obtained by an approach described below.

For the "perimeter ratio A/B" of the domains, binarized images were obtained in the same way as in [3-7] Evaluation of index for uniformity of volume resistivity of domain. The obtained binarized images were applied to a counting function using image processing software (trade name: Image-Pro Plus, manufactured by Media Cybernetics Inc.) to calculate the following items as to the domains present in the regions of 15 μm square:

perimeter A (μm) and envelope perimeter B (μm).

These values were further substituted into the expression (5) given below. The proportion of the number of domains that satisfied conditions of the expressions (4) and (5) was regarded as the "shape exponent" of the domains and calculated as % by number with respect to the total number of domains in each evaluated image. A mean value from the evaluated images of the 9 locations was calculated and regarded as the shape exponent of the domains. The results are described in Tables 6-1 and 6-2. In Tables 6-1 and 6-2, the value obtained by substitution into the expression (5) is described as "electronically conductive agent cross-sectional area ratio μr" and "perimeter ratio A/B".

$$20 \leq \mu r \quad (4)$$

(μr: the arithmetic mean value of Sc/S)

$$1.00 \leq A/B \leq 1.10 \quad (5)$$

(A: the perimeter of the domain, B: the envelope perimeter of the domain)

[3-9] Measurement of Domain Diameter D

In order to measure domain diameter D according to the present disclosure, circle-equivalent diameters were calculated from areas S of the domains obtained in [3-8] Evaluation of shape of domain described above. Specifically, $D=(4S/\pi)^{0.5}$ was calculated using the areas S of the domains.

For the measurement of the domain size, the electro-conductive layer of the electro-conductive member was divided into 4 parts in the circumferential direction and divided into 5 parts in the longitudinal direction. One thin section sample each was cut out from respective arbitrary locations of these regions and measured in the same way as the method for measuring the shape of the domains. A mean value from the evaluated images of the 9 locations was further calculated and regarded as domain diameter D. The results are described as "circle-equivalent diameter D" of the domains in Tables 6-1 and 6-2.

[3-10] Measurement of Particle Size Distribution of Domain

In order to evaluate the uniformity of the domain size, the particle size distribution of the domains was measured by calculating variation in inter-domain surface distances. Specifically, σd/D serving as an index for a particle size distribution was calculated from mean value D and standard deviation ad of domain sizes for the domain size distribution obtained in [3-9] Measurement of domain diameter D. A mean value from the evaluated images of the 9 locations was further calculated. The evaluation results are described as "particle size distribution σd/D" of the domains in Tables 6-1 and 6-2.

[3-11] Measurement of Inter-Domain Surface Distances Dm

Inter-domain surface distances Dm was measured by processing observed images obtained by the observation of the images obtained in [3-9] Measurement of domain diameter D.

Specifically, image processing software (trade name: LUZEX, manufactured by Nireco Corp.) was used in the method for measuring the size of the domains. An arithmetic mean value was calculated from the distribution of inter-domain surface distances. A mean value from the evaluated images of the 9 locations was further calculated and regarded as inter-domain surface distances Dm. The evaluation results are described as "inter-domain surface distances Dm" of the matrix in Tables 6-1 and 6-2.

[3-12] Measurement of Index for Uniformity of Inter-Domain Surface Distances

In order to evaluate the uniformity of the inter-domain surface distances, mean value Dm and standard deviation σm were calculated for the inter-domain surface distances distribution obtained in [3-11] Measurement of inter-domain surface distances Dm to calculate σm/Dm. A mean value from the evaluated images of the 9 locations was further calculated and regarded as an index for the uniformity of the inter-domain surface distances. The evaluation results are described as "inter-domain surface distances uniformity σm/Dm" of the matrix in Tables 6-1 and 6-2.

[3-13] Measurement of Inter-Surface Distances of the Domains by which the Protrusions are Constituted Observed at the Outer Surface of the Electro-Conductive Member, and Calculation of Arithmetic Mean Value Dms When the length in the longitudinal direction of the electro-conductive layer was defined as L and the thickness of the electro-conductive layer was defined as T, samples including the outer surface of the electro-conductive member were cut out using a razor from 3 locations, i.e., the center in the longitudinal direction of the electro-conductive layer, and L/4 from both ends of the electro-conductive layer toward the center. The size of the samples was 2 mm in both the circumferential direction and the longitudinal direction of the electro-conductive member, with a thickness set to thickness T of the electro-conductive layer. Analysis square regions each having 50 μm a side were placed at arbitrary 3 locations in a surface corresponding to the outer surface of the electro-conductive member as to each of the obtained 3 samples.

The 3 analysis square regions were photographed under a scanning electron microscope (trade name: S-4800, manufactured by Hitachi High-Technologies Corp.) at ×5000.

Each of a total of 9 photographed images thus obtained was binarized using image processing software (trade name: LUZEX; manufactured by Nireco Corp.). The procedures for binarization were performed as follows: the photographed images were 8-bit grayscaled to obtain black-and-white images with 256 shades of gray. Then, the photographed images were processed by monochrome inversion and binarized so as to whiten the domains in the images to obtain binarized images of the photographed images. Subsequently, the inter-surface distances of the domains was calculated as to each of the 9 binarized images, and an arithmetic mean value thereof was further calculated. An arithmetic mean value of each of the calculated 9 arithmetic mean values was further calculated and regarded as arithmetic mean value Dms of inter-surface distances of the protrusion constituting domains. The evaluation results are described as "inter-surface distance Dms between protrusions" of the matrix in Tables 6-1 and 6-2.

[3-14] Measurement of Volume Fraction of Domain

The volume fraction of the domains was calculated by the three-dimensional measurement of the electro-conductive layer using FIB-SEM.

Specifically, cross-sectional cutout with focused ion beam and SEM observation were repeated using FIB-SEM (manufactured by FEI Company Japan Ltd.) (mentioned above in detail) to obtain a slice image group.

Then, the matrix-domain structure in the obtained images was three-dimensionally constructed using 3D visualization and analysis software (trade name: Avizo, manufactured by FEI Company Japan Ltd.). Subsequently, the matrix-domain structure was identified by binarization using the analysis software.

In order to further quantify the volume fraction, the volumes of the domains contained in a sample of arbitrary one cubic shape of 10 μm side were calculated in the three-dimensional images, and the ratio thereof to the volume (1000 $\mu m^3$) of the cube of 10 μm side was calculated as the "volume fraction" of the domains.

For the measurement of the volume fraction of the domains, the electro-conductive member was divided into 4 parts in the circumferential direction and divided into 5 parts in the longitudinal direction. One thin section sample each was cut out from respective arbitrary locations of these regions and measured as described above. The volume fraction was calculated from an arithmetic mean of a total of 20 measurement values. The evaluation results are described as the "volume fraction" of the domains in Tables 6-1 and 6-2.

[3-15] Measurement of Protrusion Derived from the Domain

Measurement sections were obtained in the same way as in [3-13] Measurement of inter-surface distance Dms between protrusions of adjacent domains that provide protrusions on outer surface of electro-conductive member. When the length in the longitudinal direction of the electro-conductive layer was defined as L, the cutout position of the electro-conductive layer was 3 locations, i.e., the center in the longitudinal direction, and L/4 from both ends of the electro-conductive layer toward the center.

The surface of the electro-conductive member in the sections including the electro-conductive member surface, obtained as described above was measured using SPM (MFP-3D-Origin, manufactured by Oxford Instruments K.K.) under conditions given below. An electrical resistance value profile and a shape profile were measured by the measurement described above.

Measurement mode: AM-FM mode

Probe: OMCL-AC160TS (trade name; manufactured by Olympus Corp.)

Resonant frequency: 251.825 to 261.08 kHz

Spring constant: 23.59 to 25.18 N/m

Scan rate: 0.8 to 1.5 Hz

Scan size: 10 μm, 5 μm and 3 μm

Target amplitude: 3 V and 4 V

Set point: 2 V for all

Subsequently, protrusions in the surface shape profile obtained by the measurement described above were confirmed to be derived from domains having higher electro-conductivity than that of the surroundings in the electrical resistance value profile. The height of the convex shape was further calculated from the profile.

The calculation method involved determining the height by getting the difference between an arithmetic mean value from the shape profile derived from the domains and an arithmetic mean value from the shape profile of the matrix adjacent thereto. The arithmetic mean value was calculated from the values of randomly selected 20 protrusions measured in each of the sections cut out from the 3 locations. An arithmetic mean value of the heights of a total of 60 protrusions was further calculated. The evaluation results are described as the "height" of the protrusions in Tables 6-1 and 6-2.

(4. Image Evaluation)

[4-1] Evaluation of Charging Ability

The electro-conductive member A1 was confirmed to have the function of suppressing the omission of discharge by evaluation given below.

First, an electrophotographic laser printer (trade name: LaserJET Enterprise M553dn, manufactured by HP Development Company, L.P.) was provided as an electrophotographic apparatus. Next, the electro-conductive member A1, the electrophotographic apparatus and a process cartridge were left for 48 hours in an environment of 23° C. and 50% RH for the purpose of acclimatizing to a measurement environment.

For evaluation in a high-speed process, the laser printer was reconstructed such that the number of sheets to be output per unit time was 75 sheets of A4 size paper per minute, which was larger than the original number of sheets to be output. In this respect, the output speed of a recording medium was set to 370 mm/sec, and the image resolution was set to 1,200 dpi. A pre-exposure apparatus was removed from the laser printer.

The process cartridge was reconstructed, and a surface potential probe (main body: Model 347, probe: Model 3800S-2, manufactured by TREK, Inc.) was installed therein so as to permit measurement of a drum surface potential after a charging process.

The electro-conductive member A1 left in the environment described above was loaded as a charging roller in the process cartridge, which was then mounted to the laser printer.

In the same environment as above, a voltage of −1000 V was applied to the electro-conductive member A1 from an external power supply (Trek 615, manufactured by TREK, Japan), and the surface potential of the photosensitive drum was measured when a solid white image and a solid black image were output. Then, difference in the surface potential of the photosensitive drum after the charging process between the output of the solid black image and the output of the solid white image was calculated as the charging ability of the electro-conductive member A1. The evaluation results are described as "difference in potential between black and white" in Tables 6-1 and 6-2.

[4-2] Ghost Image Evaluation

The electro-conductive member A1 was confirmed by the following method to have the effect of being capable of causing uniform discharge against uneven surface potentials of a photosensitive drum before charging in a high-speed process.

Evaluated images were formed using the laser printer used in the "evaluation of charging ability" described above. In the same way as in the "evaluation of charging ability" described above, the electro-conductive member A1, the laser printer and a process cartridge were left for 48 hours in an environment of 23° C. and 50% RH for the purpose of acclimatizing to a measurement environment, and the evaluated image formation was performed in the same environment as above.

The evaluated images had letters "E" in the upper part of the image, and a halftone pattern from the central to lower parts of the image.

Figure 15:
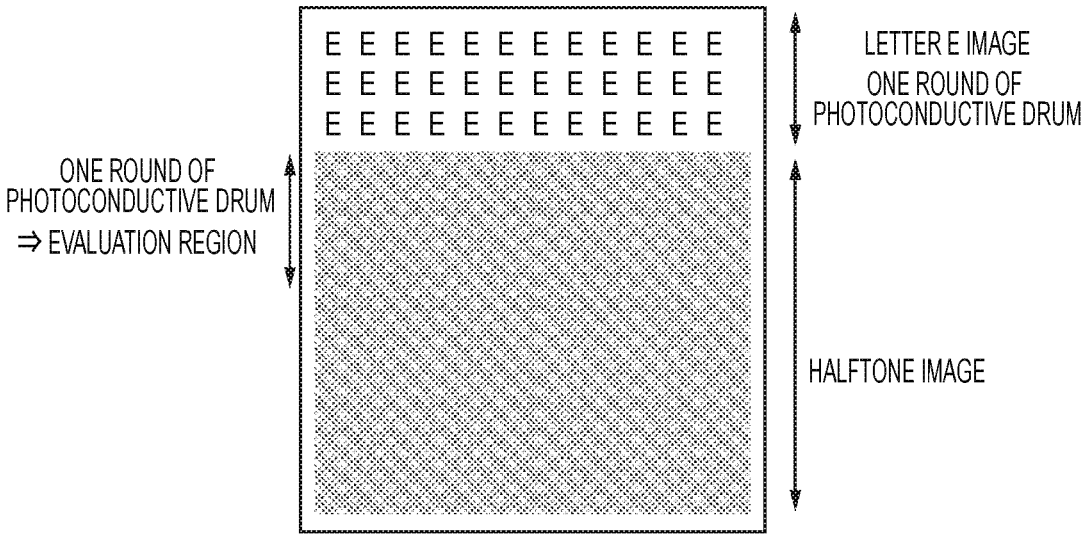
FIG. 15 is an overview diagram of an image for ghost image evaluation.
Figure 16:
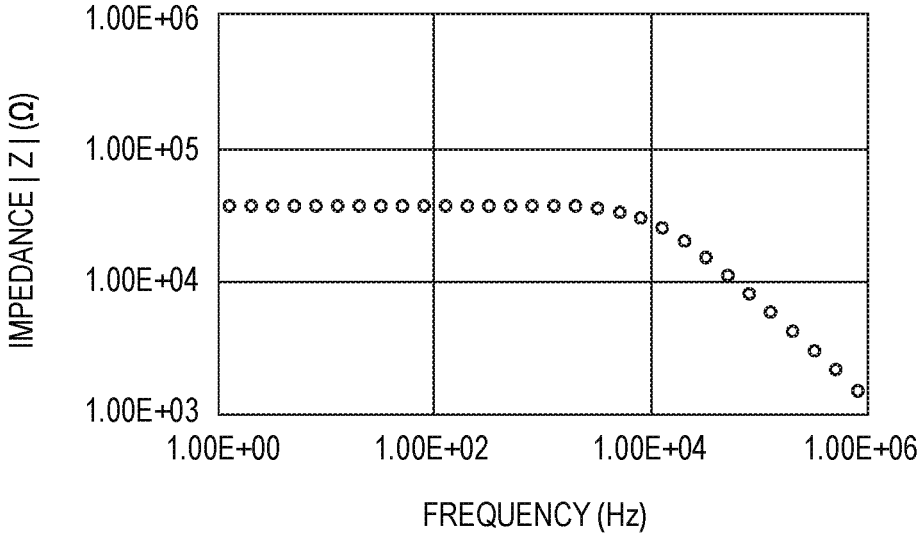
FIG. 16 is a diagram illustrating a double logarithmic plot obtained in Example 17.

Specifically, in the images, alphabetic letters "E" of 4-point size were printed in 10 cm of the upper end of the image such that the coverage was 4% by area of A4 size paper. As a result, the surface potential of a photosensitive drum after a transfer process, i.e., before a charging process, can form unevenness along a surface potential corresponding to the first letter "E", in a region on the order of one round of the photosensitive drum. FIG. 15 illustrates an illustrative view of the evaluated image.

A halftone (horizontal lines with a width of 1 dot and an interval of 2 dots were drawn in a direction perpendicular to the direction of rotation of the photosensitive drum) image was output to a part lower than the 10 cm part. The functionality of the electro-conductive member according to the present disclosure can be determined depending on whether the letters "E" preceding by one round of the photosensitive drum appeared on this halftone image. The criteria for determination are as described below. The results are described in Tables 6-1 and 6-2.

[Evaluation of Letter "E" on Halftone Image]

Rank A: image unevenness derived from the letters "E" was not found on the halftone image even by microscopic observation.

Rank B: image unevenness derived from the letters "E" was not visually found on a portion of the halftone image, but was microscopically observed.

Rank C: an image of the letters "E" was visually found on a portion of the halftone image.

Rank D: an image of the letters "E" was visually found throughout the halftone image, or the evaluation was impossible due to other image defects.

Examples 2 to 31

Electro-conductive members A2 to A31 were produced in the same way as in Example 1 except that the materials and the conditions described in Tables 5A-1 to 5A-4 were used as the raw rubber, the electronically conductive agent, the vulcanizing agent, the vulcanization accelerator and the polishing conditions.

The details of the materials described in Tables 5A-1 to 5A-4 are described in Table 5B-1 for the rubber material, Table 5B-2 for the electronically conductive agent, and Table 5B-3 for the vulcanizing agent and the vulcanization accelerator.

As for the polishing conditions, polishing conditions 1 were as described in Example 1, and polishing conditions 2 and 3 were as given below.

(Polishing Conditions 2)

The polishing conditions 2 were the same as the polishing conditions 1 except that the intrusion speed in the precision polishing step was set to 0.5 mm/sec.

(Polishing Conditions 3)

The polishing conditions 3 were the same as the polishing conditions 1 except that the intrusion speed in the precision polishing step was set to 0.2 mm/sec. The obtained results are described in Tables 6-1 and 6-2.

In Example 29, carbon fiber-reinforced polyether ether ketone (trade name: rPEEK CF30, manufactured by Teijin Ltd.) was molded at a mold temperature of 380° C. using a mold for round bars capable of forming the same shape as that of the support in Example 1. The obtained round bar made of the electro-conductive resin (total length: 252 mm, outside diameter: 6 mm) was used as the support.

In Example 30, a round bar made of an electro-conductive resin was formed in the same way as in Example 29. A 230 mm range including the central part and excluding 11 mm of both end parts in the longitudinal direction of the outer periphery of the round bar was coated throughout the entire circumference with the following adhesive using a roll coater.

Adhesive

An adhesive (trade name: Metaloc N-33, manufactured by Toyokagaku Kenkyusho Co., Ltd.) was diluted into 25% by mass with methyl isobutyl ketone.

After the coating with the adhesive, the adhesive was baked by heating at 180° C. for 30 minutes. In Example 30, the round bar with a primer layer thus obtained was used as the support.

In Example 31, 35 parts by mass of phenol resin (trade name: PR-50716, manufactured by Sumitomo Bakelite Co., Ltd.) and 5 parts by mass of hexamethylenetetramine (trade name: Urotropine, manufactured by Sumitomo Seika Chemicals Co., Ltd.) were melt-kneaded for 3 minutes with a heating roll of 90° C., then taken out, and pulverized into granules. The obtained molding material was injection-molded at a mold temperature of 175° C. to form a round bar. Platinum was deposited throughout the outer surface of the obtained round bar made of the insulating resin, and used as the support.

Each of the charging members obtained in Examples 2 to 31 was measured and evaluated for the same items as those of Example 1.

TABLE 5A-1

| | Electro-conductive support | | Unvulcanized rubber composition for domain | | | | | | | | |
|---|---|---|---|---|---|---|---|---|---|---|---|
| | | | Raw rubber species | | | | Conductive agent | | | Dispersion | Mooney |
| Example | Type | Electro-conductive support | Material abbreviation | | SP value | Mooney viscosity | Type | parts by mass | DBP | time min | viscosity — |
| 1 | SUS | Ni plating | SBR | T1000 | 16.8 | 45 | #5500 | 60 | 155 | 20 | 92 |
| 2 | SUS | Ni plating | SBR | T1000 | 16.8 | 45 | #5500 | 60 | 155 | 20 | 92 |
| 3 | SUS | Ni plating | SBR | T1000 | 16.8 | 45 | #5500 | 60 | 155 | 20 | 92 |

TABLE 5A-1-continued

| | Electro-conductive support | | Unvulcanized rubber composition for domain | | | | | | | | |
|---|---|---|---|---|---|---|---|---|---|---|---|
| | | | Raw rubber species | | | | Conductive agent | | | Dispersion | Mooney |
| Example | Type | Electro-conductive support | Material | abbreviation | SP value | Mooney viscosity | Type | parts by mass | DBP | time min | viscosity — |
| 4 | SUS | Ni plating | EPDM | Esprene505A | 16 | 47 | #5500 | 65 | 155 | 20 | 94 |
| 5 | SUS | Ni plating | SBR | T1000 | 16.8 | 45 | #5500 | 60 | 155 | 20 | 92 |
| 6 | SUS | Ni plating | SBR | T1000 | 16.8 | 45 | #5500 | 60 | 155 | 20 | 92 |
| 7 | SUS | Ni plating | EPDM | Esprene505A | 16 | 47 | #5500 | 65 | 155 | 20 | 94 |
| 8 | SUS | Ni plating | Butyl | JSR Butyl 065 | 15.8 | 32 | #5500 | 65 | 155 | 20 | 93 |
| 9 | SUS | Ni plating | EPDM | Esprene505A | 16 | 47 | #5500 | 65 | 155 | 20 | 94 |
| 10 | SUS | Ni plating | EPDM | Esprene505A | 16 | 47 | #5500 | 65 | 155 | 20 | 94 |
| 11 | SUS | Ni plating | SBR | T1000 | 16.8 | 45 | #5500 | 55 | 155 | 20 | 83 |
| 12 | SUS | Ni plating | SBR | T1000 | 16.8 | 45 | #5500 | 50 | 155 | 20 | 80 |
| 13 | SUS | Ni plating | EPDM | Esprene505A | 16 | 47 | #5500 | 55 | 155 | 20 | 84 |
| 14 | SUS | Ni plating | Butyl | JSR Butyl 065 | 15.8 | 32 | #5500 | 65 | 155 | 20 | 93 |
| 15 | SUS | Ni plating | Butyl | JSR Butyl 065 | 15.8 | 32 | #5500 | 65 | 155 | 20 | 93 |

DBP represents the amount of DBP oil absorbed, and its unit is ($cm^3$/100 g).

As for the Mooney viscosity in the table, the value for the raw rubber is a catalog value, and the value for the unvulcanized rubber composition for the domains is Mooney viscosity ML (1+4) based on JIS K 6300-1: 2013 and was measured at a rubber temperature at which all the materials constituting the unvulcanized rubber composition for the domains were kneaded. The unit of the SP value is $(J/cm^3)^{0.5}$. The same holds true for Table 5A-3.

TABLE 5A-2

| | Unvulcanized rubber composition for matrix | | | | | | Unvulcanized rubber composition | | Unvulcanized rubber dispersion | | | | | |
|---|---|---|---|---|---|---|---|---|---|---|---|---|---|---|
| | Raw rubber species | | | Conductive agent | | | Domain | Matrix | The | | Vulcanizing agent | | Vulcanization accelerator | |
| Example | Material abbreviation | SP value | Mooney viscosity | Type | parts by mass | Mooney viscosity | parts by mass | parts by mass | number of rotations rpm | Kneading min | Material abbreviation | parts by mass | Material abbreviation | parts by mass |
| 1 | JSR Butyl 065 | 15.8 | 32 | — | — | 40 | 25 | 75 | 30 | 16 | Sulfur | 3 | TT | 3 |
| 2 | JSR Butyl 065 | 15.8 | 32 | — | — | 40 | 25 | 75 | 30 | 16 | Sulfur | 3 | TT | 3 |
| 3 | JSR Butyl 065 | 15.8 | 32 | — | — | 40 | 25 | 75 | 30 | 16 | Sulfur | 3 | TT | 3 |
| 4 | JSR Butyl 065 | 15.8 | 32 | — | — | 40 | 25 | 75 | 30 | 16 | Sulfur | 3 | TET | 1 |
| 5 | JSR Butyl 065 | 15.8 | 32 | — | — | 40 | 23 | 77 | 30 | 16 | Sulfur | 3 | TT | 3 |
| 6 | JSR Butyl 065 | 15.8 | 32 | — | — | 40 | 22 | 78 | 30 | 16 | Sulfur | 3 | TT | 3 |
| 7 | T0700 | 17.1 | 43 | — | — | 48 | 25 | 75 | 30 | 16 | Sulfur | 3 | TET | 1 |
| 8 | T1000 | 16.8 | 45 | — | — | 51 | 25 | 75 | 30 | 16 | Sulfur | 3 | TT | 3 |
| 9 | T2003 | 17 | 33 | — | — | 38 | 25 | 75 | 30 | 16 | Sulfur | 3 | TET | 1 |
| 10 | A303 | 17 | 46 | — | — | 52 | 25 | 75 | 30 | 16 | Sulfur | 3 | TET | 1 |
| 11 | JSR Butyl 065 | 15.8 | 32 | — | — | 40 | 25 | 75 | 30 | 16 | Sulfur | 3 | TT | 3 |
| 12 | JSR Butyl 065 | 15.8 | 32 | — | — | 40 | 25 | 75 | 30 | 16 | Sulfur | 3 | TT | 3 |
| 13 | A303 | 17 | 46 | — | — | 52 | 25 | 75 | 30 | 16 | Sulfur | 3 | TET | 1 |
| 14 | T0700 | 17.1 | 43 | — | — | 48 | 23 | 77 | 30 | 16 | Sulfur | 3 | TT | 3 |
| 15 | T0700 | 17.1 | 43 | — | — | 48 | 21 | 79 | 30 | 16 | Sulfur | 3 | TT | 3 |

DBP represents the amount of DBP oil absorbed, and its unit is ($cm^3$/100 g).

As for the Mooney viscosity in the table, the value for the raw rubber is a catalog value, and the value for the unvulcanized rubber composition for the matrix is Mooney viscosity ML (1+4) based on JIS K 6300-1: 2013 and was measured at a rubber temperature at which all the materials constituting the unvulcanized rubber composition for the matrix were kneaded. The unit of the SP value is $(J/cm^3)^{0.5}$. The same holds true for Table 5A-4.

TABLE 5A-3

| | Electro-conductive support | | Unvulcanized rubber composition for domain | | | | | | | | |
|---|---|---|---|---|---|---|---|---|---|---|---|
| | | | Raw rubber species | | | | Conductive agent | | | Dispersion | Mooney |
| Example | Type | Electro-conductive surface | Material abbreviation | | SP value | Mooney viscosity | Type | parts by mass | DBP | time min | viscosity — |
| 16 | SUS | Ni plating | Butyl | JSR Butyl 065 | 15.8 | 32 | #5500 | 65 | 155 | 20 | 93 |
| 17 | SUS | Ni plating | Butyl | JSR Butyl 065 | 15.8 | 32 | #5500 | 55 | 155 | 20 | 80 |
| 18 | SUS | Ni plating | NBR | N230SV | 20 | 32 | #7360 | 70 | 87 | 20 | 90 |
| 19 | SUS | Ni plating | NBR | DN401LL | 17.4 | 32 | #7360 | 70 | 87 | 20 | 90 |
| 20 | SUS | Ni plating | NBR | DN401LL | 17.4 | 32 | #5500 | 50 | 155 | 20 | 78 |
| 21 | SUS | Ni plating | NBR | N230SV | 20 | 32 | #7360 | 70 | 87 | 20 | 90 |
| 22 | SUS | Ni plating | NBR | N230SV | 20 | 32 | #7360 | 50 | 87 | 20 | 57 |
| 23 | SUS | Ni plating | NBR | N230SV | 20 | 32 | #7360 | 70 | 87 | 20 | 90 |
| 24 | SUS | Ni plating | NBR | N230SV | 20 | 32 | #7360 | 50 | 87 | 20 | 57 |
| 25 | SUS | Ni plating | NBR | N220S | 20.4 | 57 | #7360 | 70 | 87 | 20 | 90 |
| 26 | SUS | Ni plating | EPDM | JSR Butyl 065 | 15.8 | 32 | #5500 | 65 | 155 | 20 | 93 |
| 27 | SUS | Ni plating | EPDM | JSR Butyl 065 | 15.8 | 32 | #5500 | 65 | 155 | 10 | 93 |
| 28 | SUS | Ni plating | EPDM | JSR Butyl 065 | 15.8 | 32 | Ketjenblack | 15 | 360 | 20 | 60 |
| 29 | Electro-conductive resin | — | SBR | T1000 | 16.8 | 45 | #5500 | 60 | 155 | 20 | 91 |
| 30 | Electro-conductive resin | Primer | SBR | T1000 | 16.8 | 45 | #5500 | 60 | 155 | 20 | 91 |
| 31 | Insulating resin | Deposited platinum film | SBR | T1000 | 16.8 | 45 | #5500 | 60 | 155 | 20 | 91 |

TABLE 5A-4

| | Unvulcanized rubber composition for matrix | | | | Conductive agent | | | Unvulcanized rubber composition | | Unvulcanized rubbber dispersion | | | | | | |
|---|---|---|---|---|---|---|---|---|---|---|---|---|---|---|---|---|
| | Raw rubber species | | | | | parts | | Domain | Matrix | The number of rotations | Kneading time | Vulcanizing agent | | Vulcanization accelerator | | |
| Example | Material abbreviation | | SP value | Mooney viscosity | Type | parks mass | Mooney viscosity | parts by mass | parts by mass | rotations rpm | time min | Material abbreviation | parts by mass | Material abbreviation | parts by mass | Polishing conditions |
| 16 | SBR | T2003 | 17 | 33 | — | — | 38 | 24 | 76 | 30 | 16 | Sulfur | 3 | TT | 3 | Polishing conditions 1 |
| 17 | BR | T0700 | 17.1 | 43 | — | — | 48 | 23 | 77 | 30 | 16 | Sulfur | 3 | TT | 3 | Polishing conditions 1 |
| 18 | SBR | T2003 | 17 | 33 | — | — | 38 | 25 | 75 | 30 | 16 | Sulfur | 2 | TBZTD | 1 | Polishing conditions 1 |
| 19 | EPDM | Esprene505 A | 16 | 47 | — | — | 52 | 25 | 75 | 30 | 16 | Sulfur | 2 | TET | 1 | Polishing conditions 1 |
| 20 | EPDM | Esprene505 A | 16 | 47 | — | — | 52 | 25 | 75 | 30 | 16 | Sulfur | 3 | TET | 1 | Polishing conditions 1 |
| 21 | EPDM | Esprene505 A | 16 | 47 | — | — | 52 | 25 | 75 | 30 | 16 | Sulfur | 3 | TET | 1 | Polishing conditions 1 |
| 22 | EPDM | Esprene505 A | 16 | 47 | — | — | 52 | 25 | 75 | 30 | 16 | Sulfur | 3 | TET | 1 | Polishing conditions 1 |
| 23 | SBR | T1000 | 16.8 | 45 | — | — | 51 | 25 | 75 | 30 | 16 | Sulfur | 3 | TBZTD | 1 | Polishing conditions 1 |
| 24 | SBR | T1000 | 16.8 | 45 | — | — | 51 | 25 | 75 | 30 | 16 | Sulfur | 3 | TBZTD | 1 | Polishing conditions 1 |
| 25 | EPDM | Esprene505 A | 16 | 47 | — | — | 52 | 25 | 75 | 30 | 16 | Sulfur | 3 | TET | 1 | Polishing conditions 1 |
| 26 | BR | T0700 | 17.1 | 43 | — | — | 48 | 25 | 75 | 20 | 5 | Sulfur | 3 | TT | 3 | Polishing conditions 1 |
| 27 | BR | T0700 | 17.1 | 43 | — | — | 48 | 25 | 75 | 30 | 16 | Sulfur | 3 | TT | 3 | Polishing conditions 1 |
| 28 | BR | T0700 | 17.1 | 43 | — | — | 48 | 25 | 75 | 30 | 16 | Sulfur | 3 | TT | 3 | Polishing conditions 1 |
| 29 | Butyl | JSR Butyl 065 | 15.8 | 32 | — | — | 40 | 25 | 75 | 30 | 16 | Sulfur | 3 | TT | 3 | Polishing conditions 1 |
| 30 | Butyl | JSR Butyl 065 | 15.8 | 32 | — | — | 40 | 25 | 75 | 30 | 16 | Sulfur | 3 | TT | 3 | Polishing conditions 1 |
| 31 | Butyl | JSR Butyl 065 | 15.8 | 32 | — | — | 40 | 25 | 75 | 30 | 16 | Sulfur | 3 | TT | 3 | Polishing conditions 1 |

TABLE 5B-1

| Raw rubber species | | | | |
|---|---|---|---|---|
| Material abbreviation | | Material name | Product name | Manufacturer name |
| Butyl | JSR Butyl 065 | Butyl rubber | JSR Butyl 065 | JSR Corp. |
| BR | T0700 | Polybutadiene rubber | JSR T0700 | JSR Corp. |
| ECO | CG102 | Epichlorohydrin rubber | Epichlomer CG102 | Osaka Soda Co., Ltd. |
| EPDM | Esprene505A | Ethylene-propylene-diene rubber | Esprene 505A | Sumitomo Chemical Co., Ltd. |
| NBR | DN401LL | Acrylonitrile-butadiene rubber | Nipol DN401LL | Zeon Corp. |
| NBR | N230SV | Acrylonitrile-butadiene rubber | JSR N230SV | JSR Corp. |
| NBR | N220S | Acrylonitrile-butadiene rubber | JSR N220S | JSR Corp. |
| SBR | T2003 | Styrene-butadiene rubber | Tufdene 2003 | Asahi Kasei Corp. |
| SBR | T1000 | Styrene-butadiene rubber | Tufdene 1000 | Asahi Kasei Corp. |
| SBR | A303 | Styrene-butadiene rubber | Asaprene 303 | Asahi Kasei Corp. |

TABLE 5B-2

| Conductive agent | | | |
|---|---|---|---|
| Material abbreviation | Material name | Product name | Manufacturer name |
| #7360 | Electro-conductive carbon black | TOKABLACK #7360SB | Tokai Carbon Co., Ltd. |
| #5500 | Electro-conductive carbon black | TOKABLACK #5500 | Tokai Carbon Co., Ltd. |
| Ketjenblack | Electro-conductive carbon black | Carbon EC300J | Lion Specialty Chemicals Co., Ltd. |
| LV | Ionic conductive agent | Adekacizer LV-70 | ADEKA Corp. |

TABLE 5B-3

| Vulcanizing agent and vulcanization accelerator | | | |
|---|---|---|---|
| Material abbreviation | Material name | Product name | Manufacturer name |
| Sulfur | Sulfur | SULFAX PMC | Tsurumi Chemical Industry Co., Ltd. |
| TT | Tetramethylthiuram disulfide | Nocceler TT-P | Ouchi Shinko Chemical Industrial Co., Ltd. |
| TBZTD | Tetrabenzylthiuram disulfide | Sanceler TBZTD | Sanshin Chemical Industry Co., Ltd. |
| TET | Tetraethylthiuram disulfide | Sanceler TET-G | Sanshin Chemical Industry Co., Ltd. |

TABLE 6-1

| | | Impedance characteristics | | | Matrix | | | | Evaluation of characteristics of matrix-domain structure: Domain | | | | | | | | | | Image evaluation | |
|---|---|---|---|---|---|---|---|---|---|---|---|---|---|---|---|---|---|---|---|---|
| Example | Presence or absence of matrix-domain structure | Electro-conductive layer (a) Slope a.u. | Electro-conductive layer (b) Impedance Ω | Electro-conductive support Impedance Ω | Volume resistivity R1 Ω cm | Inter-domain surface distances Dm um | Inter-surface distance between protrusions Dms um | Inter-domain surface distances Uniformity σm/Dm — | Volume resistivity R2 Ω cm | Volume resistivity uniformity μr/σr — | Circle-equivalent diameter D um | Particle size distribution σd/D — | Electronically conductive agent cross-sectional area ratio μr — | Perimeter ratio A/B — | Shape exponent % by number | log(R1/R2) — | Domain volume fraction % | Evaluation of protrusion Height nm | Difference in potential between black and white V | Ghost image — |
| 1 | Present | −0.32 | 1.60E+03 | 2.06E−03 | 5.83E+16 | 0.22 | 0.25 | 0.24 | 1.66E+01 | 0.12 | 0.2 | 0.25 | 23.2 | 1.06 | 90 | 15.5 | 25.1 | 185.0 | 5 | A |
| 2 | Present | −0.32 | 3.11E+03 | 6.76E−04 | 3.92E+16 | 0.21 | 0.23 | 0.25 | 1.32E+01 | 0.12 | 0.21 | 0.24 | 23.4 | 1.05 | 89 | 15.5 | 25.8 | 91.0 | 10 | A |
| 3 | Present | −0.32 | 1.78E+03 | 9.62E−03 | 1.08E+16 | 0.23 | 0.22 | 0.25 | 3.12E+01 | 0.19 | 0.21 | 0.24 | 23.3 | 1.02 | 82 | 14.5 | 25.6 | 46.0 | 40 | C |
| 4 | Present | −0.32 | 2.70E+03 | 2.10E−03 | 6.92E+16 | 0.11 | 0.13 | 0.22 | 2.38E+01 | 0.20 | 0.11 | 0.23 | 24.1 | 1.05 | 87 | 15.5 | 25.4 | 177.0 | 45 | C |
| 5 | Present | −0.32 | 3.96E+03 | 2.80E−03 | 5.09E+16 | 0.85 | 0.88 | 0.24 | 1.26E+01 | 0.11 | 0.21 | 0.22 | 23.3 | 1.09 | 81 | 15.6 | 23.7 | 182.0 | 6 | A |
| 6 | Present | −0.32 | 8.52E+03 | 7.37E−03 | 2.98E+16 | 1.85 | 1.9 | 0.23 | 1.04E+01 | 0.15 | 0.23 | 0.23 | 23.4 | 1.01 | 80 | 15.5 | 22.0 | 189.0 | 7 | A |
| 7 | Present | −0.3 | 2.88E+03 | 8.25E−03 | 5.29E+15 | 0.23 | 0.21 | 0.22 | 4.72E+01 | 0.18 | 0.23 | 0.20 | 24.2 | 1.08 | 82 | 14.0 | 25.2 | 166.0 | 9 | A |
| 8 | Present | −0.45 | 5.78E+03 | 5.43E−03 | 5.10E+14 | 0.24 | 0.23 | 0.23 | 3.04E+01 | 0.13 | 0.23 | 0.24 | 24.2 | 1.07 | 87 | 13.2 | 26.0 | 182.0 | 9 | A |
| 9 | Present | −0.55 | 1.58E+04 | 1.34E−03 | 1.10E+13 | 0.25 | 0.25 | 0.24 | 2.58E+01 | 0.15 | 0.22 | 0.21 | 24.3 | 1.05 | 86 | 11.6 | 26.1 | 199.0 | 15 | A |
| 10 | Present | −0.6 | 3.45E+04 | 8.92E−03 | 1.72E+12 | 0.23 | 0.24 | 0.23 | 3.60E+01 | 0.18 | 0.23 | 0.22 | 24.3 | 1.04 | 90 | 10.7 | 25.1 | 192.0 | 20 | A |
| 11 | Present | −0.38 | 4.57E+04 | 6.55E−03 | 7.62E+16 | 0.25 | 0.23 | 0.25 | 2.80E+02 | 0.15 | 0.22 | 0.21 | 23.0 | 1.08 | 89 | 14.4 | 25.0 | 180.0 | 11 | A |
| 12 | Present | −0.45 | 2.61E+05 | 9.12E−03 | 3.87E+16 | 0.24 | 0.22 | 0.22 | 1.35E+03 | 0.11 | 0.22 | 0.21 | 22.5 | 1.08 | 88 | 13.5 | 25.4 | 170.0 | 16 | A |
| 13 | Present | −0.71 | 3.54E+06 | 9.37E−03 | 1.92E+12 | 0.23 | 0.25 | 0.23 | 9.12E+03 | 0.11 | 0.25 | 0.21 | 23.1 | 1.01 | 84 | 8.3 | 26.0 | 172.0 | 32 | B |
| 14 | Present | −0.38 | 4.30E+04 | 4.47E−03 | 1.68E+15 | 1.11 | 1.12 | 0.25 | 3.98E+01 | 0.15 | 1.11 | 0.23 | 24.1 | 1.01 | 88 | 13.6 | 23.6 | 180.0 | 11 | A |
| 15 | Present | −0.37 | 2.26E+04 | 4.89E−03 | 7.00E+15 | 1.12 | 1.23 | 0.23 | 2.17E+01 | 0.16 | 1.12 | 0.22 | 24.2 | 1.04 | 87 | 14.5 | 21.6 | 178.0 | 11 | A |

TABLE 6-2

| | | Impedance characteristics | | | Evaluation of characteristics of matrix-domain structure | | | | | | | | | | | | | | | |
|---|---|---|---|---|---|---|---|---|---|---|---|---|---|---|---|---|---|---|---|---|
| | | | | | Matrix | | | | Domain | | | | | | | | | | Image evaluation | |
| Example | Presence or absence of matrix-domain structure | Electro-conductive layer (a) Slope a.u. | Electro-conductive layer (b) Impedance Ω | Electro-conductive support Impedance Ω | Volume resistivity R1 Ω cm | Inter-domain surface distances Dm um | Inter-surface distance between protrusions Dms um | Inter-domain surface distances Uniformity σm/Dm — | Volume resistivity R2 Ω cm | Volume resistivity uniformity μr/σr — | Circle-equivalent diameter D um | Particle size distribution σd/D — | Electronically conductive agent cross-sectional area ratio μr — | Perimeter ratio A/B — | Shape exponent % by number | log(R1/R2) — | Domain volume fraction % | Evaluation of protrusion Height nm | Difference in potential between black and white V | Ghost image — |
| 16 | Present | −0.65 | 4.53E+06 | 9.18E−04 | 2.62E+12 | 1.22 | 1.33 | 0.22 | 6.23E+01 | 0.13 | 1.2 | 0.24 | 24.3 | 1.05 | 82 | 10.6 | 24.9 | 199.0 | 20 | A |
| 17 | Present | −0.5 | 4.13E+04 | 1.50E−04 | 4.78E+15 | 1.25 | 1.25 | 0.23 | 8.44E+03 | 0.19 | 1.12 | 0.20 | 23.2 | 1.08 | 84 | 11.8 | 23.5 | 185.0 | 28 | A |
| 18 | Present | −0.71 | 6.24E+06 | 4.77E−03 | 4.52E+12 | 2.01 | 2.33 | 0.24 | 1.37E+01 | 0.15 | 2.02 | 0.23 | 26.1 | 1.02 | 88 | 11.5 | 25.1 | 190.0 | 22 | A |
| 19 | Present | −0.42 | 8.55E+04 | 5.31E−03 | 2.06E+15 | 2.15 | 2.22 | 0.25 | 3.18E+01 | 0.15 | 2.11 | 0.25 | 26.2 | 1.05 | 83 | 13.8 | 26.2 | 190.0 | 14 | A |
| 20 | Present | −0.56 | 1.93E+05 | 5.62E−03 | 4.81E+15 | 2.35 | 2.15 | 0.25 | 9.03E+03 | 0.14 | 2.35 | 0.21 | 22.3 | 1.07 | 89 | 11.7 | 25.8 | 162.0 | 18 | A |
| 21 | Present | −0.6 | 2.36E+05 | 8.15E−03 | 2.01E+15 | 4.55 | 4.69 | 0.22 | 5.47E+01 | 0.14 | 4.55 | 0.22 | 26.3 | 1.08 | 81 | 13.6 | 25.8 | 184.0 | 24 | A |
| 22 | Present | −0.59 | 1.86E+05 | 2.70E−03 | 2.36E+15 | 4.88 | 4.58 | 0.23 | 8.40E+03 | 0.12 | 4.87 | 0.26 | 25.3 | 1.02 | 81 | 11.4 | 26.2 | 163.0 | 26 | A |
| 23 | Present | −0.78 | 5.43E+06 | 1.23E−03 | 4.30E+12 | 4.88 | 4.95 | 0.25 | 5.42E+01 | 0.13 | 4.88 | 0.25 | 26.2 | 1.07 | 88 | 10.9 | 26.2 | 179.0 | 33 | B |
| 24 | Present | −0.78 | 9.93E+06 | 6.85E−03 | 1.75E+12 | 4.65 | 4.75 | 0.25 | 4.58E+03 | 0.18 | 4.65 | 0.24 | 25.2 | 1.02 | 82 | 8.6 | 26.2 | 100.0 | 35 | B |
| 25 | Present | −0.85 | 7.10E+05 | 6.51E−03 | 4.90E+15 | 5.55 | 6.01 | 0.24 | 2.14E+01 | 0.11 | 5.5 | 0.25 | 26.3 | 1.08 | 84 | 14.4 | 25.9 | 75.0 | 45 | C |
| 26 | Present | −0.75 | 2.21E+05 | 4.94E−03 | 5.42E+15 | 2.33 | 2.45 | 0.45 | 2.20E+02 | 0.15 | 2.33 | 0.34 | 24.0 | 1.05 | 55 | 14.4 | 25.2 | 130.0 | 48 | C |
| 27 | Present | −0.77 | 3.09E+05 | 5.61E−04 | 5.15E+15 | 2.92 | 2.77 | 0.23 | 4.01E+03 | 0.62 | 2.2 | 0.22 | 24.3 | 1.08 | 81 | 14.1 | 26.0 | 185.0 | 49 | C |
| 28 | Present | −0.75 | 4.18E+05 | 4.61E−03 | 1.74E+15 | 2.23 | 2.35 | 0.22 | 6.82E+03 | 0.34 | 2.25 | 0.36 | 12.5 | 1.20 | 52 | 13.4 | 25.5 | 177.0 | 48 | C |
| 29 | Present | −0.38 | 5.52E+05 | 1.50E+02 | 1.90E+16 | 0.25 | 0.28 | 0.24 | 4.90E+01 | 0.16 | 0.23 | 0.21 | 23.2 | 1.07 | 89 | 14.6 | 25.5 | 180.0 | 35 | B |
| 30 | Present | −0.35 | 4.20E+05 | 1.00E+01 | 4.86E+16 | 0.25 | 0.23 | 0.22 | 2.51E+01 | 0.12 | 0.26 | 0.22 | 23.1 | 1.05 | 81 | 15.3 | 25.8 | 156.0 | 31 | B |
| 31 | Present | −0.37 | 6.33E+05 | 2.00E+02 | 5.79E+16 | 0.22 | 0.25 | 0.22 | 2.21E+01 | 0.18 | 0.23 | 0.21 | 23.4 | 1.02 | 84 | 15.4 | 25.3 | 170.0 | 40 | A |

Example 32

Electro-conductive member B1 was produced in the same way as in Example 1 except that: the diameter of the electro-conductive support was changed to 5 mm; and the outside diameter after the polishing of the electro-conductive member was set to 10.0 mm.

The electro-conductive member B1 was used as a transfer member to carry out evaluation described below.

An electrophotographic laser printer (trade name: LaserJET M608dn, manufactured by HP Development Company, L.P.) was provided as an electrophotographic apparatus.

First, the electro-conductive member B1 and the laser printer were left for 48 hours in an environment of 23° C. and 50% RH for the purpose of acclimatizing to a measurement environment.

Then, the electro-conductive member B1 was mounted as a transfer member to the laser printer.

For evaluation in a high-speed process, the laser printer was reconstructed such that the number of sheets to be output per unit time was 75 sheets of A4 size paper per minute, which was larger than the original number of sheets to be output. In this respect, the output speed of a recording medium was set to 370 mm/sec, and the image resolution was set to 1,200 dpi. The laser printer was left for 48 hours in an environment involving 23° C. and a relative humidity of 50%.

The electrophotographic apparatus was reconstructed so as to permit measurement of a surface potential on the reverse side, opposite to the surface to which a developing agent would be transferred, of A4 size paper used as a recording medium. The same surface electrometer and probe for surface potential measurement as those of Examples about the charging roller were used.

The difference in surface potential between a location with a developing agent and the developing agent-free reverse side, opposite to the surface to which a developing agent would be transferred, of A4 size paper was evaluated and was consequently 5 V.

COMPARATIVE EXAMPLES

Comparative Example 1

An electro-conductive base layer C1-A for forming an electro-conductive resin layer through extrusion and polishing was produced on a round bar of 252 mm in total length and 6 mm in outside diameter provided by the electroless nickel plating treatment of the surface of free-cutting steel in the same way as in Example 1 except that the materials and the conditions described in Tables 8-1 and 8-2 were used. Subsequently, an electro-conductive resin layer was further established on the electro-conductive base layer C1-A according to a method given below to produce electro-conductive member C1. The electro-conductive member C1 was measured and evaluated in the same way as in Example 1. The results are described in Table 9.

First, methyl isobutyl ketone was added as a solvent to a caprolactone-modified acrylic polyol solution to adjust the solid content to 10% by mass. A mixed solution was prepared using the materials described below in Table 7 with respect to 1000 parts by mass (solid content: 100 parts by mass) of the acrylic polyol solution. In this respect, the mixture of the blocked HDI and the blocked IPDI satisfied functional group molar ratio "NCO/OH=1.0".

TABLE 7

| | Raw material name | Amount (parts by mass) |
|---|---|---|
| Base resin | Caprolactone-modified acrylic polyol solution (solid content: 70% by mass) (trade name: PLACCEL DC2016, manufactured by Daicel Corp.) | 100 (solid content) |
| Curing agent 1 | Blocked isocyanate A (IPDI, solid content: 60% by mass) (trade name: VESTANAT B1370, manufactured by Evonik Japan Co., Ltd.) | 37 (solid content) |
| Curing agent 2 | Blocked isocyanate B (HDI, solid content: 80% by mass) (trade name: DURANATE TPA-B80E, manufactured by Asahi Kasei Chemicals Corp.) | 24 (solid content) |
| Electronically conductive agent | Carbon black (HAF) (trade name: Seast3, manufactured by Tokai Carbon Co., Ltd.) | 15 |
| Additive 1 | Needle-like rutile-type titanium oxide fine particle (trade name: MT-100T, manufactured by TAYCA Corp.) | 35 |
| Additive 2 | Modified dimethylsilicone oil (trade name: DOWSIL SH28 Paint Additive, manufactured by Dow Corning Toray Silicone Co., Ltd.) | 0.1 |

Subsequently, 210 g of the mixed solution and 200 g of glass beads having an average particle diameter of 0.8 mm as media were mixed in a 450 mL glass bottle and preliminarily dispersed for 24 hours using a paint shaker dispersing machine to obtain a coating material for electro-conductive resin layer formation.

The electro-conductive base layer C1-A was immersed, with its the longitudinal direction as a vertical direction, in the coating material for electro-conductive resin layer formation and coated by the dipping method. The immersion time for the dip coating was 9 seconds, and the pulling speed was 20 mm/sec as the initial speed and 2 mm/sec as the final speed, between which the speed was linearly changed with time. The obtained coated product was dried in air at normal temperature for 30 minutes, subsequently dried for 1 hour in a hot air-circulating dryer set to 90° C., and further dried for 1 hour in a hot air-circulating dryer set to 160° C. to obtain electro-conductive member C1. The evaluation results are described in Table 9.

In this Comparative Example, the electro-conductive layer consisted of an elastic layer having a two-layer structure where an electronic conductive resin layer was disposed on the outer periphery of an ionic conductive elastic layer, and was configured to produce a single electro-conductive path as the electro-conductive member. Thus, the slope of the impedance in a high-frequency region was −1, and the ghost image was given rank D.

Comparative Example 2

Electro-conductive member C2 was produced in the same way as in Example 1 except that the materials and the conditions described in Tables 8-1 and 8-2 were used. The electro-conductive member C2 was measured and evaluated in the same way as in Example 1. The results are described in Table 9.

In this Comparative Example, the electro-conductive layer consisted of an electronic conductive elastic layer, and was configured to produce a single electro-conductive path as the electro-conductive member. Thus, the slope of the impedance in a high-frequency region was −1, and the ghost image was given rank D.

Comparative Example 3

Electro-conductive member C3 was produced in the same way as in Example 1 except that the materials and the conditions described in Tables 8-1 and 8-2 were used. The electro-conductive member C3 was measured and evaluated in the same way as in Example 1. The results are described in Table 9.

In this Comparative Example, albeit having the domains and the matrix, the matrix was an ionic conductive base layer and was eventually configured to produce a single electro-conductive path as the electro-conductive member. Thus, the slope of the impedance in a high-frequency region was −1, and the ghost image was given rank D.

Comparative Example 4

Electro-conductive member C4 was produced in the same way as in Example 1 except that the materials and the conditions described in Tables 8-1 and 8-2 were used. The electro-conductive member C4 was measured and evaluated in the same way as in Example 1. The results are described in Table 9.

In this Comparative Example, the matrix had a low volume resistivity and was configured to produce a single electro-conductive path as the electro-conductive member. Thus, the slope of the impedance in a high-frequency region was −1, and the ghost image was given rank D.

Comparative Example 5

Electro-conductive member C5 was produced in the same way as in Example 1 except that the materials and the conditions described in Tables 8-1 and 8-2 were used. The electro-conductive member C5 was measured and evaluated in the same way as in Example 1. The results are described in Table 9.

In this Comparative Example, albeit having the matrix-domain structure, the matrix had a low volume resistivity, which failed to restrict charge movement to the domains so that charge leaked out to the matrix, resulting in reduced ease of discharge. Thus, the impedance in a high-frequency region was increased, and the ghost image was given rank D.

Comparative Example 6

Electro-conductive member C6 was produced in the same way as in Example 1 except that the materials and the conditions described in Tables 8-1 and 8-2 were used. The electro-conductive member C6 was measured and evaluated in the same way as in Example 1. The results are described in Table 9.

In this Comparative Example, albeit having the matrix-domain structure, the domains had a high volume resistivity while the matrix had low resistance and was configured to produce a single continuous electro-conductive path as electro-conductive member. Thus, the slope of the impedance in a high-frequency region was −1, and the ghost image was given rank D.

Comparative Example 7

Electro-conductive member C7 was produced in the same way as in Example 1 except that the materials and the conditions described in Tables 8-1 and 8-2 were used. The electro-conductive member C7 was measured and evaluated in the same way as in Example 1. The results are described in Table 9.

In this Comparative Example, a bicontinuous structure of an electro-conductive phase and an insulating phase was formed instead of the matrix-domain structure and, specifically, configured to produce a single continuous electro-conductive path as electro-conductive member. Thus, the slope of the impedance in a high-frequency region was −1, and the ghost image was given rank D.

Comparative Example 8

[1-1. Preparation of Unvulcanized Rubber Composition]

An unvulcanized rubber composition was prepared in the same way as in [1-1. Preparation of unvulcanized rubber composition for domain formation] of Example 1 using materials in the amounts described in Table 8-3.

TABLE 8-3

Raw material of unvulcanized rubber composition

| | Raw material name | Amount (parts by mass) |
|---|---|---|
| Raw rubber | Polybutadiene rubber (trade name: JSR T0700, manufactured by JSR Corp.) Mooney viscosity ML(1 + 4)100° C.: 43 SP value: 17.1(J/cm3)0.5 | 100 |
| Electronically conductive agent | Electro-conductive carbon black (trade name: TOKABLACK #7360, manufactured by Tokai Carbon Co., Ltd.) Amount of DBP absorbed: 87 cm3/100 g pH: 7.5 | 85 |
| Vulcanization accelerator | Zinc oxide (trade name: Two Kinds of Zinc Oxides, manufactured by Sakai Chemical Industry Co., Ltd.) | 5 |
| Processing aid | Zinc stearate (trade name: SZ-2000, manufactured by Sakai Chemical Industry Co., Ltd.) | 2 |

[1-2. Preparation of Unvulcanized Rubber Composition for Domain Formation]

Materials were kneaded in the amounts described in Table 8-4 under the same conditions as in [1-4. Preparation of unvulcanized rubber composition for electro-conductive layer formation] of Example 1 to prepare an unvulcanized rubber composition for domain formation.

TABLE 8-4

Raw material of unvulcanized rubber composition for domain formation

| | Raw material name | Amount (parts by mass) |
|---|---|---|
| Raw rubber | Rubber composition | 100 |
| Vulcanizing agent | Sulfur (trade name: SULFAX PMC, manufactured by Tsurumi Chemical Industry Co., Ltd.) | 3 |
| Vulcanization aid | Tetraethylthiuram disulfide (trade name: Sanceler TET-G, manufactured by Sanshin Chemical Industry Co., Ltd.) | 1 |

[1-3. Preparation of Vulcanized Rubber Particle for Domain Formation]

The obtained unvulcanized rubber composition for domain formation was placed in a mold having a thickness of 2 mm and vulcanized at a pressure of 10 MPa and a temperature of 160° C. for 30 minutes using a hot press. The rubber sheet was taken out of the mold and cooled to room temperature to obtain a vulcanized rubber sheet of the rubber composition for domain formation having a thickness of 2 mm.

The obtained vulcanized rubber sheet of the rubber composition for domain formation was completely frozen by immersion in liquid nitrogen for 48 hours and then hammered to form a coarse powder. Then, freeze pulverization and classification treatment were performed at the same time using a collision plate type supersonic jet pulverizer (trade name: CPY+USF-TYPE, manufactured by Nippon Pneumatic Mfg. Co., Ltd.) to obtain vulcanized rubber particles for domain formation.

[1-4. Preparation of Unvulcanized Rubber Composition for Matrix Formation]

An unvulcanized rubber composition for matrix formation was prepared in the same way as in [1-2. Preparation of unvulcanized rubber composition for matrix formation (MRC)] of Example 1 using materials in the amounts described in Table 8-5.

TABLE 8-5

Raw material of unvulcanized rubber composition for matrix formation

| | Raw material name | Amount (parts by mass) |
|---|---|---|
| Raw rubber | EPDM (trade name: Esprene 505A manufactured by Sumitomo Chemical Co., Ltd.) SP value: 16.0(J/cm$^3$)$^{0.5}$ | 100 |
| Filling agent | Calcium carbonate (trade name: Nanox #30, manufactured by Maruo Calcium Co., Ltd.) | 70 |
| Vulcanization accelerator | Zinc oxide (trade name: Two Kinds of Zinc Oxides, manufactured by Sakai Chemical Industry Co., Ltd.) | 7 |
| Processing aid | Zinc stearate (trade name: SZ-2000, manufactured by Sakai Chemical Industry Co., Ltd.) | 2.8 |

[1-5. Preparation of Unvulcanized Rubber Composition]

An unvulcanized rubber composition was prepared in the same way as in [1-3. Preparation of unvulcanized rubber composition] of Example 1 using materials in the amounts described in Table 8-6.

TABLE 8-6

Raw material of rubber composition

| | Raw material name | Amount (parts by mass) |
|---|---|---|
| Raw rubber | Vulcanized rubber particle for domain formation | 25 |
| Raw rubber | Unvulcanized matrix composition | 75 |

[1-6. Preparation of Rubber Composition for Electro-Conductive Layer Formation]

A rubber composition for electro-conductive layer formation was prepared in the same way as in [1-4. Preparation of rubber composition for electro-conductive layer formation] of Example 1 using materials in the amounts described in Table 8-7.

TABLE 8-7

Raw material of rubber composition for electro-conductive layer formation

| | Raw material name | Amount (parts by mass) |
|---|---|---|
| Raw rubber | Rubber composition | 100 |
| Vulcanizing agent | Sulfur (trade name: SULFAX PMC, manufactured by Tsurumi Chemical Industry Co., Ltd.) | 3 |
| Vulcanization aid | Tetraethylthiuram disulfide (trade name: Sanceler TET-G, manufactured by Sanshin Chemical Industry Co., Ltd.) | 1 |

Electro-conductive member C8 was produced in the same way as in Example 1 except that the raw materials of the rubber composition for electro-conductive layer formation described above were used. The electro-conductive member C8 was measured and evaluated in the same way as in Example 1. The results are described in Table 9.

In this Comparative Example, electro-conductive paths were nonuniformly formed within the electro-conductive member because anisotropic electro-conductive rubber particles having a large size, formed by freeze pulverization were dispersed. This means that the domains virtually had a large thickness. As a result, the slope of the impedance at a high frequency was −1, and the ghost image was given rank D.

Comparative Example 9

[Preparation of Unvulcanized Hydrin Rubber Composition]

Materials were kneaded in the amounts described in Table 8-8 under the same conditions as in [1-1. Preparation of unvulcanized rubber composition for domain formation] of Example 1 to prepare an unvulcanized hydrin rubber composition.

TABLE 8-8

Raw material of unvulcanized hydrin rubber composition

| | Raw material name | Amount (parts by mass) |
|---|---|---|
| Raw rubber | Epichlorohydrin rubber (EO-EP-AGE ternary copolymer compound) (trade name: Epichlomer CG102, manufactured by Osaka Soda Co., Ltd.; SP value: 18.5 (J/cm$^3$)$^{0.5}$) | 100 |
| Ionic conductive agent | LV-70 (trade name: Adekacizer LV-70, manufactured by ADEKA Corp.) | 3 |
| Plasticizer | Aliphatic polyester plasticizer (trade name: Polycizer P-202, manufactured by DIC Corp.) | 10 |

TABLE 8-8-continued

| Raw material of unvulcanized hydrin rubber composition | | |
|---|---|---|
| | Raw material name | Amount (parts by mass) |
| Filling agent | Calcium carbonate (trade name: Nanox #30, manufactured by Maruo Calcium Co., Ltd.) | 60 |
| Vulcanization accelerator | Zinc oxide (trade name: Two Kinds of Zinc Oxides, manufactured by Sakai Chemical Industry Co., Ltd.) | 5 |
| Processing aid | Zinc stearate (trade name: SZ-2000, manufactured by Sakai Chemical Industry Co., Ltd.) | 1 |

Then, materials were kneaded in the amounts described in Table 8-9 under the same conditions as in the preparation of the rubber composition for electro-conductive layer formation of Example 1 to prepare a hydrin rubber composition for electro-conductive layer formation.

TABLE 8-9

| Hydrin rubber composition for electro-conductive layer formation | | |
|---|---|---|
| | Raw material name | Amount (parts by mass) |
| Raw rubber | Unvulcanized hydrin rubber composition | 100 |
| Vulcanizing agent | Sulfur (trade name: SULFAX PMC, manufactured by Tsurumi Chemical Industry Co., Ltd.) | 1.8 |
| Vulcanization aid 1 | Tetramethylthiuram monosulfide (trade name: Nocceler TS, manufactured by Ouchi Shinko Chemical Industrial Co., Ltd.) | 1 |
| Vulcanization aid 2 | 2-Mercaptobenzimidazole (trade name: Noclac MB, manufactured by Ouchi Shinko Chemical Industrial Co., Ltd.) | 1 |

Next, in the same manner as disclosed in Example 1, the unvulcanized rubber composition for electro-conductive layer was provided.

Figure 17:
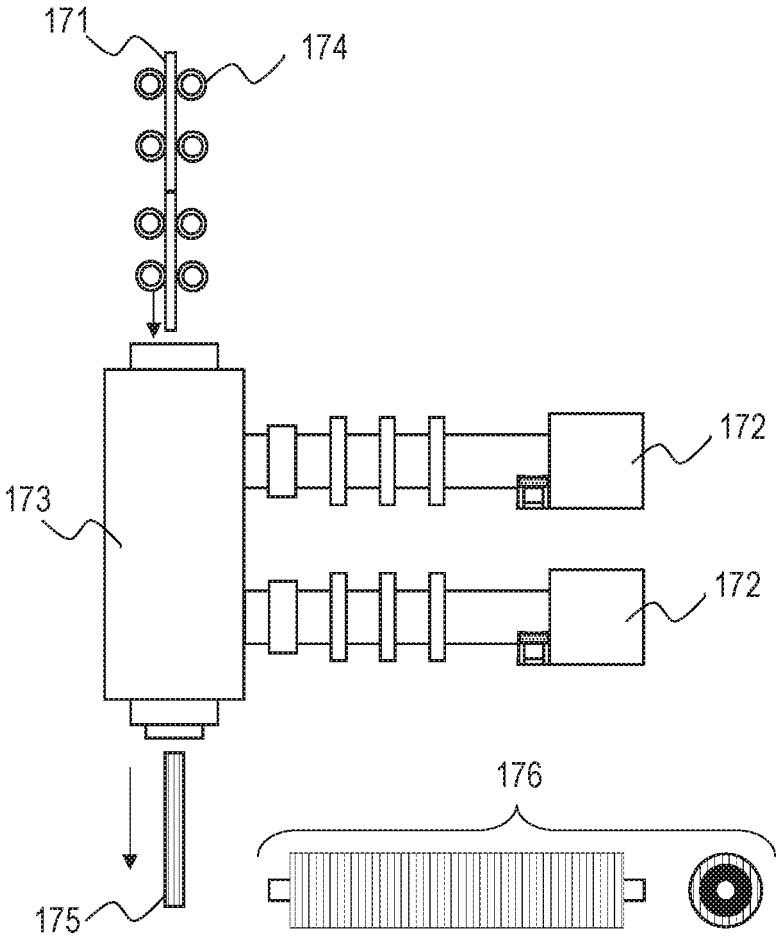
FIG. 17 is an illustrative view of a method for producing an electro-conductive member.

In order to form a layer of the above provided hydrin rubber composition for electro-conductive layer and a layer of the unvulcanized rubber composition around an electro-conductive surface of the mandrel, two-layer extrusion was performed using a two-layer extrusion apparatus as illustrated in FIG. 17. FIG. 17 is a schematic view of a two-layer extrusion step. Extruders 172 include two-layer crosshead 173. A second electro-conductive layer can be laminated on a first electro-conductive layer using two types of unvulcanized rubbers by the two-layer crosshead 173 to prepare electro-conductive member 176. Electro-conductive mandrel 171 sent through mandrel feed rollers 174 rotated in the direction indicated by the arrow is inserted to the two-layer crosshead 173 from behind. Two types of unvulcanized rubber layers in a hollow cylindrical form are integrally extruded at the same time with the mandrel 171 to obtain unvulcanized rubber roller 175 of which laminated unvulcanized rubber layers are formed around a surface of the mandrel.

In the comparative example, the extrusion molding by using the two-layer crosshead, was adjusted such that the temperature was 100° C. and the outside diameter of the extrudate was 10.0 mm. Next, the mandrel was extruded together with the hydrin rubber composition and the unvulcanized rubber composition, and an unvulcanized rubber roller of which a layer of the hydrin rubber composition and a layer of the unvulcanized rubber composition were laminated in this order on the surface of the mandrel, was obtained.

Then, the unvulcanized rubber roller was introduced into a hot-air vulcanization furnace inside of which are maintained at a temperature of 160° C. and heated for 1 hour to vulcanize the layer of the hydrin rubber composition and the layer of the unvulcanized rubber composition to obtain a rubber roller of which a laminated electro-conductive layer including a layer containing a cured hydrin rubber, i.e. a first electro-conductive layer, and a layer having a matrix-domain structure, i.e. a second electro-conductive layer, in this order, was formed on the electro-conductive surface of the mandrel. Then, both end parts of the laminated electro-conductive layer were cut off by 10 mm each to adjust the length in the longitudinal direction thereof to 232 mm.

Finally, the outer surface of the laminated electro-conductive layer was polished with a rotary grindstone to obtain an electro-conductive roller C9 having a crown shape in which each diameter at position of 90 mm each from the central part toward both end parts was 8.4 mm, and the diameter at the central part was 8.5 mm. The electro-conductive roller C9 was measured and evaluated in the same way as in Example 1. The results are described in Table 9. As the electro-conductive roller C9 has the second electro-conductive layer containing a matrix-domain structure, on the first electro-conductive layer which is ionically electro-conductive and has moderate electro-resistivity, the slope of the impedance in a high-frequency region is governed by the characteristics of the first electro-conductive layer, and the slope of the impedance at a high frequency was −1, and the ghost image was given rank D. Here, in Table 9, the value of the impedance of the electro-conductive support of Comparative Example 9, i.e. 2.50 E+06, is the impedance at a frequency of $1.0\times10^{-2}$ Hz to $1.0\times10^{1}$ Hz, which was measured by applying an alternating-current voltage with an amplitude of 1 V to between the outer surface of the support and a platinum electrode directly provided on a surface of the first electro-conductive layer opposed to a surface facing the mandrel in an environment involving a temperature of 23° C. and a relative humidity of 50% while varying the frequency between $1.0\times10^{-2}$ Hz and $1.0\times10^{7}$ Hz.

TABLE 9

| | | Impedance characteristics | | | Matrix | | | | Evaluation of characteristics of matrix-domain structure: Domain | | | | | | | | | | Image evaluation | |
|---|---|---|---|---|---|---|---|---|---|---|---|---|---|---|---|---|---|---|---|---|
| Example | Presence or absence of matrix-domain structure | Electro-conductive layer (a) Slope a.u. | Electro-conductive layer (b) Impedance Ω | Electro-conductive support Impedance Ω | Volume resistivity R1 Ω cm | Inter-domain surface distances Dm um | Outer-surface inter-domain surface distances Dms um | Inter-domain surface distances uniformity σm/Dm — | Volume resistivity R2 Ω cm | Volume resistivity uniformity μr/σr — | Circle-equivalent diameter D um | Particle size distribution σd/D — | Electronically conductive agent cross-sectional area ratio μr % | Perimeter ratio A/B — | Shape exponent % by number | log(R1/R2) — | Domain volume fraction % | Protrusion shape Height nm | Difference in potential between black and white V | Ghost image — |
| 1 | Absent | −1 | 2.56E+08 | 8.79E−04 | — | — | — | — | — | — | — | — | — | — | — | — | — | — | 60 | D |
| 2 | Absent | −1 | 6.22E+07 | 9.51E−04 | — | — | — | — | — | — | — | — | — | — | — | — | — | — | 62 | D |
| 3 | Present | −1 | 5.12E+08 | 5.60E−03 | 1.44E+07 | 1.25 | 1.33 | 0.65 | 1.25E+01 | 0.55 | 1.20 | 0.52 | 13.0 | 1.02 | 55 | 66.1 | 25.1 | 150.0 | 65 | D |
| 4 | Present | −1 | 6.15E+08 | 5.20E−03 | 1.87E+07 | 0.21 | 0.22 | 0.25 | 2.55E+01 | 0.14 | 0.33 | 0.21 | 23.4 | 1.05 | 84 | 5.9 | 24.6 | 160.0 | 66 | D |
| 5 | Present | −1 | 5.16E+08 | 6.33E−03 | 2.58E+09 | 3.2 | 2.8 | 0.26 | 5.21E+01 | 0.16 | 3.00 | 0.25 | 23.3 | 1.02 | 86 | 7.7 | 24.3 | 110.0 | 62 | D |
| 6 | Present | −1 | 2.21E+04 | 9.23E−03 | 9.18E+02 | 0.28 | 0.26 | 0.22 | 2.56E+12 | — | 0.33 | 0.34 | — | 1.02 | — | −9.4 | 75.6 | 12.0 | 60 | D |
| 7 | Absent | −1 | 1.60.E+05 | 5.50E−03 | — | — | — | — | — | — | — | — | — | — | — | — | — | — | 60 | D |
| 8 | Present | −1 | 6.97.E+06 | 4.20.E−03 | 9.27E+15 | 18 | 16 | 0.55 | 8.3.E+01 | 0.22 | 12 | 0.56 | 25.6 | 1.30 | 32 | 14.0 | 25.0 | 32.0 | — | D |
| 9 | Present | −1 | 1.50.E+06 | 2.50E+06 | 8.70E+16 | 0.23 | 0.25 | 0.24 | 6.22E+01 | 0.15 | 0.23 | 0.26 | 23.4 | 1.08 | 82 | 14.1 | 25.2 | 188.0 | 63 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191571, filed Oct. 18, 2019, and Japanese Patent Application No. 2019-069097, filed Mar. 29, 2019, which are hereby incorporated by reference herein in their entirety.

What is claimed is:

1. An electro-conductive member for electrophotography comprising a support having an electro-conductive outer surface, and an electro-conductive layer on the outer surface of the support, the electro-conductive layer having a matrix comprising a first cross-linked rubber, and domains dispersed in the matrix, the domains each comprising a second cross-linked rubber and an electronically conductive agent, at least some of the domains being exposed to an outer surface of the electro-conductive member to constitute protrusions on an outer surface of the electro-conductive member, the outer surface of the electro-conductive member being constituted by the matrix and the domains exposed to the outer surface of the electro-conductive member, wherein in a double logarithmic plot with a frequency on the abscissa and an impedance on the ordinate, a slope at a frequency of $1.0\times10^{5}$ Hz to $1.0\times10^{6}$ Hz is −0.8 or more and −0.3 or less, and an impedance at a frequency of $1.0\times10^{-2}$ Hz to $1.0\times10^{1}$ Hz is $1.0\times10^{3}$ to $1.0\times10^{7}\Omega$, the impedance being measured by applying an alternating-current voltage with an amplitude of 1 V to between the outer surface of the support and a platinum electrode directly provided on the outer surface of the electro-conductive member while varying the frequency between $1.0\times10^{-2}$ Hz and $1.0\times10^{7}$ Hz in an environment involving a temperature of 23° C. and a relative humidity of 50%.

2. The electro-conductive member according to claim 1, wherein the electro-conductive layer is disposed directly on the outer surface of the support.

3. The electro-conductive member according to claim 1, further comprising an electro-conductive resin layer between the electro-conductive layer and the outer surface of the support, wherein an impedance at a frequency of $1.0\times10^{-2}$ Hz to $1.0\times10^{1}$ Hz is $1.0\times10^{-5}$ to $1.0\times10^{2}\Omega$, the impedance being measured by applying an alternating-current voltage with an amplitude of 1 V to between the outer surface of the support and a platinum electrode directly provided on a surface of the resin layer opposed to a surface facing the support, while varying the frequency between $1.0\times10^{-2}$ Hz and $1.0\times10^{7}$ Hz in an environment involving a temperature of 23° C. and a relative humidity of 50%.

4. The electro-conductive member according to claim 1, wherein a volume resistivity of the matrix is larger than $1.0\times10^{12}$ Ω·cm and $1.0\times10^{17}$ Ω·cm or smaller.

5. The electro-conductive member according to claim 1, wherein arithmetic mean value Dm of inter-domain surface distances is 0.2 μm or more and 2.0 μm or less.

6. The electro-conductive member according to claim 1, wherein the protrusions each has a height of 50 nm or larger and 200 nm or smaller.

7. The electro-conductive member according to claim 1, wherein arithmetic mean value Dms of inter-surface distances of the domains by which the protrusions are constituted, the inter-surface distances being measured at the outer surface of the electro-conductive member, is 2.0 μm or less.

8. The electro-conductive member according to claim 1, wherein the support is a cylindrical support, and the electro-conductive layer is disposed on the outer periphery of the cylindrical support.

9. The electro-conductive member for electrophotography according to claim 8, wherein assuming that three cross sections of the electro-conductive layer in a thickness direction thereof at a center in the longitudinal direction of the electro-conductive layer, and L/4 from both ends of the electro-conductive layer toward the center, are obtained, where L represents a length of the electro-conductive layer in the longitudinal direction of the cylindrical support, and assuming that at the each of the cross sections, three square observation areas each having 15 μm a side, are arbitrary placed in a thickness region from 0.1 T to 0.9 T in depth from the outer surface of the electro-conductive layer, where T represents a thickness of the electro-conductive layer, 80% by number or more of domains observed in each of the nine square observation regions, satisfy the following requirement (1) and requirement (2):

Requirement (1): a ratio of a total sum of cross-sectional areas of the electronically conductive agent contained in a domain to be measured to a cross-sectional area of the domain is 20% or more; and Requirement (2): A/B is 1.00 or more and 1.10 or less, where A is a perimeter of the domain, and B is an envelope perimeter of the domain.

10. The electro-conductive member according to claim 1, wherein the electronically conductive agent is electro-conductive carbon black.

11. The electro-conductive member according to claim 10, wherein the electro-conductive carbon black has DBP absorption of 40 $cm^3$/100 g or more and 170 $cm^3$/100 g or less.

12. The electro-conductive member according to claim 1, wherein when an arithmetic mean value of circle-equivalent diameters of the domains is defined as D and standard deviation of a distribution of the D is defined as ad, coefficient of variation σd/D of the circle-equivalent diameters of the domains is 0 or more and 0.4 or less.

13. The electro-conductive member according to claim 1, wherein when an arithmetic mean value of the inter-domain surface distances is defined as Dm and standard deviation of a distribution of the Dm is defined as σm, coefficient of variation σm/Dm of the inter-domain surface distances is 0 or more and 0.4 or less.

14. The electro-conductive member according to claim 1, wherein when a mean value of ratios of cross-sectional areas of moieties of the conductive agent contained in the domains, respectively, appearing in a cross section in the thickness direction of the electro-conductive layer to respective cross-sectional areas of the domains is defined as μr and standard deviation of the ratios is defined as σr, coefficient of variation σr/μr of the ratios of the cross-sectional areas of the moieties of the conductive agent is 0 or more and 0.4 or less.

15. The electro-conductive member according to claim 1, wherein the electro-conductive member is a charging member.

16. The electro-conductive member according to claim 1, wherein the electro-conductive member is a transfer member.

17. A process cartridge configured to be detachably attachable to a main body of an electrophotographic image forming apparatus, comprising an electro-conductive member, the electro-conductive member having a support having an electro-conductive outer surface and an electro-conductive layer on the outer surface of the support, the electro-conductive layer having a matrix comprising a first cross-linked rubber, and domains dispersed in the matrix, the domains each comprising a second cross-linked rubber and an electronically conductive agent, at least some of the domains being exposed to an outer surface of the electro-conductive member to constitute protrusions on an outer surface of the electro-conductive member, the outer surface of the electro-conductive member being constituted by the matrix and the domains exposed to the outer surface of the electro-conductive member, wherein in a double logarithmic plot with a frequency on the abscissa and an impedance on the ordinate, a slope at a frequency of $1.0\times10^{5}$ Hz to $1.0\times10^{6}$ Hz is −0.8 or more and −0.3 or less, and an impedance at a frequency of $1.0\times10^{-2}$ Hz to $1.0\times10^{1}$ Hz is $1.0\times10^{3}$ to $1.0\times10^{7}\Omega$, the impedance being measured by applying an alternating-current voltage with an amplitude of 1 V to between the outer surface of the support and a platinum electrode directly provided on the outer surface of the electro-conductive member while varying the frequency between $1.0\times10^{-2}$ Hz and $1.0\times10^{7}$ Hz in an environment involving a temperature of 23° C. and a relative humidity of 50%.

18. The process cartridge according to claim 17, wherein the electro-conductive member is included as a charging member.

19. An electrophotographic image forming apparatus comprising an electro-conductive member for electrophotography, the electro-conductive member having a support having an electro-conductive outer surface and an electro-conductive layer on the outer surface of the support, wherein the electro-conductive layer having a matrix comprising a first cross-linked rubber, and domains dispersed in the matrix, the domains each comprising a second cross-linked rubber and an electronically conductive agent, at least some of the domains being exposed to an outer surface of the electro-conductive member to constitute protrusions on an outer surface of the electro-conductive member, the outer surface of the electro-conductive member being constituted by the matrix and the domains exposed to the outer surface of the electro-conductive member, wherein in a double logarithmic plot with a frequency on the abscissa and an impedance on the ordinate, a slope at a frequency of $1.0\times10^{5}$ Hz to $1.0\times10^{6}$ Hz is −0.8 or more and −0.3 or less, and an impedance at a frequency of $1.0\times10^{-2}$ Hz to $1.0\times10^{1}$ Hz is $1.0\times10^{3}$ to $1.0\times10^{7}\Omega$, the impedance being measured by applying an alternating-current voltage with an amplitude of 1 V to between the outer surface of the support and a platinum electrode directly provided on the outer surface of the electro-conductive member while varying the frequency between $1.0\times10^{-2}$ Hz and $1.0\times10^{7}$ Hz in an environment involving a temperature of 23° C. and a relative humidity of 50%.

20. The electrophotographic image forming apparatus according to claim 19, wherein the electro-conductive member is included as at least one of a charging member and a transfer member.

* * * * *